US007738799B2

(12) United States Patent
Kikuchi

(10) Patent No.: US 7,738,799 B2
(45) Date of Patent: Jun. 15, 2010

(54) DEVICE UNIT, AN IMAGE FORMING APPARATUS, A MANAGEMENT SYSTEM, AND A RECYCLING SYSTEM CAPABLE OF USING NON-GENUINE DEVICE UNIT AS REPLACEMENT PRODUCT

(75) Inventor: Hideo Kikuchi, Yokohama (JP)

(73) Assignee: Ricoh Company, Ltd, Tokyo (JP)

( * ) Notice: Subject to any disclaimer, the term of this patent is extended or adjusted under 35 U.S.C. 154(b) by 38 days.

(21) Appl. No.: 11/864,359

(22) Filed: Sep. 28, 2007

(65) Prior Publication Data

US 2008/0022053 A1 Jan. 24, 2008

Related U.S. Application Data

(62) Division of application No. 10/922,973, filed on Aug. 23, 2004, now Pat. No. 7,295,787.

(30) Foreign Application Priority Data

Aug. 22, 2003 (JP) ..... 2003-298261
Aug. 22, 2003 (JP) ..... 2003-298889
Nov. 4, 2003 (JP) ..... 2003-373846

(51) Int. Cl.
*G03G 15/00* (2006.01)

(52) U.S. Cl. ..... 399/12

(58) Field of Classification Search ..... 399/12
See application file for complete search history.

(56) References Cited

U.S. PATENT DOCUMENTS 5,132,729 A 7/1992 Matsushita et al.
6,144,812 A 11/2000 Ueno
6,324,351 B1 11/2001 Kurimoto et al.
6,549,732 B2 4/2003 Yoshizaki et al.
6,631,248 B2 10/2003 Serizawa
6,808,255 B1 10/2004 Haines et al.
6,850,715 B2 2/2005 Maehara
6,873,802 B2 3/2005 Koga et al.
6,947,676 B2 9/2005 Hayakawa
7,295,787 B2 * 11/2007 Kikuchi ..... 399/12

(Continued)

FOREIGN PATENT DOCUMENTS

JP 07074875 A * 3/1995

(Continued)

*Primary Examiner*—David M Gray
*Assistant Examiner*—Erika Villaluna
(74) *Attorney, Agent, or Firm*—Oblon, Spivak, McClelland, Maier & Neustadt, L.L.P.

(57) ABSTRACT

A novel device unit is detachably provided to an image forming apparatus having a control unit configured to control the image forming apparatus. The device unit includes a CPU configured to communicate with the control unit; and a memory configured to store property information including information provided through a communication between the CPU and the control unit. The memory includes a write-prohibited area configured to prohibit an information overwriting; a first writable area configured to allow an information writing; and a second writable area configured to controllably allow a one time information overwriting. A recycling system includes a reader/writer configured to communicate with an IC tag provided to the device unit, and a personal computer configured to communicate with the IC tag via the reader/writer and to perform a recycle processing of the device unit.

18 Claims, 33 Drawing Sheets

U.S. PATENT DOCUMENTS

2002/0027676 A1 3/2002 Okunishi et al.

FOREIGN PATENT DOCUMENTS

| | | | |
|---|---|---|---|
| JP | 7-175370 | | 7/1995 |
| JP | 8-248861 | | 9/1996 |
| JP | 10039717 | A | 2/1998 |
| JP | 11-184575 | | 7/1999 |
| JP | 2001-246921 | | 9/2000 |
| JP | 2001-022230 | | 1/2001 |
| JP | 2002-6691 | A | 1/2002 |
| JP | 2002-023570 | | 1/2002 |
| JP | 2003-029583 | | 1/2002 |
| JP | 2002-072781 | | 3/2002 |
| JP | 2002-127460 | | 5/2002 |
| JP | 2002-318511 | | 10/2002 |
| JP | 2002318511 | A | 10/2002 |
| JP | 2003-66708 | | 3/2003 |
| JP | 2003-195694 | A | 7/2003 |

* cited by examiner

FIG. 5A

FIG. 5

| FIG. 5A |
|---|
| FIG. 5B |

| ADDRESS | NO. OF BYTES | CONTENTS |
|---|---|---|
| 00H | 1 | PRODUCT GROUP ID OF PROCESS CARTRIDGE |
| | 1 | VERSION OF PROCESS CARTRIDGE |
| | 1 | COLOR TYPE OF DEVELOPER (COLOR ID) |
| | 4 | EFFECTIVE PERIOD (STORAGE PERIOD) |
| | 4 | NUMBER OF COPIED SHEETS |
| | 1 | NUMBER OF RECYCLING |
| | 4 | RECYCLED DATE |
| | 4 | MALFUNCTION HISTORY |
| | 2 | FILLING AMOUNT OF DEVELOPER |
| | 4 | FILLING DATE OF DEVELOPER |
| | 2 | DEVELOPER REMAINING AMOUNT |
| | 2 | T SENSOR CONTROL INFORMATION |
| | 2 | P SENSOR CONTROL INFORMATION |
| | | |
| 20H | 4 | USAGE START DATE |
| | 1 | USAGE START SIGNAL |
| | 1 | WRITE PROHIBIT FLAG |
| | | |
| | | |
| | | |
| | | |
| | | |
| 30H | 2 | LOT NO. |
| | 1 | MANUFACTURER (MANUFACTURER ID) |

FIRST WRITABLE AREA

SECOND WRITABLE AREA

WHEN A TYPE IS USED

FIG. 5B

| | | | | |
|---|---|---|---|---|
| | 4 | MANUFACTURED DATE | WRITE-PROHIBITED AREA | WHEN B TYPE IS USED |
| | 3 | SERIAL NO. | | |
| | 1 | LIMIT OF NUMBER OF RECYCLING | | |
| | 1 | PRODUCT GROUP ID OF PROCESS CARTRIDGE | | |
| | 1 | VERSION OF PROCESS CARTRIDGE | | |
| | 2 | AMOUNT OF EXPOSED LIGHT | | |
| | 2 | AMOUNT OF CHARGING | | |
| | 2 | DEVELOPING BIAS VOLTAGE | | |
| | | | | |
| | | | | |
| 50H | 1 | PRODUCT GROUP ID OF PROCESS CARTRIDGE | FIRST WRITABLE AREA | |
| | 1 | VERSION OF PROCESS CARTRIDGE | | |
| | 1 | COLOR TYPE OF DEVELOPER (COLOR ID) | | |
| | 4 | EFFECTIVE PERIOD (STORAGE PERIOD) | | |
| | 4 | NUMBER OF COPIED SHEETS | | |
| | 1 | NUMBER OF RECYCLING | | |
| | 4 | RECYCLED DATE | | |
| | 4 | MALFUNCTION HISTORY | | |
| | 2 | FILLING AMOUNT OF DEVELOPER | | |
| | 4 | FILLING DATE OF DEVELOPER | | |
| | 2 | DEVELOPER REMAINING AMOUNT | | |
| | 2 | T SENSOR CONTROL INFORMATION | | |
| | 2 | P SENSOR CONTROL INFORMATION | | |
| | | | | |
| | | | | |

FIG. 13A

FIG. 13
FIG. 13A
FIG. 13B

| ADDRESS | NO. OF BYTES | CONTENTS | |
|---|---|---|---|
| 00H | 1 | PRODUCT GROUP ID OF PROCESS CARTRIDGE | FIRST WRITABLE AREA |
| | 1 | VERSION OF PROCESS CARTRIDGE | |
| | 1 | COLOR TYPE OF DEVELOPER (COLOR ID) | |
| | 4 | EFFECTIVE PERIOD (STORAGE PERIOD) | |
| | 4 | NUMBER OF COPIED SHEETS | |
| | 1 | NUMBER OF RECYCLING | |
| | 4 | RECYCLED DATE | |
| | 4 | MALFUNCTION HISTORY | |
| | 2 | FILLING AMOUNT OF DEVELOPER | |
| | 4 | FILLING DATE OF DEVELOPER | |
| | 2 | DEVELOPER REMAINING AMOUNT | |
| | | | |
| 20H | 4 | USAGE START DATE | SECOND WRITABLE AREA |
| | 1 | USAGE START SIGNAL | |
| | 1 | WRITE PROHIBIT FLAG | |
| | | | |
| | | | |
| | | | |
| | | | |
| | | | |
| 30H | 2 | LOT NO. | |
| | 1 | MANUFACTURER (MANUFACTURER ID) | |

WHEN A TYPE IS USED

FIG. 13B

| | | | | |
|---|---|---|---|---|
| | 4 | MANUFACTURED DATE | WRITE-PROHIBITED AREA | WHEN B TYPE IS USED |
| | 3 | SERIAL NO. | | |
| | 1 | LIMIT OF NUMBER OF RECYCLING | | |
| | 1 | PRODUCT GROUP ID OF PROCESS CARTRIDGE | | |
| | 1 | VERSION OF PROCESS CARTRIDGE | | |
| | 2 | AMOUNT OF EXPOSED LIGHT | | |
| | 2 | AMOUNT OF CHARGING | | |
| | 2 | DEVELOPING BIAS VOLTAGE | | |
| | | | | |
| | | | | |
| 50H | 1 | PRODUCT GROUP ID OF PROCESS CARTRIDGE | FIRST WRITABLE AREA | |
| | 1 | VERSION OF PROCESS CARTRIDGE | | |
| | 1 | COLOR TYPE OF DEVELOPER (COLOR ID) | | |
| | 4 | EFFECTIVE PERIOD (STORAGE PERIOD) | | |
| | 4 | NUMBER OF COPIED SHEETS | | |
| | 1 | NUMBER OF RECYCLING | | |
| | 4 | RECYCLED DATE | | |
| | 4 | MALFUNCTION HISTORY | | |
| | 2 | FILLING AMOUNT OF DEVELOPER | | |
| | 4 | FILLING DATE OF DEVELOPER | | |
| | 2 | DEVELOPER REMAINING AMOUNT | | |
| | | | | |
| | | | | |

FIG. 14A

FIG. 14

| |
|---|
| FIG. 14A |
| FIG. 14B |
| FIG. 14C |

| ADDRESS | NO. OF BYTES | CONTENTS |
|---|---|---|
| 00H | 1 | MANUFACTURER OF IMAGE FORMING APPARATUS (MANUFACTURER ID) |
| | 2 | LOT NO. OF IMAGE FORMING APPARATUS |
| | 4 | MANUFACTURED DATE OF IMAGE FORMING APPARATUS |
| | 1 | PRODUCT GROUP ID OF PROCESS CARTRIDGE WHEN IMAGE FORMING APPARATUS IS SHIPPED FROM FACTORY |
| | 4 | DATE OF WHEN IMAGE FORMING APPARATUS IS SHIPPED FROM FACTORY |
| | 2 | LOT NO. OF PROCESS CARTRIDGE WHEN IMAGE FORMING APPARATUS IS SHIPPED FROM FACTORY |
| | 1 | MANUFACTURER OF PROCESS CARTRIDGE WHEN IMAGE FORMING APPARATUS IS SHIPPED FROM FACTORY (MANUFACTURER ID) |
| | 4 | MANUFACTURED DATE OF PROCESS CARTRIDGE WHEN IMAGE FORMING APPARATUS IS SHIPPED FROM FACTORY |

WRITE-PROHIBITED AREA

WHEN a UNIT IS USED

FIG. 14B

| | | | | |
|---|---|---|---|---|
| | 3 | SERIAL NO. OF PROCESS CARTRIDGE WHEN IMAGE FORMING APPARATUS IS SHIPPED FROM FACTORY | | |
| | 1 | NUMBER OF LIMIT OF RECYCLING OF PROCESS CARTRIDGE WHEN IMAGE FORMING APPARATUS IS SHIPPED FROM FACTORY | | |
| | | | | |
| | | | | |
| | | | | |
| 20H | 1 | PRODUCT GROUP ID OF PROCESS CARTRIDGE | FIRST WRITABLE AREA | WHEN a UNIT IS USED |
| | 1 | VERSION OF PROCESS CARTRIDGE | | |
| | 1 | COLOR TYPE OF DEVELOPER (COLOR ID) | | |
| | 4 | EFFECTIVE PERIOD (STORAGE PERIOD) | | |
| | 4 | NUMBER OF COPIED SHEETS | | |
| | 1 | NUMBER OF RECYCLING | | |
| | 4 | RECYCLED DATE | | |
| | 4 | MALFUNCTION HISTORY | | |
| | 2 | AMOUNT OF EXPOSED LIGHT | | |
| | 2 | AMOUNT OF CHARGING | | |
| | 2 | DEVELOPING BIAS VOLTAGE | | |
| | | | | |
| | | | | |
| | | | | |

FIG. 14C

| | | | | |
|---|---|---|---|---|
| 40H | 4 | USAGE START DATE | SECOND WRITABLE AREA | WHEN b UNIT IS USED |
| | 2 | LOT NO. | | |
| | 1 | MANUFACTURER (MANUFACTURER ID) | | |
| | 4 | MANUFACTURED DATE | | |
| | 3 | SERIAL NO. | | |
| | 1 | LIMIT OF NUMBER OF RECYCLING | | |
| | 1 | WRITE-PROHIBITED FLAG | | |
| | 1 | PRODUCT GROUP ID OF PROCESS CARTRIDGE | | |
| | 1 | VERSION OF PROCESS CARTRIDGE | | |
| | | | | |
| 60H | 1 | PRODUCT GROUP ID OF PROCESS CARTRIDGE | FIRST WRITABLE AREA | |
| | 1 | VERSION OF PROCESS CARTRIDGE | | |
| | 1 | COLOR TYPE OF DEVELOPER (COLOR ID) | | |
| | 4 | EFFECTIVE PERIOD (STORAGE PERIOD) | | |
| | 4 | NUMBER OF COPIED SHEETS | | |
| | 1 | NUMBER OF RECYCLING | | |
| | 4 | RECYCLED DATE | | |
| | 4 | MALFUNCTION HISTORY | | |
| | 2 | AMOUNT OF EXPOSED LIGHT | | |
| | 2 | AMOUNT OF CHARGING | | |
| | 2 | DEVELOPING BIAS VOLTAGE | | |

| FIG. 15A |
| --- |
| FIG. 15B |

FIG. 19

FIG. 19A

FIG. 19B

FIG. 19A

| ADDRESS | NO. OF BYTES | CONTENTS | |
|---|---|---|---|
| 00H | 1 | RECYCLE MANUFACTURER ID | FIRST MEMORY AREA |
| | 1 | REPLACED PART | |
| | 1 | COLOR TYPE OF DEVELOPER (COLOR ID) | |
| | 4 | EFFECTIVE PERIOD (STORAGE PERIOD) | |
| | 4 | NUMBER OF COPIED SHEETS WHEN RECYCLED | |
| | 1 | NUMBER OF RECYCLING | |
| | 4 | RECYCLED DATE | |
| | 2 | FILLING AMOUNT OF DEVELOPER | |
| | 4 | FILLING DATE OF DEVELOPER | |
| | 2 | DEVELOPER REMAINING AMOUNT | |
| | 1 | RECYCLE USAGE FLAG SET | |
| | | | |
| | | | |
| | | | |
| 20H | 4 | USAGE START DATE | THIRD MEMORY AREA |
| | 1 | USAGE START SIGNAL | |
| | 1 | WRITE-PROHIBITED FLAG | |
| | 10 | ABNORMAL HISTORY | |
| | 10 | MALFUNCTION HISTORY | |
| | 4 | NUMBER OF COPIED SHEETS | |
| | 1 | DEVELOPER REMAINING AMOUNT | |
| | | | |
| 30H | 2 | LOT NO. | |
| | 1 | MANUFACTURER (MANUFACTURER ID) | |

WHEN A TYPE IS USED

FIG. 19B

| | | | | |
|---|---|---|---|---|
| | 4 | MANUFACTURED DATE | SECOND MEMORY AREA | WHEN B TYPE IS USED |
| | 3 | SERIAL NO. | | |
| | 1 | LIMIT OF NUMBER OF RECYCLING | | |
| | 1 | PRODUCT GROUP ID AVAILABLE FOR PROCESS CARTRIDGE | | |
| | 1 | VERSION OF PROCESS CARTRIDGE | | |
| | 2 | AMOUNT OF EXPOSED LIGHT | | |
| | 2 | AMOUNT OF CHARGING | | |
| | 2 | DEVELOPING BIAS VOLTAGE | | |
| | 3 | DEVELOPER PROPERTY INFORMATION | | |
| | 10 | TO BE REPLACED PART INFORMATION | | |
| | | | | |
| | | | | |
| 60H | 1 | RECYCLE MANUFACTURER ID | FIRST MEMORY AREA | |
| | 1 | REPLACED PART | | |
| | 1 | COLOR TYPE OF DEVELOPER (COLOR ID) | | |
| | 4 | EFFECTIVE PERIOD (STORAGE PERIOD) | | |
| | 4 | NUMBER OF COPIED SHEETS WHEN RECYCLED | | |
| | 1 | NUMBER OF RECYCLING | | |
| | 4 | RECYCLED DATE | | |
| | 2 | FILLING AMOUNT OF DEVELOPER | | |
| | 4 | FILLING DATE OF DEVELOPER | | |
| | 2 | DEVELOPER REMAINING AMOUNT | | |
| | 1 | RECYCLE USAGE FLAG SET | | |

DEVICE UNIT, AN IMAGE FORMING APPARATUS, A MANAGEMENT SYSTEM, AND A RECYCLING SYSTEM CAPABLE OF USING NON-GENUINE DEVICE UNIT AS REPLACEMENT PRODUCT

CROSS-REFERENCE TO RELATED APPLICATIONS

This application is a divisional application of application Ser. No. 10/922,973, filed Aug. 23, 2004, which claims priority from Japanese patent applications No. 2003-298889 filed on Aug. 22, 2003, No. 2003-298261 filed on Aug. 22, 2003, and No. 2003-373846 filed on Nov. 4, 2003 in the Japan Patent Office, the entire contents of each of which are hereby incorporated by reference herein.

BACKGROUND OF THE INVENTION

1. Field of the Invention

The present invention relates to a device unit detachably provided to an image forming apparatus such as copier, printer, facsimile or composite machines, an image forming apparatus, a management system configured to administer the image forming apparatus and operational statuses of the image forming apparatus, and a recycling system configured to recycle the device unit to use as a replacement product.

2. Discussion of the Background

Conventionally, image forming apparatuses such as a color copier are provided with a device unit (or process cartridge) detachable from the image forming apparatus.

As for such image forming apparatuses, when an existing device unit ends a lifetime or becomes malfunctioned, an operator such as a user and a service person performs a maintenance operation of replacing the existing device unit with a device unit of a new and unused state.

The device unit of a new and unused state includes a unit newly manufactured at a factory, and a recycle unit collected after using in the image forming apparatus and recycled in a recycle factory.

With an awareness of resource saving becoming more and more popular, manufacturing (i.e. recycle processing) of recycle units has been performed by manufacturers different from a manufacturer of image forming apparatuses.

Hereinafter, a device unit which is manufactured by a same manufacturer of an image forming apparatus is termed as "genuine product," and such manufacturer is termed as a "genuine manufacturer." Alternatively, a device unit which is manufactured by a manufacturer different from the above-mentioned "genuine manufacturer" is termed as a "non-genuine product," and such a manufacturer is termed as "non-genuine manufacturer." In addition, manufacturing a device unit means manufacturing a new product or recycling a used product.

A conventional image forming apparatus is detachably provided with a process cartridge having a nonvolatile memory, which communicates with a memory installed in the image forming apparatus. Specifically, writing timing is controlled to perform writing only when the writing is necessary to the nonvolatile memory and to prohibit writing to the nonvolatile memory in another time in order to prevent miss-writing to the nonvolatile memory of the process cartridge by noise signal.

Another conventional image forming apparatus is detachably provided with a process cartridge having an IC tag, which communicates with a control unit installed in the image forming apparatus, and using information stored in the IC tag when recycling. Specifically, when it is determined that an installed process cartridge is an unqualified one for normal operation based on the information obtained from the IC tag, an image forming condition of the image forming apparatus is downgraded from a normal level. With such a configuration, a user recognizes the process cartridge as an unqualified one, and thus, use of a pirate product is prevented. And to prevent an illegal recycle processing such as putting the IC tag used in a qualified process cartridge to an unqualified process cartridge, "Used" information is written to the IC tag when the process cartridge is installed in the image forming apparatus.

Another conventional image forming apparatus is detachably provided with a process cartridge having a memory, which communicates with a control unit installed in the image forming apparatus. Specifically, when it is determined that the installed process cartridge is not a genuine product based on the information obtained from the memory, the image forming apparatus stops its operation. And when the process cartridge is recycled, the process cartridge is verified by a host data base before clearing a memory, and a new information is written to the memory.

The above-mentioned conventional image forming apparatuses have experienced degradation of image quality of image output after replacing a process cartridge. Specifically, the degradation is caused as follows.

An image forming apparatus is manufactured by installing a process cartridge therein at a factory and a number of adjustments are made before shipping.

The adjustments include a precise adjustment to secure superior image quality. An image forming apparatus and a process cartridge may need precise adjustment on a unit-by-unit basis. That is, if a process cartridge installed in a fully adjusted image forming apparatus is replaced with another process cartridge, an exact same image quality may not be obtained for image output in many cases.

Such problems emerge when an operator performs a maintenance operation for an image forming apparatus. Specifically, when an existing process cartridge is replaced with a new process cartridge due to lifetime or malfunction of the existing process cartridge, the image forming apparatus may experience degradation of image quality for image output.

If the process cartridge for replacement is a non-genuine product, the above-mentioned problem may become a serious issue for a genuine manufacturer of the image forming apparatus because the non-genuine product is manufactured by a non-genuine manufacturer, and is not managed by the genuine manufacturer. Accordingly, a method for the above-described precise adjustment to a non-genuine product may not be known, and thus cannot be performed.

Similarly, if the process cartridge for replacement is a recycled product manufactured by a non-genuine manufacturer, the above-mentioned problem may become a serious issue for a genuine manufacturer.

The non-genuine product may be produced: by collecting a genuine product and performing recycle processing by a non-genuine manufacturer; by collecting a non-genuine product and performing recycle processing by a non-genuine manufacturer; or by collecting a non-genuine product and performing recycle processing by a genuine manufacturer, for example.

More particularly, the above-mentioned problem cannot be ignored for an image forming apparatus required to produce a high image quality.

Another conventional image forming apparatus uses a method of restricting an installment of all kinds of non-genuine process cartridges to an image forming apparatus to solve the problem.

However, superior image quality obtained by a genuine product may be maintained even using non-genuine products with an effort of a manufacturer manufacturing the non-genuine products.

Particularly, if a genuine product is collected, recycled and used for the image forming apparatus, superior image quality may be obtained with a higher probability even if a non-genuine manufacturer recycles the genuine product. Therefore, it is not appropriate to prohibit installing all kinds of non-genuine process cartridges to the image forming apparatus from a viewpoint of users because users are restricted from choosing a variety of products.

The above-mentioned problems also affect all kinds of devices that are detachable from the image forming apparatus and that have a quality difference on a unit-by-unit basis, such as a photo-sensitive member, a charging unit, a developing unit, a developer cartridge, a cleaning unit, an optical unit, a transfer unit, a sheet feed unit, and a fixing unit.

As for the conventional image forming apparatus, there is an uncertainty of quality assurance responsibility when a process cartridge produced by a recycle manufacturer, different from a genuine manufacturer, is used in the image forming apparatus.

In many cases, a process cartridge is formed of a variety of components having different lifetime and assembled together with adjustments. In some cases, precise adjustments, such as a development gap adjustment and a doctor gap adjustment, may be required to secure superior image quality. Methods of making such precise adjustments for the process cartridge are known by the genuine manufacturer.

When a process cartridge for replacement is a genuine product, which is controlled in quality by the genuine manufacturer, the above-mentioned problems of image quality rarely happen because the image forming apparatus and the process cartridge are designed and manufactured based on the genuine manufacturer's knowledge of minimizing variation of the above-mentioned image quality even if the process cartridge is replaced. This is also true for a process cartridge recycled by a genuine manufacturer.

Therefore, when a recycled process cartridge is a genuine product, which is controlled in quality by the genuine manufacturer, image forming apparatuses using such a recycled process cartridge rarely experience quality problems. Even if a quality problem happens, the responsibility of the quality assurance is clearly identified.

On the other hand, when a recycled process cartridge is a non-genuine product, which is recycled by a recycle manufacturer (i.e., non-genuine manufacturer) and out of the control of the genuine manufacturer, the image forming apparatus using such a recycled process cartridge experiences quality problems in many cases. In such situations, users may usually demand responsibility for quality assurance from the genuine manufacturer because they rarely know that the recycled process cartridge is produced by a non-genuine manufacturer.

In addition, a non-genuine manufacturer may use material that the genuine manufacturer refrains from using to comply with social and technical standards when recycling a process cartridge. In such a situation, a genuine manufacturer may be accused of non-compliance with those standards.

To avoid the above-mentioned responsibilities, conventional technologies restrict usage of non-genuine process cartridges (or containers) in the image forming apparatus.

However, some non-genuine products may maintain superior image quality similar to that obtained by a genuine product due to effort of the non-genuine product manufacturer. Thus, some users may choose a non-genuine product even if the quality of the non-genuine product is not at a same level as the genuine product, if a non-genuine product is less expensive than the genuine product.

Therefore, it is not appropriate to prohibit installing all kinds of non-genuine products for use in an image forming apparatus from a user's viewpoint because users are then restricted from choosing a variety of products.

SUMMARY OF THE INVENTION

In view of the foregoing, it is an object of the present invention to provide a novel device unit detachably provided to an image forming apparatus such as a copier, printer, facsimile or composite machines, an image forming apparatus, a management system configured to administer the image forming apparatus and operational statuses of the image forming apparatus, and a recycling system configured to recycle the device unit to use as a replacement product.

To achieve the above object, in one example, a novel device unit is detachably provided to an image forming apparatus having a control unit configured to control the image forming apparatus. The device unit includes: a CPU configured to communicate with the control unit; and a memory configured to store property information including information provided through a communication between the CPU and the control unit. The memory includes a write-prohibited area configured to prohibit an information overwriting; a first writable area configured to allow an information writing, and a second writable area configured to allow one time an information writing.

In the above-mentioned device unit, the second writable area of the memory is configured to allow another one time the information writing when the device unit recognizes a predetermined code transmitted from the control unit.

In the above-mentioned device unit, the write-prohibited area, the first writable area, and the second writable area of the memory are allocated in a way corresponding to product group identifications.

In the above-mentioned device unit, the write-prohibited area of the memory is configured to cancel prohibition of the information overwriting.

In the above-mentioned device unit, the write-prohibited area of the memory is configured to allow another one time the information overwriting when the device unit recognizes a predetermined code transmitted from the control unit.

In the above-mentioned device unit, the memory is included in an IC tag detachably provided to the device unit.

In the above-mentioned device unit, the device unit further includes at least one of an image carrying member, a charging device, a developing device, a transfer device, and a cleaning device.

In the above-mentioned device unit, the write-prohibited area of the memory stores information relating to image forming conditions.

In the above-mentioned device unit, the device unit further includes a developer cartridge configured to store developer.

In the above-mentioned device unit, the write-prohibited area of the memory stores information relating to manufacturing of the device unit.

In the above-mentioned device unit, the first writable area of the memory stores information relating to an operational history of the device unit.

In the above-mentioned device unit, the memory further comprises a second writable area configured to allow one time an information writing, and the second writable area stores information relating to a start time of using the device unit.

In the above-mentioned device unit, the memory includes a nonvolatile memory.

A novel image forming apparatus includes a control unit configured to control the image forming apparatus and including a memory. The device unit includes a CPU configured to communicate with the control unit; and a memory configured to store property information including information provided through a communication between the CPU and the control unit. The memory includes a write-prohibited area configured to prohibit an information overwriting; and a first writable area configured to allow an information writing.

In the above-mentioned the image forming apparatus, the image forming apparatus is coupled to a management system which administers operational statuses of the image forming apparatus via a public telecommunication line or Internet, and transmits information stored in the memory to the management system via the public telecommunication line or the Internet.

In the above-mentioned the image forming apparatus, the image forming apparatus is coupled to a management system which administers operational statuses of the image forming apparatus via a public telecommunication line or Internet, and receives information from the management system via the public telecommunication line or the Internet, and stores the information from the management system into the memory.

In the above-mentioned the image forming apparatus, the memory includes a nonvolatile memory.

Another novel image forming apparatus includes a control unit configured to control the image forming apparatus and including a memory; a first memory configured to store property information; and a device unit detachably provided to the image forming apparatus, and having a second memory storing information relating to property information stored in the first nonvolatile memory. At least one of the first memory and the second memory has a write-prohibited area prohibiting an information overwriting, and a first writable area permitting an information overwriting.

In the above-mentioned image forming apparatus, at least one of the first memory and the second memory has a second writable area permitting one time an information writing.

In the above-mentioned image forming apparatus, the second writable area permits the information writing when the device unit in a new and unused state is installed in the image forming apparatus.

In the above-mentioned image forming apparatus, the device unit further includes at least one of an image carrying member, a charging device, a developing device, a transfer device, and a cleaning device.

In the above-mentioned image forming apparatus, the write-prohibited area of the memory stores information relating to image forming conditions.

In the above-mentioned image forming apparatus, the image forming apparatus further includes a developer cartridge configured to store developer.

In the above-mentioned image forming apparatus, the write-prohibited area of the memory stores information relating to manufacturing of the image forming apparatus.

In the above-mentioned image forming apparatus, the first writable area of the nonvolatile memory stores information relating to an operational history of the device unit.

In the above-mentioned image forming apparatus, the second memory includes a second writable area configured to allow one time an information writing, and store information relating to a start time of using the device unit.

In the above-mentioned image forming apparatus, the first memory includes a second writable area configured to allow one time an information writing, and store at least one of information relating to manufacturing of the device unit and information relating to a start time of using the device unit.

In the above-mentioned image forming apparatus, the first memory has a first writable area permitting the information writing and storing information of the image forming conditions.

In the above-mentioned image forming apparatus, the second memory is included in an IC tag detachably provided to the device unit.

In the above-mentioned image forming apparatus, the first memory has at least one of a write-prohibited area prohibiting an information overwriting, a first writable area permitting an information writing, and a second writable area permitting one time an information writing. A new area is formed for at least one of the write-prohibited area, the first writable area, and the second writable area when a device unit having an identification code different from an identification code of an existing device unit is installed in the image forming apparatus.

In the above-mentioned image forming apparatus, the image forming apparatus further includes a power supply source supplying power to the image forming apparatus. The first memory has an EEPROM and an SRAM detachably provided to the image forming apparatus, and information stored in the SRAM is written to the EEPROM when the power supply source stops power supply to the image forming apparatus.

In the above-mentioned image forming apparatus, the first memory permits the information writing when the image forming apparatus recognizes a predetermined code transmitted from the control unit.

In the above-mentioned image forming apparatus, the first memory has a write-prohibited area prohibiting an information overwriting, and permitting the information overwriting when the image forming apparatus recognizes a predetermined code transmitted from the control unit.

In the above-mentioned image forming apparatus, the first memory has a second writable area permitting one time the information writing, and permitting another one time information writing when the image forming apparatus recognizes a predetermined code transmitted from the control unit.

In the above-mentioned image forming apparatus, the image forming apparatus is coupled to a management system which administers operational statuses of the image forming apparatus via a public telecommunication line or Internet, and transmits information stored in the first memory to the management system via the public telecommunication line or the Internet.

In the above-mentioned image forming apparatus, the image forming apparatus is coupled to a management system which administers operational statuses of the image forming apparatus via a public telecommunication line or Internet, and receives information from the management system via the public telecommunication line or the Internet to store the information from the management system into at least one of the first memory and the second memory.

In the above-mentioned image forming apparatus, the first memory and the second memory include a nonvolatile memory.

Another novel device unit is detachably provided to an image forming apparatus having a control unit configured to control the image forming apparatus. The device unit includes: a CPU configured to communicate with the control unit; and a memory configured to store property information including information provided through a communication between the CPU and the control unit. The memory includes a first memory area to which recycle information is written.

In the above-mentioned device unit, the recycle information is written to the first memory area when the device unit undergoes a recycle processing.

In the above-mentioned device unit, the CPU allocates a new area for the first memory area in the memory when the device unit undergoes the recycle processing.

In the above-mentioned device unit, the recycle information includes at least one of a recycle manufacture, a number of recycling, a recycled date, and a replaced part.

In the above-mentioned device unit, the recycle information includes at least one of a filling amount, a filling date, an effective usage period, and a color type of a developer, and is written into the first memory area when a developer cartridge is refilled with the developer during the recycle processing.

In the above-mentioned device unit, the recycle information written into the first memory area during the recycle processing is prohibited of an information overwriting.

In the above-mentioned device unit, the information writing to the first memory area is prohibited when information of a recycle manufacturer is excluded from the recycle information.

In the above-mentioned device unit, the device unit further includes a second memory area storing permanent information different form the recycle information. The permanent information includes information of the device unit when manufactured.

In the above-mentioned device unit, the information includes identification information to specify the device unit when manufactured.

In the above-mentioned device unit, the permanent information includes information of the image forming apparatus when manufactured.

In the above-mentioned device unit, the permanent information includes information specifying a part to be replaced, based on which a recycle processing is performed.

In the above-mentioned device unit, the device unit further includes at least one of an image carrying member and a cleaning blade, wherein the part to be replaced includes at least one of the image carrying member and the cleaning blade.

In the above-mentioned device unit, the permanent information written to the second memory area is prohibited of the information overwriting.

In the above-mentioned device unit, the memory further includes a third memory area storing non-permanent information different from the recycle information. The non-permanent information includes information relating to an operational history of the image forming apparatus.

In the above-mentioned device unit, the information relating to the operational history of the image forming apparatus includes at least one of information of a malfunction history and an abnormal history.

In the above-mentioned device unit, the recycle processing is performed based on the non-permanent information stored in the third memory area.

In the above-mentioned device unit, the device unit further includes at least one of an image carrying member, a charging device, a developing device, a transfer device, a cleaning device, and a developer cartridge.

In the above-mentioned device unit, the device unit further includes an IC tag to which the memory is provided.

Another novel image forming apparatus includes a control unit configured to control the image forming apparatus; and a device unit detachably provided to the image forming apparatus. The device unit includes: a CPU configured to communicate with the control unit; a memory configured to store property information including information provided through a communication between the CPU and the control unit. The memory includes a first memory area to which recycle information is written. A warning is displayed when at least a part of a recycle information is excluded from the first memory area of the device unit which undergoes a recycle processing.

In the above-mentioned image forming apparatus, an image forming operation is prohibited when at least a part of the recycle information is excluded from the first memory area of the device unit which undergoes a recycle processing.

In the above-mentioned image forming apparatus, operation conditions of the image forming apparatus are controlled based on the recycle information stored in the first memory area.

In the above-mentioned image forming apparatus, the memory includes a nonvolatile memory.

A novel recycling system includes: a reader/writer configured to communicate with an IC tag; and a personal computer configured to communicate with the IC tag via the reader/writer and perform a recycle processing of a device unit.

In the above-mentioned recycling system, the reader/writer reads the recycle information stored in a memory, and writes the recycle information into a first memory area of the memory.

In the above-mentioned recycling system, the memory includes a nonvolatile memory.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIGS. 5A and 5B are an exemplary memory map of a nonvolatile memory of the IC tag in FIG. 4;

FIGS. 13A and 13B include an exemplary memory map of a second nonvolatile memory of the process cartridge;

FIGS. 14A, 14B, and 14C include an exemplary memory map of a first nonvolatile memory of the engine control board;

FIGS. 19A and 19B include an exemplary memory map of a nonvolatile memory of the IC tag in FIG. 4;

DETAILED DESCRIPTION OF THE PREFERRED EMBODIMENTS

Figure 1:
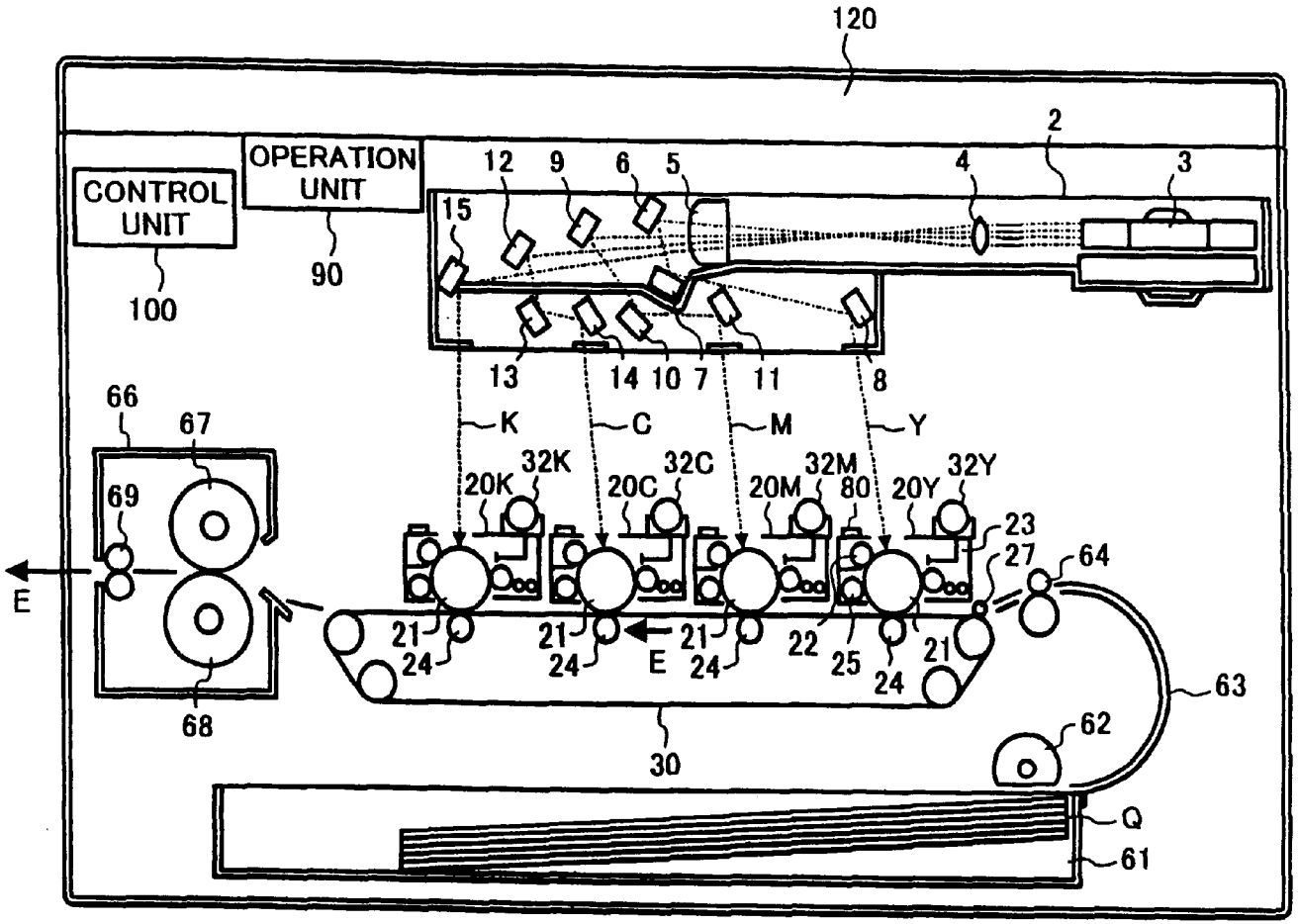
FIG. 1 is an overall schematic view of an image forming apparatus according to an exemplary embodiment of the present invention.

In describing preferred embodiments illustrated in the drawings, specific terminology is employed for the sake of clarity. However, the disclosure of the present invention is not intended to be limited to the specific terminology so selected and it is to be understood that each specific element includes all technical equivalents that operate in a similar manner.

Referring now to the drawings, wherein like reference numerals designate identical or corresponding parts throughout the several views, and more particularly to FIG. 1 thereof, an exemplary image forming apparatus according to an exemplary embodiment of the present invention is described.

FIG. 1 is an overall schematic view of an image forming apparatus according to an exemplary embodiment of the present invention.

As illustrated in FIG. 1, the image forming apparatus includes: an optical unit 2 configured to emit laser light based on image information; process cartridges 20Y, 20M, 20C, and 20K for each of colors of yellow, magenta, cyan, black, respectively, formed as a device unit and to be detached from the image forming apparatus; photo-sensitive members 21 in a drum shape provided to each of the process cartridges 20Y, 20M, 20C, and 20K as an image carrying member; a charging device 22 configured to charge a surface of the photo-sensitive member 21; a developing device 23 configured to develop an electro-static latent image formed on the surface of the photo-sensitive member 21; a transfer roller 24 configured to transfer the developer image formed on the surface of the photo-sensitive member 21 to a transfer-receiving member Q; a cleaning device 25 configured to collect developers remained on the surface of the photo-sensitive member 21 after the transfer process; a transfer belt 30 of a transfer belt unit; developer supplying units 32Y, 32M, 32C, and 32K configured to supply different color developer D to the developing device 23 in each of the process cartridges 20Y, 20M, 20C, and 20K; a sheet feeding unit 61 configured to store the transfer-receiving member Q such as transfer paper; a fixing unit 66 configured to fix the developer image transferred to the transfer-receiving member Q; an IC tag 80 detachably provided to each of the process cartridges 20Y, 20M, 20C, and 20K; an operation unit 90 provided to an outer surface of the image forming apparatus; a control unit 100 provided to the image forming apparatus; and a scanner 120 configured to optically scan an image of an original document which is set on a position for scanning.

Each of the process cartridges 20Y, 20M, 20C, and 20K is configured to integrate the photo-sensitive member 21, the charging device 22, the developing device 23, and the cleaning device 25.

An image formation including colors of yellow, magenta, cyan, and black is performed on the photo-sensitive member 21 of each of the process cartridges 20Y, 20M, 20C, and 20K.

Hereinafter, an exemplary operation of an image formation of the image forming apparatus according to an exemplary embodiment of the present invention will be described.

Four photo-sensitive members 21 rotate in a clockwise direction in FIG. 1, and a surface of the photo-sensitive member 21 is charged uniformly at a position at which the photo-sensitive member 21 faces the charging device 22 (a charging process). Then, a charged surface of the photo-sensitive member 21 comes to a position to be irradiated by laser light for each color.

When an original document is set to a scanning position of the scanner 120, an image of the original document is optically scanned by a scanning part (not shown). That is, the original document is scanned by irradiating light, and the image of the original document is focused on a color CCD (not shown). And the image of the original document, or a light reflected from the original document is photo-electrically converted to an image signal formed of the Red light R (not shown), Green light G (not shown), and Blue light B (not shown) by the color CCD. These image signals are transmitted to the optical unit 2 to emit laser light from a laser diode light source corresponding to each of the image signals. The laser light enters and reflectively exits from a polygon mirror 3, and passes through lenses 4 and 5. The laser light passed through the lenses 4 and 5 is separated to different paths for each of the colors of yellow, magenta, cyan, and black (a exposing process).

A laser light for yellow Y is reflected at mirrors 6, 7, and 8, and irradiated to a surface of the photo-sensitive member 21 of the process cartridge 20Y. At this time, the laser light for yellow Y is scanned to a longitudinal direction (main scanning direction) of the photo-sensitive member 21 by the polygon mirror 3 rotating at a high speed to form an electro-static latent image of yellow on the photo-sensitive member 21 of the process cartridge 20Y already charged by the charging device 22.

Similarly, a laser light for magenta M is reflected at mirrors 9, 10, and 11, and irradiated on a surface of the photo-sensitive member 21 of the process cartridge 20M, and an electro-static latent image of magenta M is formed on the photo-sensitive member 21 of the process cartridge 20M.

Similarly, a laser light for cyan C is reflected at mirrors 12, 13, and 14, and irradiated on a surface of the photo-sensitive member 21 of the process cartridge 20C, and an electro-static latent image of cyan C is formed on the photo-sensitive member 21 of the process cartridge 20C.

Similarly, a laser light for black K is reflected at a mirror 15, and irradiated on a surface of the photo-sensitive member 21 of the process cartridge 20K, and an electro-static latent image of black K is formed on the photo-sensitive member 21 of the process cartridge 20K.

Subsequently, each of the photo-sensitive members 21 having the electro-static latent image of each color further rotates to a position facing the developing device 23. The developing device 23 supplies developer of each color to each of the photo-sensitive members 21 to develop the electro-static latent images on each of the photo-sensitive member 21 (a developing process).

Subsequently, the surface of the photo-sensitive member 21 comes to a position facing the transfer belt 30 at which the transfer roller 24 is configured to contact a back surface of the transfer belt 30. At such a position, developer images of each color formed on each of the photo-sensitive members 21 are sequentially transferred to the transfer-receiving member Q transported by a transfer belt 30 (a transfer process).

The transfer belt 30 is extended by a drive roller and three driven rollers, and travels in a direction of arrow E by the drive roller. The transfer belt unit includes and integrates the above-mentioned transfer roller 24 and the transfer belt 30, and is configured to be a device unit detachable from the image forming apparatus.

After the transfer of the developer images, the surface of the photo-sensitive member 21 comes to a position facing the cleaning device 25 to collect developer remaining on the photo-sensitive member 21 by the cleaning device 25 (a cleaning process). After the cleaning, the surface of the photo-sensitive member 21 comes to a position facing a discharging member (not shown) to discharge the photo-sensitive member 21, and a sequence of image forming process ends.

The transfer-receiving member Q is fed from the sheet feeding unit 61 by a sheet feeding roller 62, and guided to a position of a registration roller 64 after passing through a transport guide 63. The transfer-receiving member Q guided to the registration roller 64 is transported to a space between the transfer belt 30 and a roller 27 while transport timing is controlled.

The transfer-receiving member Q, transported by the transfer belt 30 traveling in the direction of arrow E, passes through positions facing the four photo-sensitive members 21 sequentially to have an overlayingly transferred developer images of each color on the transfer-receiving member Q for color image formation.

The transfer-receiving member Q having the color image leaves the transfer belt 30, and is guided to the fixing unit 66 to fix the color image on the transfer-receiving member Q at a nip formed by a heat roller 67 and a pressure roller 68 of the fixing unit 66. After the fixing, the transfer-receiving member Q is ejected to an outside of the image forming apparatus by a sheet ejection roller 69, and a whole image forming operation of the image forming apparatus ends.

Figure 2A:
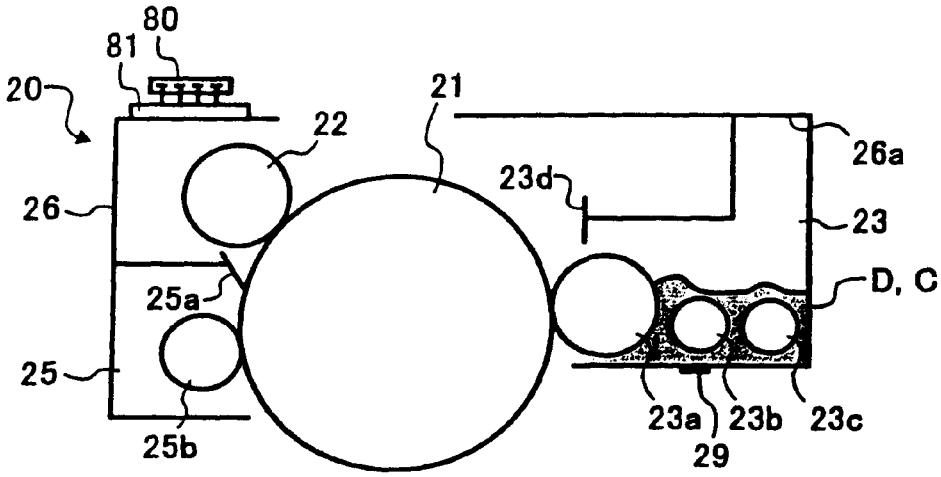
FIG. 2A is an exemplary cross sectional view of a process cartridge in a new and unused state to be installed in the image forming apparatus.
Figure 2B:
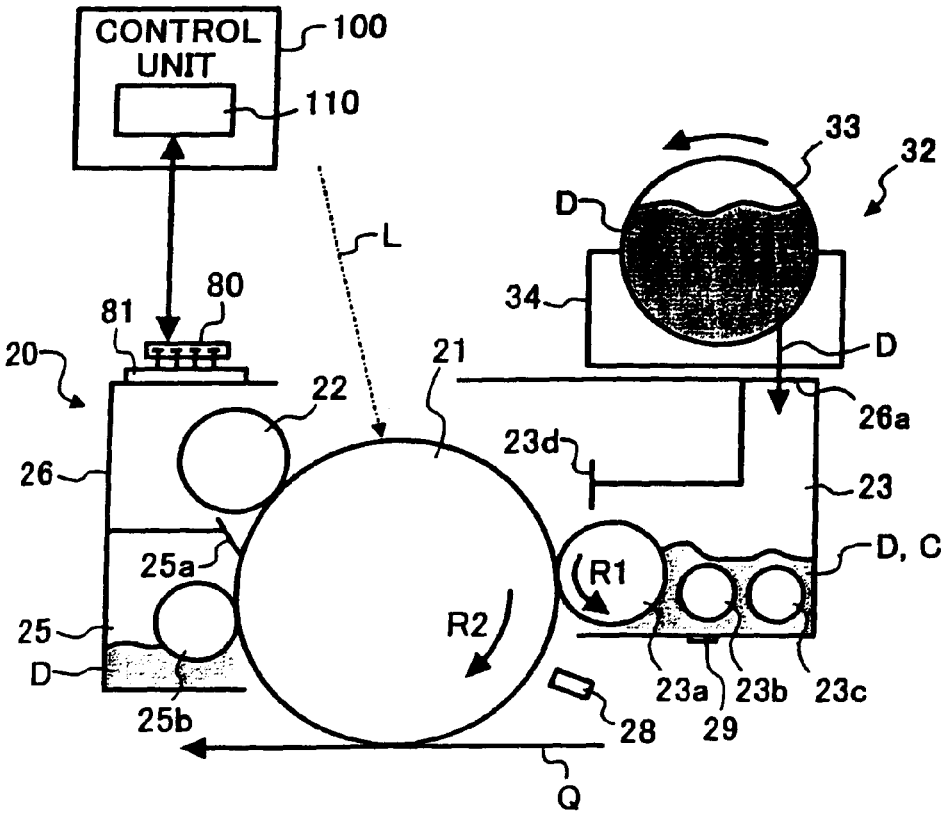
FIG. 2B is an exemplary cross sectional view of the process cartridge in FIG. 2A installed in the image forming apparatus.

FIGS. 2A and 2B are exemplary cross sectional views of the process cartridge detachable from the image forming apparatus according to an exemplary embodiment of the present invention. Because the four process cartridges provided to the image forming apparatus have a similar configuration except the color of stored developers, reference signs Y, M, C, and K are omitted from the drawing.

FIG. 2A is an exemplary cross sectional view of the process cartridge 20 in a new and unused state. The new and unused state means that the process cartridge 20 (i.e., new product or recycled product) is not used in the image forming apparatus after manufacturing or recycle processing.

As illustrated in FIG. 2A, as one example of an exemplary embodiment of the present invention, the process cartridge 20 includes the photo-sensitive member 21 as an image carrying member, the charging device 22, the developing device 23, the cleaning device 25, and a case 26 which encases the above-mentioned members and devices.

As one example of an exemplary embodiment of the present invention, the developing device 23 includes a developing roller 23*a*, agitation rollers 23*b* and 23*c*, a doctor blade 23*d*, and a sensor 29 (developer concentration sensor), and stores a carrier C and a developer D therein. The cleaning device 25 includes a cleaning blade 25*a*, and a cleaning roller 25*b*.

As illustrated in FIG. 2A, an IC tag 80 is detachably provided on the case 26 of the process cartridge 20. Specifically, the IC tag 80 is a packaged integrated circuit (IC) having external terminals and configured to communicate with the control unit 100 of the image forming apparatus. The external terminals of the IC tag 80 are inserted to connection terminals of an IC socket 81 fixed to the case 26.

However, the IC tag 80 is not restricted to that described above. The IC tag 80 may alternatively be an IC chip having a square shape in the order of several millimeters, or an IC chip installed on a printed circuit board (PCB) having external terminals. The IC tag 80 can communicate with the control unit 100 as a contact type IC tag using a wired system, or a non-contact type IC tag using a wireless system.

An operator can replace the process cartridge 20 from the image forming apparatus as a single unit. In other words, the process cartridge 20 in FIG. 2B is installed in the image forming apparatus as a device unit.

Specifically, the operator opens a door (not shown) of the image forming apparatus, and installs the process cartridge 20 in the image forming apparatus using a guide rail (not shown) provided in the image forming apparatus.

When the process cartridge 20 is installed in the image forming apparatus, the IC tag 80 of the process cartridge 20 and an engine control board 110 of the control unit 100 start to communicate with each other for information including image forming conditions, manufacturing, operational history, and usage start date relating to the process cartridge 20.

Based on such communicated information, the control unit 100 adjusts image forming conditions to optimize a whole operation of the image forming apparatus. Such an operation will be described in detail later.

After the above-mentioned communication is finished, a normal operation for the image formation explained with FIG. 1 will be performed.

Specifically, the developing roller 23*a* rotates in the direction of arrow R1 in FIG. 2B. The developer D in the developing device 23 is mixed with the carrier C and the developer D supplied from a developer supplying unit 32 by agitation rollers 23*b* and 23*c* rotating to a counter-clockwise direction in the FIG. 2B. Frictionally charged developer D is supplied to the surface of the developing roller 23*a* with the carrier C by the agitation roller 23*b*.

The developer D is supplied to the developing device 23 from a developer bottle 33, as required, corresponding to consumption of the developer D in the developing device 23. The consumption of the developer D in the developing device 23 is detected by a developer concentration sensor 28 (P sensor) and a developer concentration sensor (T sensor), wherein the P sensor functions as an optical sensor while facing the photo-sensitive member with drum shape 21, and the T sensor functions as a magnetic permeability sensor provided in the developing device 23.

The developer D carried on the developing roller 23*a* passes a position of the doctor blade 23*d*, and comes to a position facing the photo-sensitive member 21, which rotates in the direction of arrow R2. Then, the developer D is adhered to the electro-static latent image formed on the surface of the photo-sensitive member 21. Specifically, the developer D is adhered to the surface of the photo-sensitive member 21 by a electric field generated by a potential difference between the surface potential of the photo-sensitive member 21 irradiated by a laser light L and a developing bias voltage potential applied to the developing roller 23*a*.

Most of the developer D adhered to the surface of the photo-sensitive member 21 is transferred to the transfer-receiving member Q. The developer D remained on the surface of the photo-sensitive member 21 is collected in the cleaning device 25 by the cleaning blade 25*a* and the cleaning roller 25*b*.

Figure 3:
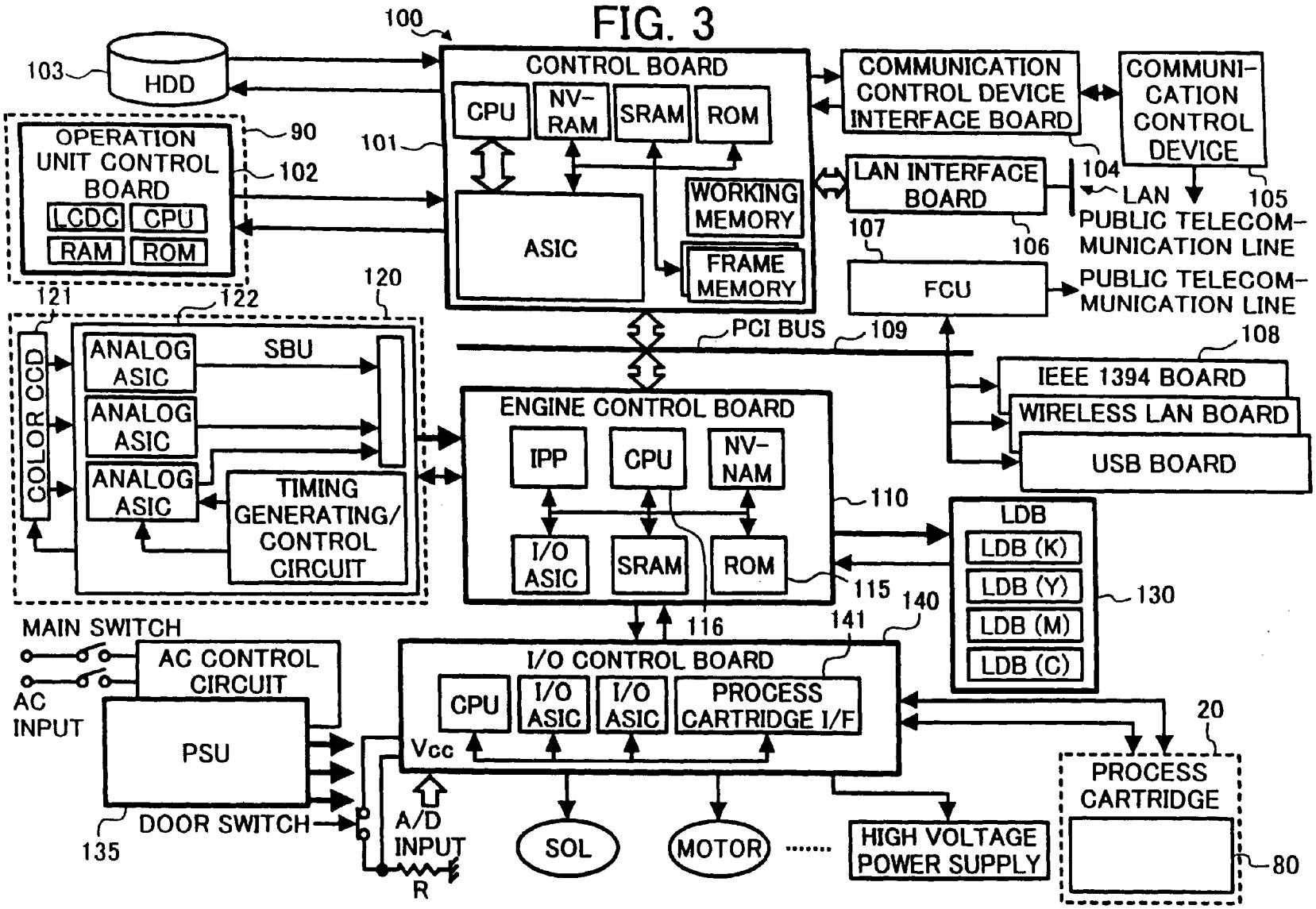
FIG. 3 is an exemplary block diagram for explaining a relationship of a control unit and an IC tag.

FIG. 3 is an exemplary block diagram for explaining a relationship of the control unit 100 and the IC tag 80.

As illustrated in FIG. 3, as one example of an exemplary embodiment of the present invention, the control unit 100 includes a control board 101 configured to control the whole image forming apparatus, an operation unit control board 102 configured to control the operation unit 90, a HDD 103 configured to memorize an image information, a communication control device 105, a communication control device interface board 104 connected to the public telecommunication line such as analog telecommunication line via the communication control device 105, a LAN interface board 106 connected to LAN, a facsimile control unit (FCU) 107 connected to a PCI bus, IEEE1394 board/wireless LAN board/USB board 108, an engine control board 110 connected to the control board 101 via a PCI bus 109, an I/O control board 140 connected to the engine control board 110 and configured to control the input and output (I/O) of the image forming apparatus, a scanner board unit (SBU) 122 configured to scan an image of an original document set to the scanner 120, and a LDB 130 configured to write image information on the surface of the photo-sensitive member 21 by laser light.

A color CCD 121 of the scanner 120 is a three-line color CCD configured to generate an image signal of R, G, and B in EVENch/ODDch (not shown). These image signals are input to an analog ASIC in the SBU 122 having a timing generating/control circuit configured to generate a drive timing of the analog ASIC in the SBU 122 and the color CCD 121.

An output signal of the CCD 121 is sampled and held by a sample-hold circuit in the analog ASIC in the SBU 122, and then converted to a digital signal by an A/D converter. Image data of R, G, and B converted to a digital signal from an analog signal are corrected by a shading correction, and transmitted to an IPP (image information processor) in the engine control board 110 via an output I/F (interface).

The IPP (image information processor) in the engine control board 110 performs a number of processes including separational generation (judging whether image is a character region or photo region), real time thresholding (RTT), scanner gamma conversion, filtering, color correction, zooming, image processing, printer gamma conversion, gradation processing. The IPP is a programmable computing processor configured to perform image processing.

The image information is transmitted from the SBU 122 to the IPP to correct signal deterioration, and then written to a frame memory in the control board 101.

The control board 101 includes a CPU, a ROM used for controlling the control board 101, an SRAM as a working memory used by the CPU, an NV-RAM having a lithium cell and a clock for back up of the SRAM, an ASIC configured to control peripheries of the CPU such as system bus control, a frame memory control and FIFO, and an interface circuit.

The control board 101 controls a whole system of the image forming apparatus and is used for controlling a composite machine having multiple applications including a scanner application, a facsimile application, a printer application, a copy application. In other words, the control board 101 decodes information relating to applications which is input from the operation unit control board 102, sets a condition for the system, and displays such conditions to a display portion of the operation unit 90.

The control board 101 is connected to the communication control device 105 via the communication control device interface board 104 to perform a full duplex asynchronous serial communication. The communication control device 105 is connected in a multi-drop way and communicates with a management system (to be described later) via the communication control device interface board 104.

The control board 101 is connected to the LAN (Internet) via a LAN interface board 106, which is a standard communication interface such as PHY chip I/F embedded with a PHY chip and I2C bus I/F. The control board 101 communicates with a management system (to be described later) via the LAN interface board 106.

The HDD 103 connected to the control board 101 stores an application program of the system, an application database for bias information, a data base for image information, for example. The HDD 103 is connected to the control board 101 via an interface according an HDD interface standard.

The operation unit control board 102 connected to the control board 101 includes a CPU, a ROM, a RAM, and an LCDC. Based on communication between the operation unit control board 102 and the control board 101, information required for key inputs and operations are displayed on a display portion of the operation unit 90. The ROM of the operation unit control board 102 stores a control program to control an input-reading and a display-output. The RAM of the operation unit control board 102 is a working memory used by the CPU.

An operator inputs a system setting through the display portion of the operation unit 90, and checks the system setting and status by viewing the display portion of the operation unit 90.

The engine control board 110 mainly controls the image forming process explained with FIGS. 1, 2A, and 2B.

The engine control board 110 includes a CPU 116, an I/O ASIC, an IPP, a ROM 115 storing programs required for controlling image formation, a SRAM required for controlling the ROM 115, and an NV-RAM.

The CPU 116 of the engine control board 110 and the IC tag 80 of the process cartridge 20 are configured to be able to communicate with each other. This will be described later.

The engine control board 110 is connected to the control board 101 via the PCI bus 109, which is an image information bus/control command bus transmitting image information and control commands in a time division manner.

Write signals of each color of yellow, magenta, cyan, and black are output from a working memory of the control board 101, and input to an LD writing circuit in an LD board (LDB) 130 connected to the engine control board 110. The LD writing circuit performs an LD current control (modulation control), and outputs the LD current to each of LD light sources.

The I/O ASIC of the engine control board 110 has a serial interface to communicate with the CPU 116. The I/O ASIC controls devices including a counter, a fan, a solenoid, a motor provided closely to the engine control board 110.

The I/O control board 140 connected to the engine control board 110 by a synchronous serial interface includes a CPU, an I/O ASIC, and a process cartridge I/F 141. The CPU of the I/O control board 140 functions as a sub-CPU, and performs I/O control such as an analog control of the developer concentration sensors 28 and 29 explained with FIGS. 2A and 2B.

An installation of the process cartridge 20 in a new and unused state to the image forming apparatus is detected when a door of the image forming apparatus is opened and closed. That is, when a door switch connected to the I/O control board 140 is in an "OFF" state, the process cartridge 20 is checked because the process cartridge 20 may be replaced with a new one. The check result is transmitted to the engine control board 110.

The process cartridge I/F 141 is an interface circuit used for communication between the engine control board 110 and a nonvolatile memory of the IC tag 80.

For example, when a communication interface between the nonvolatile memory and the control unit 100 is an I2C bus, parallel signals from the CPU 116 of the control unit 100 are converted to I2C signals, and transmitted to the nonvolatile memory of the IC tag 80. Similarly, signals from the nonvolatile memory are converted to parallel signals, and transmitted to the CPU 116 of the control unit 100. On the other hand, when the CPU 116 of the control unit 100 has an I2C bus, the engine control board 110 and the nonvolatile memory of the IC tag 80 are connected directly.

A PSU 135 is a power supply unit for the image forming apparatus, and supplies power to control the image forming apparatus. The power is supplied to the image forming apparatus by switching a main switch to an "ON" state.

The IC tag 80 detachably provided to the process cartridge 20 will be explained in detail with reference to FIG. 4.

Figure 4:
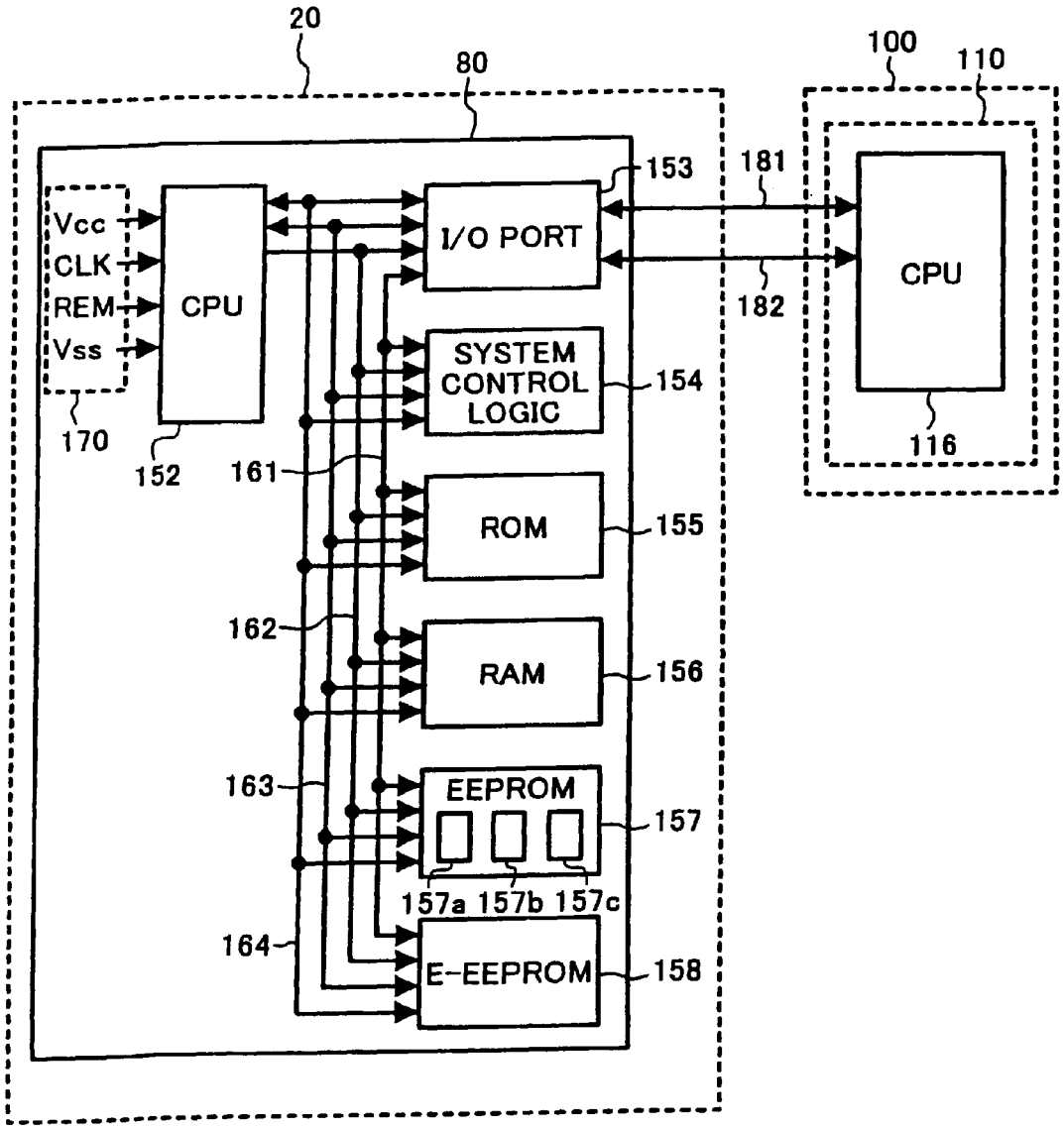
FIG. 4 is an exemplary block diagram of the IC tag provided to the process cartridge in FIGS. 2A and 2B.

As illustrated in FIG. 4, as one example of an exemplary embodiment of the present invention, the IC tag 80 is a contact type IC tag and includes a CPU 152, an I/O port 153, a system control logic 154, a ROM 155, a RAM 156, and an EEPROM 157 as a nonvolatile memory and an E-EEPROM 158.

The EEPROM 157 (nonvolatile memory) includes a write-prohibited area 157*a*, a first writable area 157*b*, and a second writable area 157*c* with addresses. In these areas, information of the process cartridge 20 required for controlling the image forming apparatus is stored. This will be explained in detail with FIG. 5.

The CPU 152 uses programs stored in the IC tag 80 to write information to the nonvolatile memory 157 and read information stored in the nonvolatile memory 157 corresponding to communication and command from an external environment.

The I/O port 153 is a communication interface according to a standard I/O interface and communicates interface signals 181 and 182 with the CPU 116 of the engine control board 110 of the control unit 100. The CPUs 152 can communicate a communication interface signal 170 with other CPUs in the image forming apparatus in addition to the CPU 116 of the engine control board 110.

The system control logic 154 is a control circuit to control the IC tag 80. The ROM 155 is a program memory, and the RAM 156 is a working memory to perform the program. The E-EEPROM 158 is a memory storing a specific program relating to writing to the nonvolatile memory 157.

The CPU 152, the I/O port 153, the system control logic 154, the ROM 155, the RAM 156, the nonvolatile memory 157, and the E-EEPROM 158 are connected each other by a control signal 161, a control bus 162, a data bus 163, and an address bus 164.

As described above, in an exemplary embodiment of the present invention, the IC tag 80 is a contact type. However, the IC tag 80 may be a non-contact type. In such a case, the IC tag 80 is provided with a non-contact type communication interface and a power supply source, in which the non-contact type communication interface is connected to an antenna instead of the I/O port in FIG. 4. Then the IC tag 80 communicates with the CPU in the image forming apparatus wirelessly.

The nonvolatile memory 157 of the IC tag 80 is not restricted to an EEPROM of an exemplary embodiment, but many types of nonvolatile memories can be used.

The nonvolatile memory 157 provided to the process cartridge 20 will be explained in detail with referring to FIG. 5. FIG. 5 is an exemplary memory map of the nonvolatile memory 157 of the IC tag 80.

As illustrated in FIG. 5, as one example of an exemplary embodiment of the present invention, a first writable area is allocated with an address 00H, a second writable area is allocated with an address 20H, and a write-prohibited area is allocated with address 30H in the nonvolatile memory 157 when an A type unit is used. Similarly, another first writable area is allocated with an address 50H, and another second writable area (not shown) and another write-prohibited area (not shown) are allocated in the nonvolatile memory 157 when an B type unit is used.

The A type unit and the B type unit are different types of the image forming apparatus. The process cartridge 20 can be installed in a plurality of types of the image forming apparatus such as A type unit and B type.

The process cartridge 20 communicates with the above-mentioned control unit 100, and judges the types of the image forming apparatus. For example, if the type is determined as the A type, information in the first writable area (address 00H), the second writable area (address 20H), and the write-prohibited area (address 30H) in the nonvolatile memory 157 corresponding to the A type unit is used.

As illustrated in FIGS. 5A and 5B, as one example of an exemplary embodiment of the present invention, information such as "Product group ID of process cartridge," "Version of process cartridge," "Color type of developer (color ID)," "Effective period (Storage period)," "Number of copied sheets," "Number of recycling," "Recycled date," "Malfunction history (Error history)," "Filling amount of developer," "Filling date of developer," "Developer remaining amount," "T sensor control information," and "P sensor control information" are stored with certain bytes in the first writable area (address 00H) of the nonvolatile memory 157.

The information in the first writable area is non-permanent information relating to an operational history of the process cartridge 20, most of the information relates to a recycle history. Because the information in the first writable area is mainly non-permanent information corresponding to the history of the process cartridge 20, the information stored in the first writable area is re-writable.

In other words, information in the first writable area can be read and written freely, and is re-writable as required. "Product group ID of process cartridge" and "Version of process cartridge" are defined as non-permanent information with a consideration of the process cartridge recycling.

As illustrated in FIGS. 5A and 5B, as one example of an exemplary embodiment of the present invention, information such as "Usage start date," "Usage start signal," "Write-prohibited flag" are stored with certain bytes in the second writable area (address 20H) of the nonvolatile memory 157.

The information in the second writable area is mainly semi-permanent information defined at the time of usage start of the process cartridge 20. The usage start of the process cartridge 20 means that the process cartridge 20 in a new and unused state is used for the first time.

Because the information in the second writable area is semi-permanent information defined at the time of the usage start of the process cartridge 20, information can be written only one time. That is, information such as "Usage start date" is written to the second writable area at the time of the usage start of the process cartridge 20.

As illustrated in FIGS. 5A and 5B, as one example of an exemplary embodiment of the present invention, information such as "Lot No.," "Manufacturer (Manufacturer ID)," "Manufactured date," "Serial No. (ID No.)," "Limit of number of recycling," "Product group ID of process cartridge," "Version of process cartridge," "Amount of exposed light," "Amount of charging," "Developing bias voltage" are stored with certain bytes in the write-prohibited area (address 30H) of the nonvolatile memory 157.

The information in the write-prohibited area is mainly permanent information relating to manufacturing of the process cartridge 20 and image forming conditions. The permanent information is information that is defined at the time of manufacturing the process cartridge 20.

Because the information in the write-prohibited area is permanent information defined at the time of the manufacturing the process cartridge 20, information stored in the write-prohibited area cannot be overwritten.

The image forming conditions relating to the image forming process explained with FIGS. 1 and 2 are, for example, the amount of exposed light of the laser light L in the exposing process, the amount of charging by the charging device 22 in the charging process, and the developing bias voltage of the developing device 23 in the developing process, and is a customized information of the process cartridge 20 to perform an optimal image forming.

"Product group ID of process cartridge" and "Version of process cartridge" are designated as permanent information because they should be the original information at the time of manufacturing.

In an exemplary embodiment of the present invention, "information overwriting" includes: writing new information after erasing existing information by initialization of the area; and overwriting information on the existing information. Further, a new area defined by "information overwriting" may be larger or smaller than the existing area.

Each of the above-mentioned write-prohibited area, first writable area, and second writable area may correspond to the product group ID ("product group ID of process cartridge") to store information in a well organized manner.

With reference to FIGS. 6A, 6B, 7, and 8, control operations of the above-mentioned image forming apparatus will be explained in detail.

FIG. 6 is a flow chart explaining an information check operation of the process cartridge 20 when the process cartridge 20 is installed in the image forming apparatus.

When the main switch of the image forming apparatus is shifted to "ON" ("Power ON"), or the door of the image forming apparatus is opened and closed, the control unit 100 transmits control information including "Product group ID, Serial number, Write signal" of the existing process cartridge 20 to the IC tag 80 of the process cartridge presently installed in the image forming apparatus.

Figure 6A:
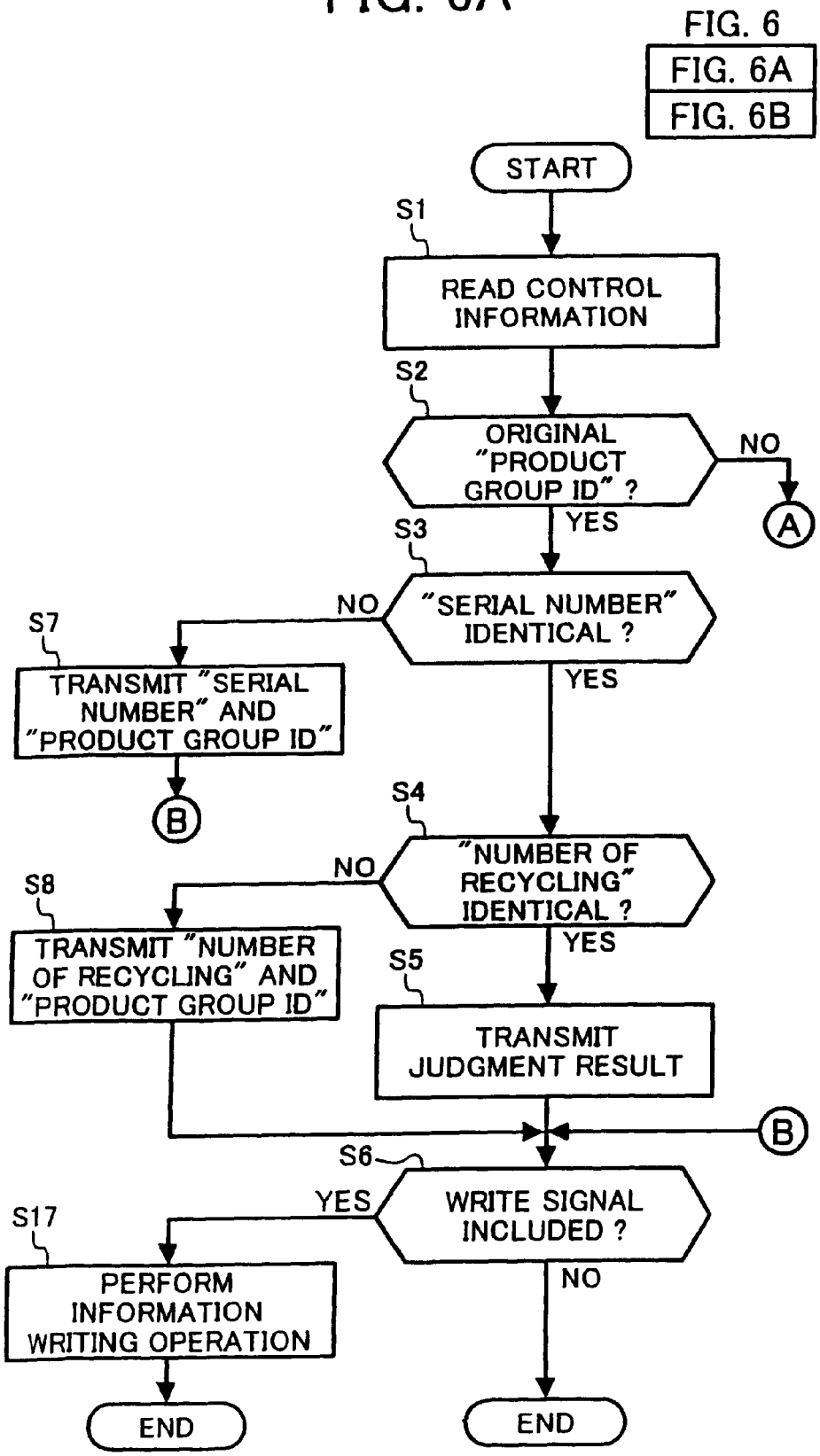
FIGS. 6A and 6B are a flow chart explaining an information check operation of the process cartridge when the process cartridge is installed in the image forming apparatus.
Figure 6B:
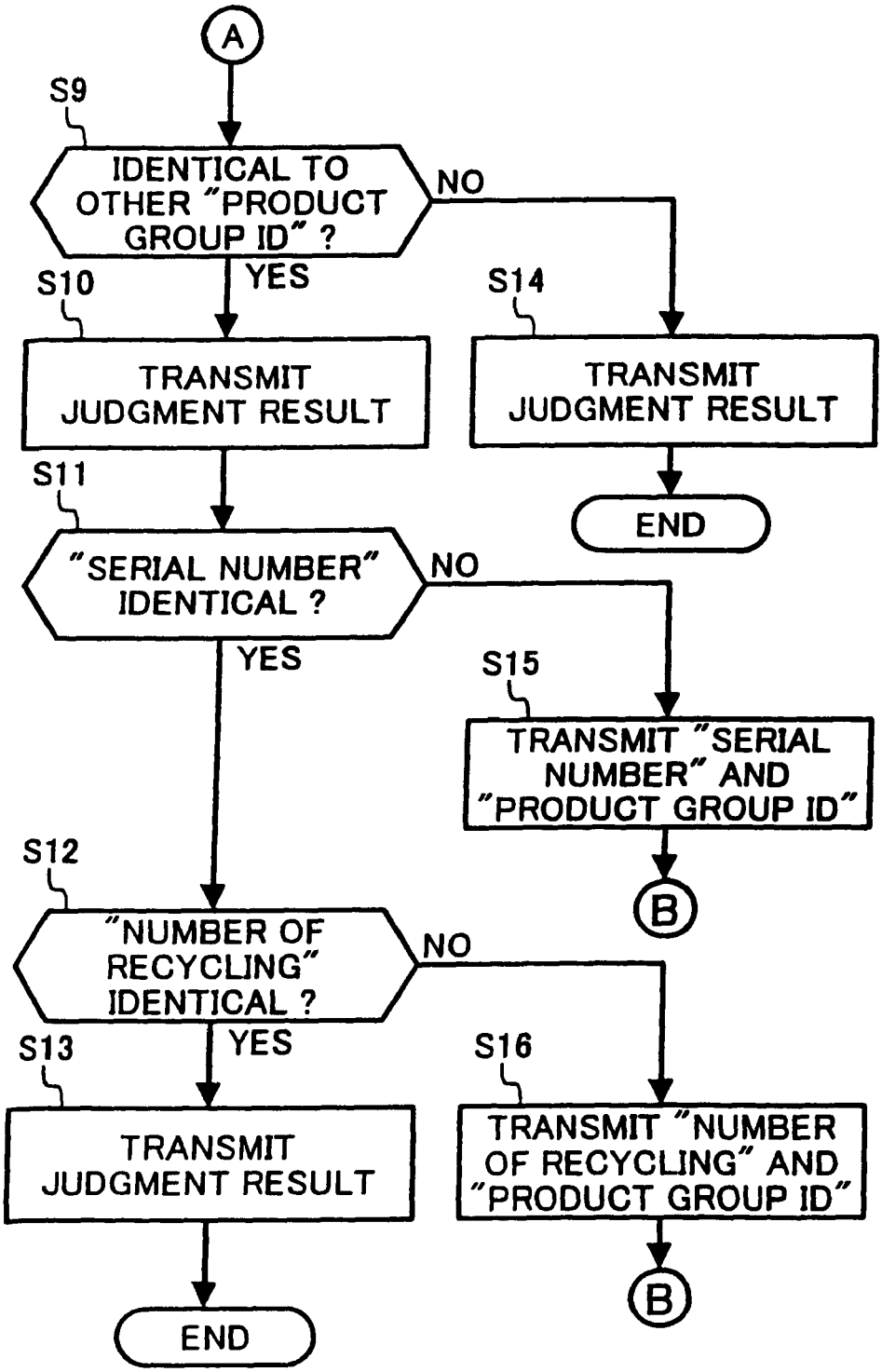

As illustrated in FIGS. 6A and 6B, the IC tag 80 of the process cartridge 20 receives and reads the information including "Product group ID", "Serial number", and "Write signal" from the control unit 100, in Step S1.

After Step 1, it is determined whether the transmitted product group ID is identical with a product group ID stored in the nonvolatile memory 157 of the process cartridge 20, in Step S2. That is, the product group ID of the process cartridge 20 presently installed in the image forming apparatus is compared with an original product group ID (i.e., a product group ID at the time of shipping from a factory).

When it is determined that the two product group IDs are identical in Step S2, it is determined whether the transmitted serial number is identical with a serial number stored in the nonvolatile memory 157 of the process cartridge 20, in Step S3.

When it is determined that the two serial numbers are identical in Step S3, it is determined whether the transmitted number of recycling (i.e., information writable at a recycling factory) is identical with a number of recycling stored in the nonvolatile memory 157, in Step S4.

When it is determined that the two "number of recycling" are identical in Step S4, it is determined that the process cartridge is not replaced from the image forming apparatus, and the judgment result is transmitted to the control unit 100, in Step S5.

After Step S5, it is determined whether the information transmitted from the control unit 100 of the image forming apparatus includes a write signal, in Step S6.

When it is determined that the write signal is not included in the information in Step S6, the information check operation ends.

On the other hand, when it is determined that the write signal is included in the information in Step S6, next is an information writing operation for the nonvolatile memory 157, in Step S17, which will be described in detail later with reference to FIG. 7.

When it is determined that the two serial numbers are not identical in Step S3, the serial number stored in the nonvolatile memory 157 and the product group ID determined as identical are transmitted to the control unit 100, in Step S7. After Step 7, the above-explained Step S6 and subsequent steps are performed.

When it is determined that the two "number of recycling" are not identical in Step S4, the number of recycling stored in the nonvolatile memory 157 and the product group ID determined as identical are transmitted to the control unit 100, in Step S8. After Step 8, the above-explained Step S6 and subsequent steps are performed.

When it is determined that the two product group IDs are not identical in Step S3, it is determined whether the transmitted original product group ID is identical with any of a plurality of product group IDs stored in the nonvolatile memory 157 in Step S9. The nonvolatile memory 157 stores control information corresponding to a plurality of product group IDs.

Such control information is useful to enable a process cartridge to form a superior image even when a process cartridge is installed in another image forming apparatus manufactured by the same manufacturer or in an image forming apparatus manufactured by another manufacturer.

When it is determined that the original product group ID is not identical with any of the plurality of product group IDs stored in the nonvolatile memory 157 in Step S9, the judgment result of Step S9 is transmitted to the control unit 100, in Step S14, and the information check operation ends.

On the other hand, when it is determined that the original product group ID is identical with any of the plurality of product group IDs stored in the nonvolatile memory 157 in Step S9, information indicating that the presently installed process cartridge is not an original one, and information of the product group ID of the presently installed process cartridge are transmitted to the control unit 100, in Step S10.

After Step S10, in Step S11, it is determined whether the serial number transmitted from control unit 100 is identical with a serial number of the process cartridge, which is determined to be identical in product group ID in Step S9.

When it is the determined that two serial numbers are identical in Step 11, in Step S12, it is determined whether the number of recycling transmitted from control unit 100 is identical with a number of recycling of the process cartridge, which is determined to be identical in product group ID in Step S9.

When it is determined that the two "number of recycling" are identical in Step 12, it is assumed that the process cartridge is not replaced from the image forming apparatus, and the judgment result is transmitted to the control unit 100 in Step S13. Then the information check operation ends.

When it is determined that the two serial numbers are not identical in Step 11, the serial number of the process cartridge and the product group ID judged as identical with the original product group ID are transmitted to the control unit 100, in Step S15. After such transmission, the above-explained Step S6 and subsequent steps are performed.

When it is determined that the two "number of recycling" are not identical in Step 12, the number of recycling of the process cartridge and the product group ID judged as identical with the original product group ID are transmitted to the control unit 100, in Step S16. After such transmission, the above-explained Step S6 and subsequent steps are performed.

Figure 7:
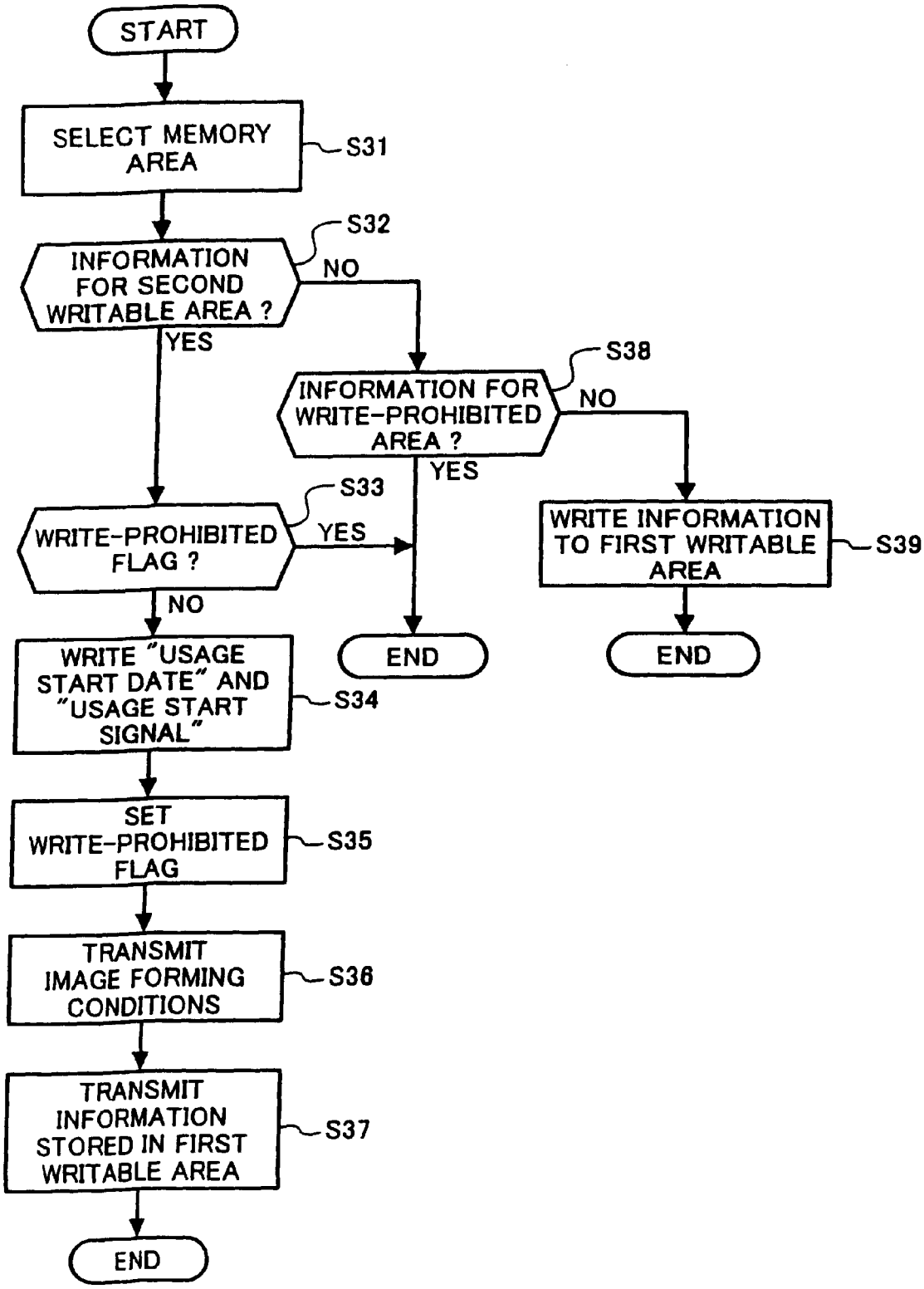
FIG. 7 is a flow chart explaining a primary information writing operation for the nonvolatile memory of the process cartridge.

FIG. 7 is a flow chart explaining a primary information writing operation for the nonvolatile memory 157 of the process cartridge 20.

As illustrated in FIG. 7, a memory area corresponding to a product group ID is selected, in Step S31.

In Step S32, it is determined whether information transmitted from the control unit 100 relates to the second writable area of the nonvolatile memory 157 of the process cartridge 20.

When it is determined that the information transmitted from the control unit 100 relates to the second writable area in Step S32, it is determined whether a write-prohibited flag is detected, in Step S33.

When it is determined that the write-prohibited flag is not detected, that is, the second writable area is determined to be writable, "Usage start date" and "Usage start signal" are overwritten to the second writable area of the nonvolatile memory 157 corresponding to the product group ID in Step S34.

After Step S34, a write-prohibited flag is set to the second writable area of the nonvolatile memory 157, in Step S35.

After Step S35, information relating to image forming conditions corresponding to the product group ID stored in the nonvolatile memory 157 is transmitted to the control unit 100, in Step S36.

After Step S36, information stored in the first writable area of the nonvolatile memory 157 is transmitted to the control unit 100, in Step S37, and the primary information writing operation ends.

On the other hand, when it is determined that the information does not relate to the second writable area in Step S32, it is determined whether the information is a write-prohibited information, in Step S38.

When it is determined that the information is the write-prohibited information in Step S38, the primary information writing operation ends.

On the other hand, when it is determined that the information is not the write-prohibited information Step S38, the information is written to the first writable area of the nonvolatile memory 157 corresponding to product group ID, in Step S39, and the primary information writing operation ends.

Also when it is determined that the write-prohibited flag is detected in Step S33, the primary information writing operation ends.

Figure 8:
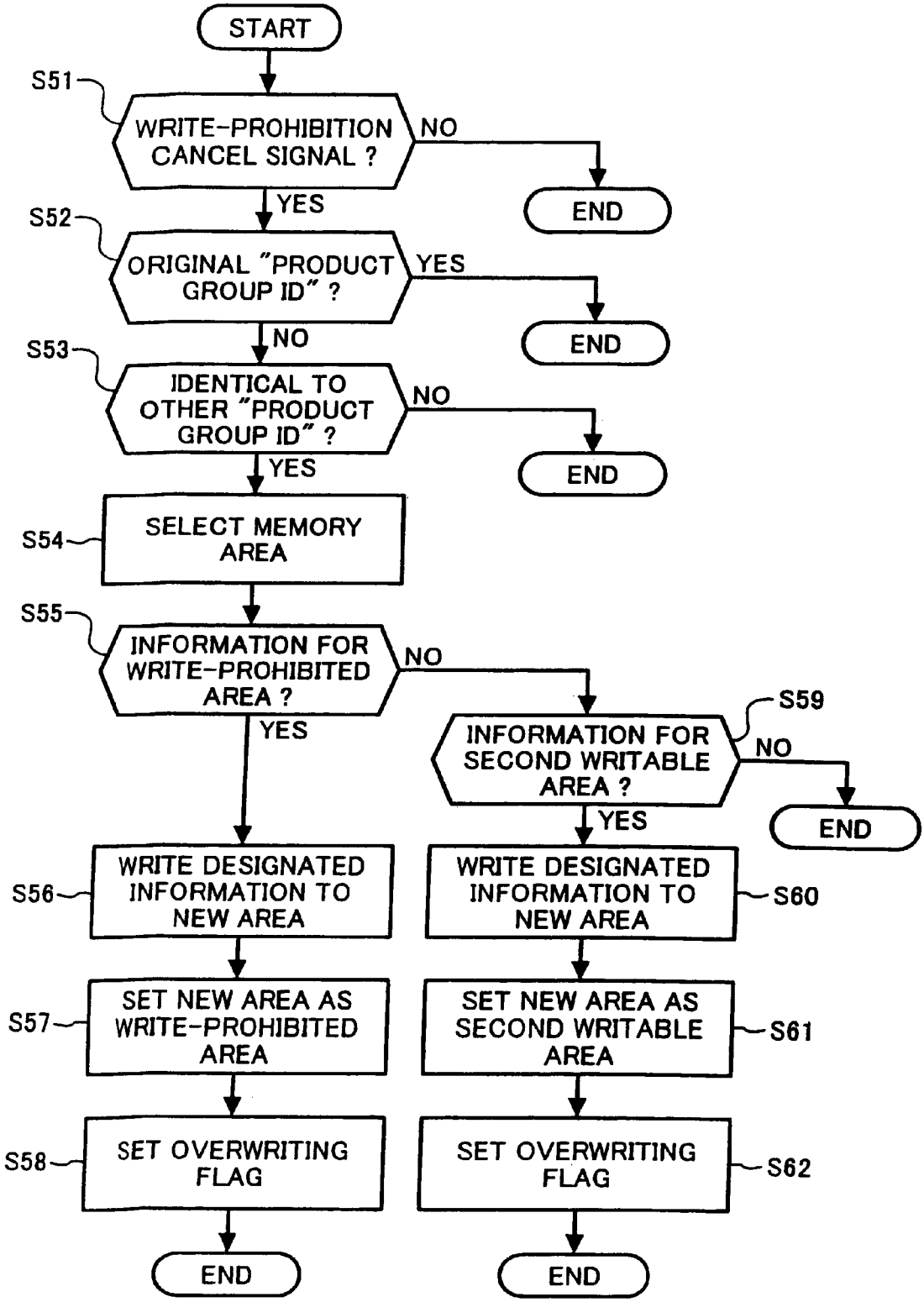
FIG. 8 is a flow chart explaining a secondary information writing operation for a write-prohibited area and a second writable area of the nonvolatile memory of the process cartridge.

FIG. 8 is a flow chart explaining a secondary information writing operation for the write-prohibited area and the second writable area of the nonvolatile memory 157 of the process cartridge 20.

Principally, the write-prohibited area does not allow information overwriting, and the second writable area allows an information overwriting only one time.

However, as for the secondary information writing operation to be described hereinafter, an administrator (a designated person to administer the image forming apparatus) can exceptionally cancel write-prohibition and one time information writing, and can write information to the write-prohibited area and the second writable area of the nonvolatile memory 157. Therefore, the administrator can optimize operation conditions of the image forming apparatus.

The administrator can input necessary information to the image forming apparatus by operating the operation unit 90 directly, or by a remote control using a management system.

As illustrated in FIG. 8, it is determined whether information from an external unit (i.e. the operation unit 90 or the management system) has a write-prohibition cancel signal (predetermined code) in Step S51.

When it is determined that the write-prohibition cancel signal is not detected, the secondary information writing operation ends.

On the other hand, when it is determined that the write-prohibition cancel signal is detected, it is determined whether the product group ID relating to the write-prohibition cancel signal is identical with the original product group ID of the process cartridge 20, in Step S52.

When it is determined that the product group ID relating to the write-prohibition cancel signal is identical with the original product group ID in Step S52, information writing is not performed, and the secondary information writing operation ends.

On the other hand, when it is determined that the product group ID relating to the write-prohibition cancel signal is not identical with the original product group ID in Step S52, it is determined whether the product group ID relating to the write-prohibition cancel signal is identical with any of a plurality of product group IDs stored in the nonvolatile memory 157, in Step S53.

When it is determined that the product group ID is not identical with any of the plurality of product group IDs in Step S53, information writing is not performed, and the secondary information writing operation ends.

On the other hand, when it is determined that the product group ID relating to the write-prohibition cancel signal is identical with any of the plurality of product group IDs in Step S53, a memory area corresponding to the product group ID judged as identical is selected, in Step S54.

After Step S54, it is determined whether information (designated information) transmitted with the write-prohibition cancel signal relates to the write-prohibited area, in Step S55.

When it is determined that the information transmitted with the write-prohibition cancel signal relates to the write-prohibited area in Step S55, a new area including the existing write-prohibited area is allocated in the nonvolatile memory 157, and the designated information is written to the new area, in Step S56.

After Step S56, the new area, in which existing information is overwritten in Step S56, is set as a new write-prohibited area in Step S57, and a flag indicating that an overwriting is performed in the write-prohibited area is set, in Step S58. Then the secondary information writing operation ends.

On the other hand, when it is determined that the information does not relate to the write-prohibited area in Step S55, it is determined whether the designated information relates to the second writable area, in Step S59.

When it is determined that the designated information relates to the second writable area in Step S59, a new area including the second writable area is allocated in the nonvolatile memory 157, and the designated information is written to the new area, in Step S60. At this time, the second writable area is in a state that information writing can be performed another one time.

After Step S60, the new area, in which the existing information is overwritten, is set as a new second writable area in Step S61, and a flag indicating that an overwriting is performed in the second writable area is set, in Step S62. Then the secondary information writing operation ends.

When it is determined that the information does not relate to the second writable area in Step S59, the secondary information writing operation ends.

Next, as one example of an exemplary embodiment of the present invention, a management system connected to the above-mentioned image forming apparatus will be explained with reference to FIGS. 9 and 10.

As explained in FIG. 3, the image forming apparatus according to an exemplary embodiment of the present invention can be connected to a public telecommunication line or the Internet.

Figure 9:
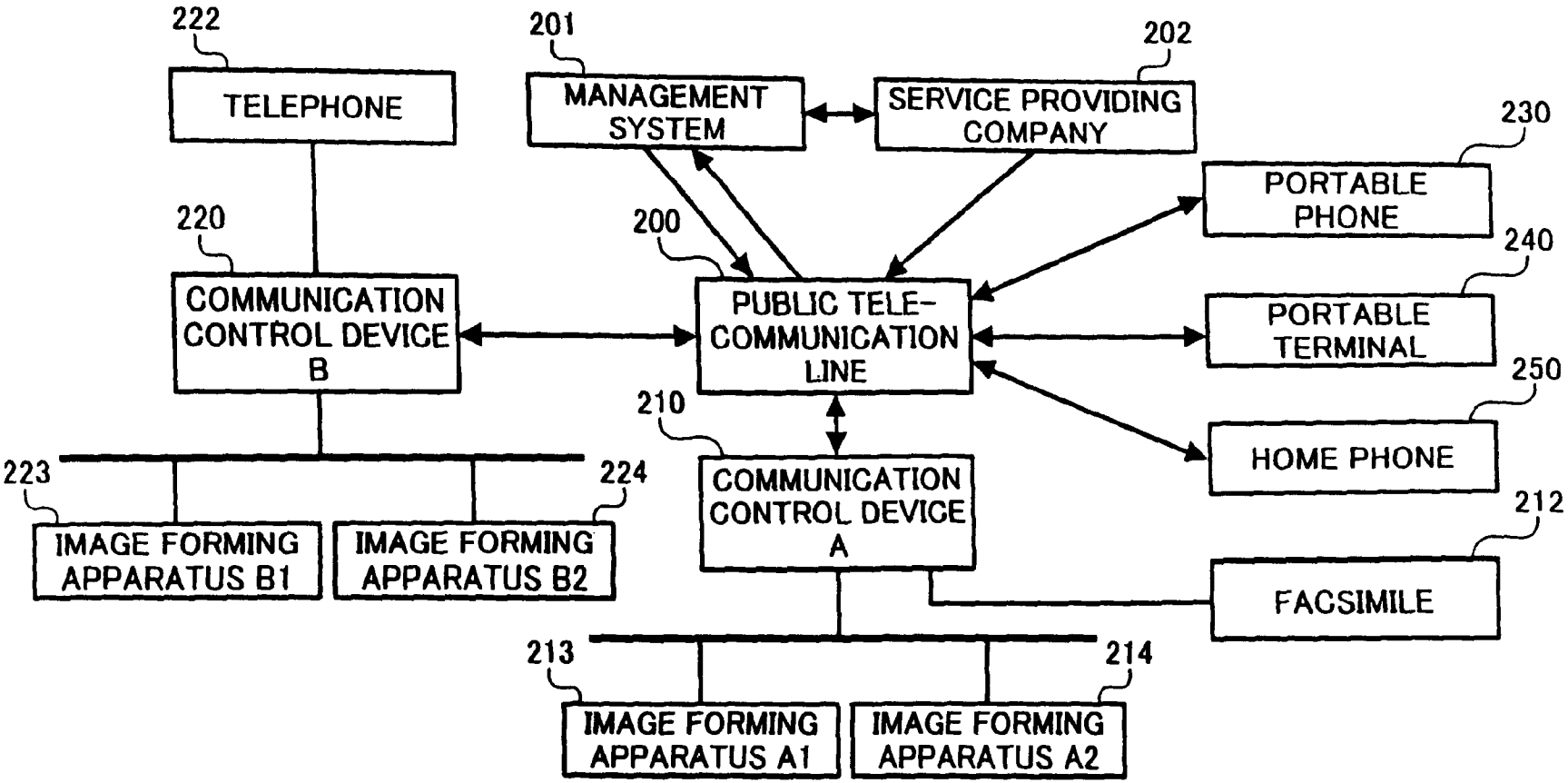
FIG. 9 is an exemplary schematic view illustrating a plurality of image forming apparatuses connected to a management system via a public telecommunication line network.

FIG. 9 is an exemplary schematic view illustrating a plurality of image forming apparatuses connected to a management system via a public telecommunication line network.

Figure 10:
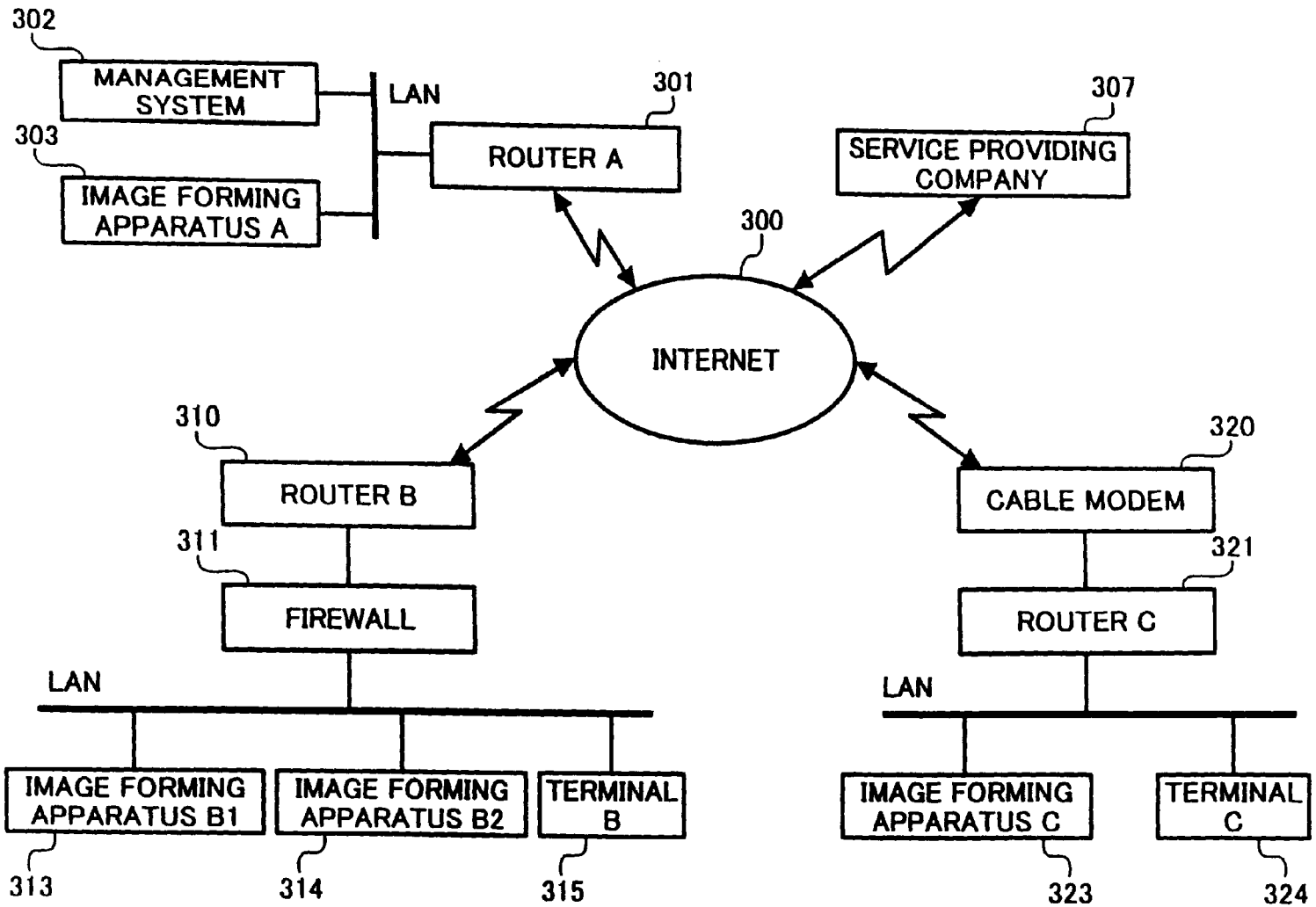
FIG. 10 is an exemplary schematic view illustrating a plurality of image forming apparatuses connected to a management system via the Internet.

FIG. 10 is an exemplary schematic view illustrating a plurality of image forming apparatuses connected to a management system via the Internet. The image forming apparatuses used in FIGS. 9 and 10 are similar to the image forming apparatus explained in FIGS. 1 through 8.

As illustrated in FIG. 9, two image forming apparatuses 213 and 214 are connected to a communication control device 210 with a facsimile 212, and another two image forming apparatuses 223 and 224 are connected to another communication control device 220 with a telephone 220.

The two communication control devices 210 and 220 are connected to a management system 201, which is a management center, via public telecommunication line 200.

With such a configuration, the plurality of image forming apparatuses 213, 214, 223, and 224 and the management system 201, which administer quality of the image forming apparatuses, can communicate with each other via the public telecommunication line 200.

Specifically, the management system 201 can obtain information stored in the control unit 100 and the nonvolatile memory 157 of the image forming apparatuses 213, 214, 223, and 224 via public telecommunication line 200. Therefore, an administrator using the management system 201 can correctly administer operational statuses of the image forming apparatuses 213, 214, 223, and 224 in real time manner from a remote area.

Based on such information, the management system 201 transmits information (designated information) to optimize the operational statuses of the image forming apparatuses 213, 214, 223, and 224 via the public telecommunication line 200. Thus, an administrator using the management system 201 can optimally adjust the operational statuses of the image forming apparatuses 213, 214, 223, and 224 from a remote area.

As illustrated in FIG. 9, the management system 201 can be also connected to a service providing company 202, and a portable phone 230, a portable terminal 240, and a home phone 250 of a service person are also connected to a service providing company 202 via the public telecommunication line 200.

Therefore, based on the information obtained from the image forming apparatuses 213, 214, 223, and 224, the management system 201 can provide a higher quality service to a user by collaborating with the service providing company 202 and the service person.

As illustrated in FIG. 10, two image forming apparatus 313 and 314 are connected to a router 310 and firewall 311 with a terminal 315 to form one LAN, and another image forming apparatus 323 is connected to a router 321 and cable modem 320 with a terminal 324 to form another LAN.

Furthermore, a management system 302 is connected to a router 301 with an image forming apparatus 303 to form another LAN for management center. These LANs are connected by a network to form an Internet 300.

With such a configuration, the plurality of image forming apparatuses 303, 313, 314, and 323 and the management system 302 can communicate each other via the Internet 300.

Specifically, the management system 302 can obtain information stored in the control unit 100 and the nonvolatile memory 157 of the image forming apparatus 303, 313, 314, and 323 via the Internet 300. Therefore, an administrator using the management system 302 can correctly administer operational statuses of the image forming apparatus 303, 313, 314, and 323 in real time manner from a remote area.

Based on such information, the management system 302 transmits information (designated information) to optimize the operational statuses of the image forming apparatuses 303, 313, 314, and 323 via Internet 300. In such a way, the administrator using the management system 302 can optimally adjust the operational statuses of the image forming apparatuses 303, 313, 314, and 323 from a remote area.

As illustrated in FIG. 10, the management system 302 can be also connected to a service providing company 307. Therefore, based on the information obtained from the image forming apparatuses 303, 313, 314, and 323, the management system 302 can provide a higher quality service to a user by collaborating with the service providing company 307.

In an exemplary embodiment of the present invention, the image forming apparatus recognizes a replacement of the process cartridge 20 and different conditions of the process cartridge 20 such as name of manufacture, brand new one or recycled one, number of recycling, version, color, and adjusts conditions of the image forming apparatus based on such information to realize an optimal image formation condition for the image forming apparatus.

All necessary information for the optimal image formation are sorted and organized into either one of the write-prohibited area, the first writable area, the second writable area in the nonvolatile memory 157 of the process cartridge 20 depending on properties of the information, and such information is communicated to the control unit 100.

With such a configuration, a control for adjusting conditions for the image forming apparatus is well organized, and an information manipulation by a third party person who has no access rights to the apparatus can be prevented.

Furthermore, a user can monitor a condition of the apparatus by viewing information displayed on the display portion, and the apparatus can be adjusted by communication with the management systems 199 and 302. Thus, a user-friendly apparatus maintaining high quality and high reliability for a long time can be provided.

In an exemplary embodiment of the present invention, a device unit is the process cartridge 20 having the nonvolatile memory and detachable from the image forming apparatus. However, the present invention does not limit the device unit to such a case, but any device units giving different quality to an image forming apparatus on a unit-by-unit basis can be used. The present invention defines a "device unit" as a unit detachably provided to an image forming apparatus.

For example, the present invention can be applied to any device units including the optical unit 2, the transfer belt units 24 and 30, the fixing unit 66, the sheet feeding unit 61 in FIG. 1, and the developer bottle 33 (e.g., developer cartridge) in FIGS. 2A and 2B.

In addition, in an image forming apparatus having no process cartridge, the present invention can be applied to an independent device unit for the image forming process such as a photo-sensitive member in a drum shape, a charging unit, a developing unit, a cleaning unit, and a transfer unit, for example.

Furthermore, the present invention can be applied to a multi-functional unit formed by combining a plurality of photo-sensitive members in a drum shape, charging device, developing device, cleaning device, and transfer device, for example.

In such cases, similar effects as this exemplary embodiment of the present invention can be obtained by providing a nonvolatile memory, which stores necessary information for image formation quality, to a device unit, and by providing a write-prohibited area, a first writable area, and a second writable area in the nonvolatile memory.

The exemplary embodiment of the present invention is applied to an image forming apparatus using an electro-photography. However, the present invention is not limited to such a case, but can be applied to a variety of image forming apparatuses provided with a device unit such as an image forming apparatus using an ink jet method, and an image forming apparatus using a heat transfer method.

In the exemplary embodiment of the present invention, although the engine control board 110 and the control board 101 are separately provided in the control unit 100 of the image forming apparatus, they may be integrated in one board.

Hereinafter, another exemplary embodiment of the present invention will be explained, which is similar to the embodiments shown in FIGS. 1, 9, and 10.

Figure 11A:
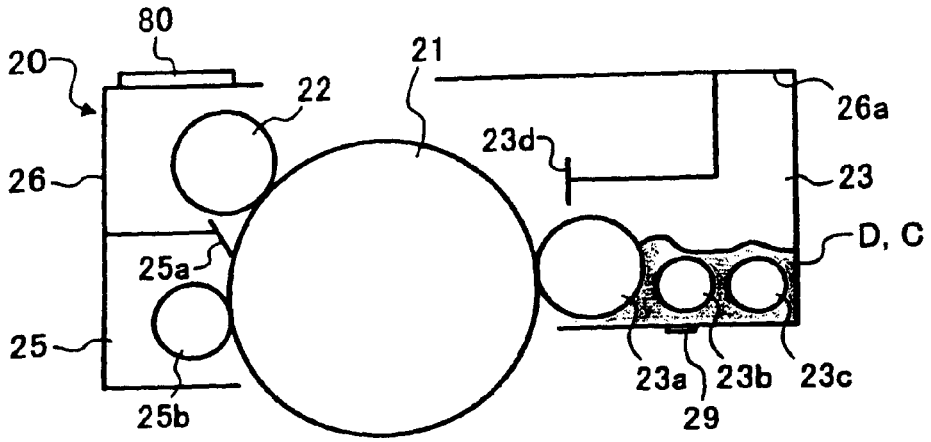
FIG. 11A is an exemplary cross sectional view of a process cartridge in a new and unused state to be installed in the image forming apparatus.
Figure 11B:
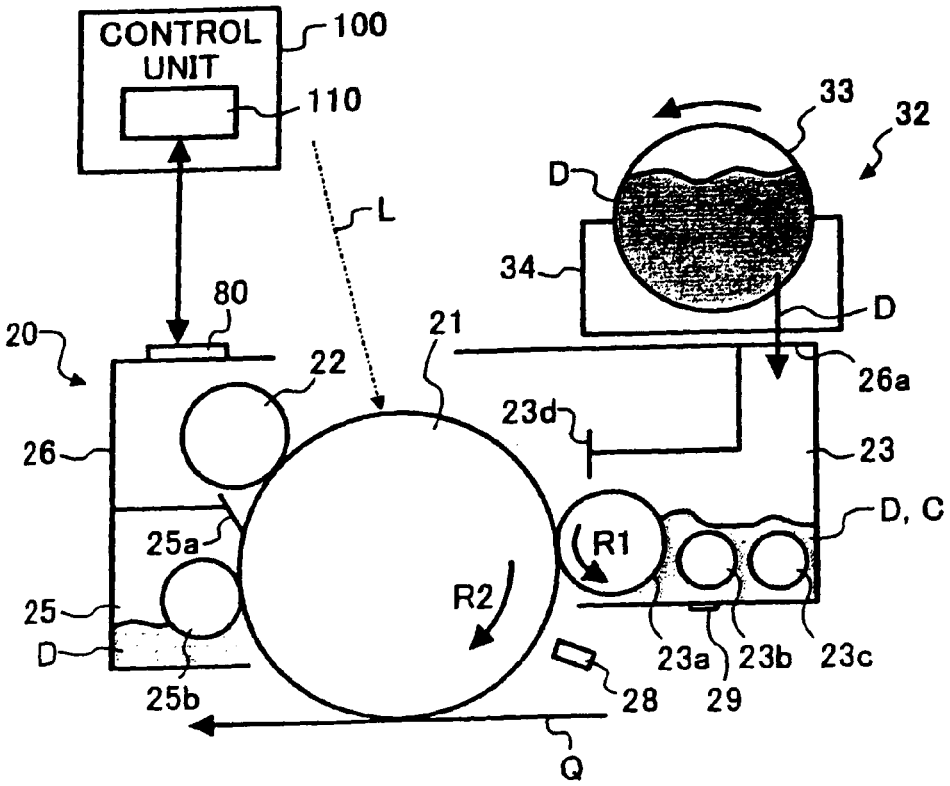
FIG. 11B is an exemplary cross sectional view of the process cartridge in FIG. 11A installed in the image forming apparatus.

FIGS. 11A and 11B are exemplary cross sectional views of the process cartridge detachable from the image forming apparatus according to another exemplary embodiment of the present invention. Because the four process cartridges provided to the image forming apparatus have a similar configuration except the color of stored developers, reference signs Y, M, C, and K are omitted from the drawing.

FIG. 11A is an exemplary cross sectional view of the process cartridge 20 in a new and unused state to be installed in the image forming apparatus. The new and unused state means that the process cartridge 20 (i.e., new product or recycled product) is not used in the image forming apparatus after manufacturing or recycle processing.

FIG. 11B is an exemplary cross sectional view of the process cartridge 20 installed in the image forming apparatus in FIG. 11A.

As illustrated in FIG. 11A, as one example of an exemplary embodiment of the present invention, the process cartridge 20 includes the photo-sensitive member 21 as an image carrying member, the charging device 22, the developing device 23, the cleaning device 25, and a case 26 which encases the above-mentioned members and devices.

As one example of an exemplary embodiment of the present invention, the developing device 23 includes a developing roller 23*a*, agitation rollers 23*b* and 23*c*, a doctor blade 23*d*, and a sensor 29 (i.e., developer concentration sensor), and stores a development agent formed of a carrier C and a developer D therein. The cleaning device 25 includes a cleaning blade 25*a*, and a cleaning roller 25*b*. An IC tag 80 is detachably provided on the case 26 of the process cartridge 20.

The IC tag 80 is an IC chip having a square shape in the order of several millimeters, and communicates with a first nonvolatile memory 111 of the control unit 100 of the image forming apparatus. Specifically, a CPU of control unit 100 processes information stored in the first nonvolatile memory 111 and information stored in a second nonvolatile memory of the IC tag 80.

The IC tag 80 can communicate with the control unit 100 as a contact type using a wired system and I/O port, or a non-contact type using a wireless system having an antenna.

An operator can replace the process cartridge 20 from the image forming apparatus as a single unit. In other words, the process cartridge 20 in FIG. 11B is installed in the image forming apparatus as a device unit.

Specifically, the operator opens a door (not shown) of the image forming apparatus, and installs the process cartridge 20 in the image forming apparatus using guide rails (not shown) provided in the image forming apparatus.

When the process cartridge 20 is installed in the image forming apparatus, the IC tag 80 of the process cartridge 20 and the first nonvolatile memory 111 of the control unit 100 start to communicate with each other for information including image forming conditions, manufacturing, operational history, and usage start date relating to the process cartridge 20.

Based on such communicated information, the control unit 100 adjusts image forming conditions to optimize a whole operation of the image forming apparatus. Such operation will be described in detail later.

After the above-mentioned communication is finished, a normal operation for the image formation explained with FIG. 1 will be performed.

Specifically, the developing roller 23*a* rotates in the direction of arrow R1 in FIG. 11B. The developer D in the developing device 23 is mixed with the carrier C and the developer D supplied from a developer supplying unit 32 by agitation rollers 23*b* and 23*c* rotating to a counter-clockwise direction in FIG. 11B. Frictionally charged developer D is supplied to the surface of the developing roller 23*a* with the carrier C by the agitation roller 23*b*.

The developer D is supplied to the developing device 23 from a developer bottle 33, as required, corresponding to consumption of the developer D in the developing device 23. The consumption of the developer D in the developing device 23 is detected by a developer concentration sensor 28 (P sensor) and a developer concentration sensor 29 (T sensor), wherein the P sensor functions as an optical sensor while facing the photo-sensitive member in drum shape 21, and the T sensor functions as a magnetic permeability sensor provided in the developing device 23.

The developer D carried on the developing roller 23*a* passes a position of the doctor blade 23*d*, and comes to a position facing the photo-sensitive member 21, which rotates in the direction of arrow R2. Then, the developer D is adhered to the electro-static latent image formed on the surface of the photo-sensitive member 21. Specifically, the developer D is adhered to the surface of the photo-sensitive member 21 by an electric field generated by a potential difference between the surface potential of the photo-sensitive member 21 irradiated by a laser light L and a developing bias voltage potential applied to the developing roller 23*a*.

Most of the developer D adhered to the surface of the photo-sensitive member 21 is transferred to the transfer-receiving member Q. The developer D remaining on the surface of the photo-sensitive member 21 is collected in the cleaning device 25 by the cleaning blade 25*a* and the cleaning roller 25*b*.

Figure 12:
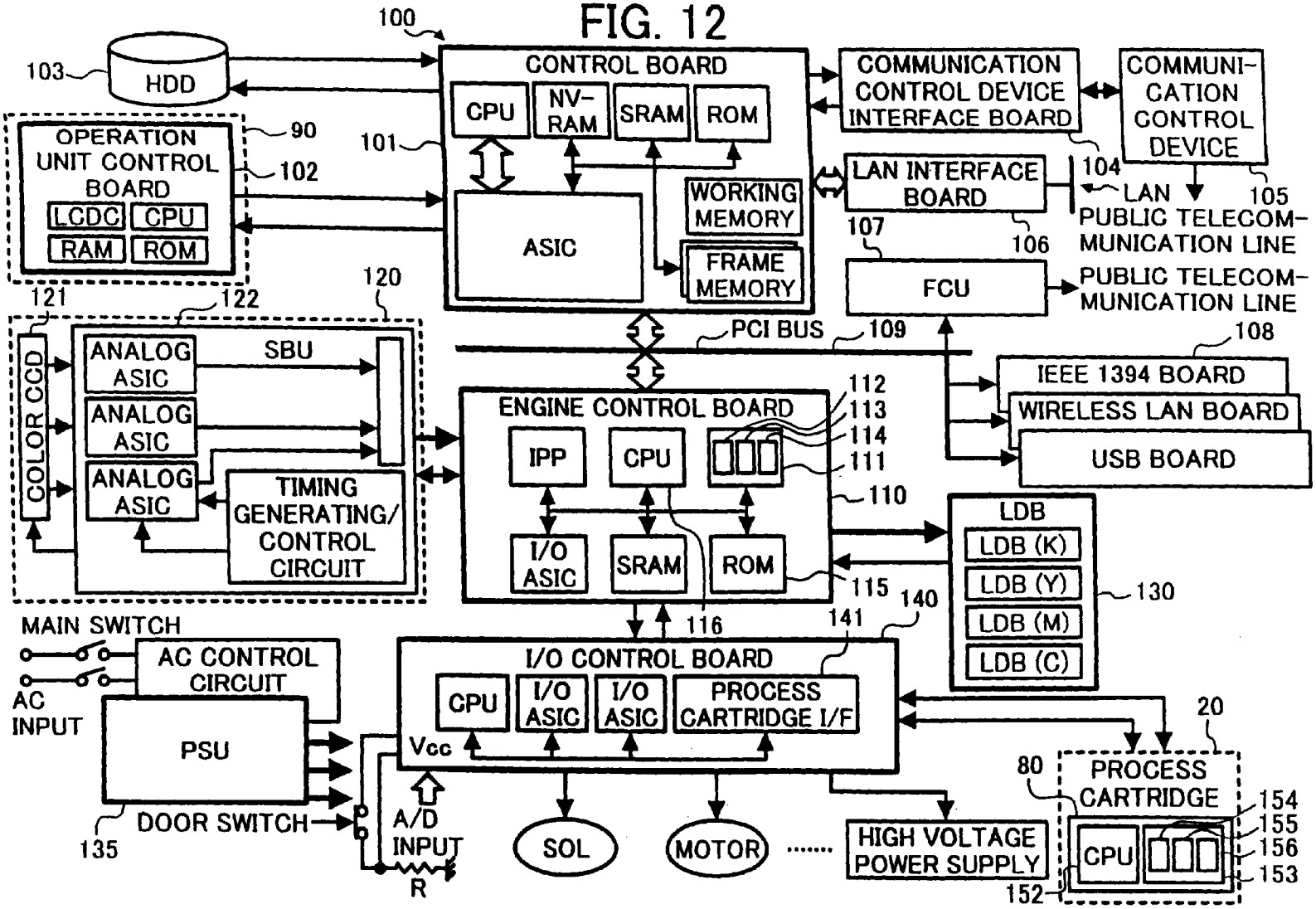
FIG. 12 is an exemplary block diagram for explaining a relationship of a control unit and an IC tag.

FIG. 12 is an exemplary block diagram for explaining a relationship of the control unit 100 and the IC tag 80.

As illustrated in FIG. 12, as one example of an exemplary embodiment of the present invention, the control unit 100 includes a control board 101 configured to control the whole image forming apparatus, an operation unit control board 102 configured to control the operation unit 90, a HDD 103 configured to memorize an image information, a communication control device 105, a communication control device interface board 104 connected to the public telecommunication line such as analog telecommunication line via the communication control device 105, a LAN interface board 106 connected to LAN, a facsimile control unit (FCU) 107 connected to a PCI bus, IEEE1394 board/wireless LAN board/USB board 108, an engine control board 110 connected to the control board 101 via a PCI bus 109, an I/O control board 140 connected to the engine control board 110 and configured to control the input and output (I/O) of the image forming apparatus, a scanner board unit (SBU) 122 configured to scan an image of an original document set to the scanner 120, and a LDB 130 configured to write image information on the surface of the photo-sensitive member 21 by laser light.

A color CCD 121 of the scanner 120 is a three-line color CCD configured to generate an image signal of R (not shown), G (not shown), and B (not shown) in EVENch/ODDch (not shown). These image signals are input to an analog ASIC in the SBU 122 having a timing generating/control circuit configured to generate a drive timing of the analog ASIC and the color CCD 121.

An output signal of the CCD 121 is sampled and held by a sample-hold circuit in the analog ASIC, and then converted to a digital signal by an A/D converter. Image data of R, G, and B converted to a digital signal from an analog signal are corrected by a shading correction, and transmitted to an IPP (image information processor) in the engine control board 110 via an output I/F (interface).

The IPP (image information processor) in the engine control board 110 performs a number of processes including separational generation (i.e., judging whether image is a character region or photo region), real time thresholding (RTT), scanner gamma conversion, filtering, color correction, zooming, image processing, printer gamma conversion, gradation processing. The IPP is a programmable computing processor configured to perform image processing.

The image information is transmitted from the SBU 122 to the IPP to correct signal deterioration (signal deterioration of a scanner system) associated with a conversion to a digital signal, and then written to a frame memory in the control board 101.

The control board 101 includes a CPU, a ROM used for controlling the control board 101, an SRAM as a working memory used by the CPU, an NV-RAM having a lithium cell and a clock for back up of the SRAM, an ASIC configured to control peripheries of the CPU such as system bus control, a frame memory control and FIFO, and an interface circuit.

The control board 101 controls a whole system of the image forming apparatus and is used for controlling a composite machine having multiple applications including a scanner application, a facsimile application, a printer application, a copy application. In other words, the control board 101 decodes information relating to applications, which is input from the operation unit control board 102, sets a condition for the system, and displays such a condition to a display portion of the operation unit 90.

The control board 101 is connected to the communication control device 105 via the communication control device interface board 104 to perform a full duplex asynchronous serial communication. The communication control device 105 is connected in a multi-drop way and communicates with a management system (to be described later) via the communication control device interface board 104.

The control board 101 is connected to the LAN (Internet) via a LAN interface board 106, which is a standard communication interface such as PHY chip I/F embedded with a PHY chip and I2C bus I/F. The control board 101 communicates with a management system (to be described later) via the LAN interface board 106.

The HDD 103 connected to the control board 101 stores an application program of the system, an application database for bias information, and a database for image information, for example. The HDD 103 is connected to the control board 101 via an interface according to an HDD interface standard.

The operation unit control board 102 connected to the control board 101 includes a CPU, a ROM, a RAM, an LCD, and an LCDC which is an ASIC for controlling key input. Based on the communication between the operation unit control board 102 and the control board 101, information required for key-inputs and operations are displayed on a display portion of the operation unit 90. The ROM of the operation unit control board 102 stores a control program to control an input-reading and a display-output. The RAM of the operation unit control board 102 is a working memory used by the CPU.

An operator inputs a system setting through the display portion of the operation unit 90, and checks the system setting and status by viewing the display portion of the operation unit 90.

The engine control board 110 mainly controls the image forming process as explained with FIGS. 1 and 2.

The engine control board 110 includes a CPU 116, an I/O ASIC, the above-mentioned IPP, a ROM 115 storing programs required for controlling image formation, a SRAM required for controlling the ROM 115, and the first nonvolatile memory 111.

The first nonvolatile memory 111 is an IC detachably provided to an IC socket (not shown) of the engine control board 110, and is provided with a write-prohibited area 112, a first writable area 113, and a second writable area 114 with addresses. This will be described later.

The engine control board 110 is connected to the control board 101 via the PCI bus 109, which is an image information bus/control command bus transmitting image information and control commands in a time division manner.

Write signals of each color of yellow, magenta, cyan, and black are output from a working memory of the control board 101, and input to an LD writing circuit in an LD board (LDB) 130 connected to the engine control board 110. The LD writing circuit performs an LD current control (i.e., modulation control), and outputs the LD current to each of the LD light sources.

The I/O ASIC of the engine control board 110 has a serial interface to communicate with the CPU 116. The I/O ASIC controls devices including a counter, a fan, a solenoid, and a motor provided closely to the engine control board 110.

The I/O control board 140 connected to the engine control board 110 by a synchronous serial interface includes a CPU, an I/O ASIC, and a process cartridge I/F 141. The CPU of the I/O control board 140 functions as a sub-CPU, and performs I/O control such as an analog control of the developer concentration sensor 28 (P sensor) explained with FIG. 11.

An installation of the process cartridge 20 in a new and unused state to the image forming apparatus is detected when a door of the image forming apparatus is opened and closed. That is, when a door switch connected to the I/O control board 140 is in an "OFF" state, the process cartridge 20 is checked because the process cartridge 20 may be replaced with a new one. The check result is transmitted to the engine control board 110. A series of control steps for such situation will be explained later with a flow chart.

The process cartridge I/F 141 is an interface circuit included in the I/O control board 140, through which the first nonvolatile memory 111 and the second nonvolatile memory 153 of the IC tag 80 communicates each other.

For example, when a communication interface between the second nonvolatile memory 153 and the process cartridge I/F 141 is an I2C bus, parallel signals from the CPU 116 of the control unit 100 are converted to I2C signals, and transmitted to the second nonvolatile memory 153. Similarly, signals from the second nonvolatile memory 153 are converted to parallel signals, and transmitted to the CPU 116 of the control unit 100. On the other hand, when the CPU 116 of the control unit 100 has an I2C bus, the first nonvolatile memory 111 and the second nonvolatile memory 153 are connected directly.

A PSU 135 is a power supply unit for the image forming apparatus, and supplies power to control the image forming apparatus. The power is supplied to the image forming apparatus by switching a main switch to an "ON" state.

As one example of an exemplary embodiment of the present invention, the IC tag 80 of the process cartridge 20 includes the second nonvolatile memory 153, and a CPU 152. The second nonvolatile memory 153 includes a write-prohibited area 154, a first writable area 155, and a second writable area 156 with addresses.

Most of the information stored in the first nonvolatile memory 111 and the second nonvolatile memory 153 are inter-related information necessary for controlling the image forming apparatus.

The second nonvolatile memory 153 provided to the process cartridge 20 will be explained in detail with referring to FIG. 13. FIG. 13 is an exemplary memory map of the second nonvolatile memory 153 of the process cartridge 20.

As illustrated in FIG. 13, as one example of an exemplary embodiment of the present invention, a first writable area is allocated with an address 00H, a second writable area is allocated with an address 20H, and a write-prohibited area is allocated with address 30H in the second nonvolatile memory 153 when an A type unit is used. Similarly, another first writable area is allocated with an address 50H, and another second writable area (not shown) and another write-prohibited area (not shown) are allocated in the nonvolatile memory 153 when a B type unit is used.

The A type unit and the B type unit are different types of the image forming apparatus. The process cartridge 20 can be installed in a plurality of types of the image forming apparatus such as an A type unit and a B type unit.

The process cartridge 20 communicates with the above-mentioned control unit 100, and judges the types of the image forming apparatus. In this case, the type is determined as the A type, and information in the first writable area (address 00H), the second writable area (address 20H), and the write-prohibited area (address 30H) in the second nonvolatile memory 153 corresponding to the A type unit is used.

As illustrated in FIG. 13, as one example of an exemplary embodiment of the present invention, "Product group ID of process cartridge," "Version of process cartridge," "Color type of developer (color ID)," "Effective period (Storage period)," "Number of copied sheets," "Number of recycling," "Recycled date," "Malfunction history (Error history)," "Filling amount of developer," "Filling date of developer," and "Developer remaining amount" are stored with certain bytes in the first writable area (address 00H) of the second nonvolatile memory 153. Although it is not shown in FIG. 13, the first writable area (address 00H) of the second nonvolatile memory 153 may also include "Developer lot," and "Replacement history of device unit".

The information in the first writable area is non-permanent information relating to an operational history of the process cartridge 20, and most of the information therein relates to a recycle history. Because the information in the first writable area is non-permanent information corresponding to the history of the process cartridge 20, information stored in the first writable area is re-writable.

In other words, information in the first writable area can be read and written freely, and is re-writable as required.

"Product group ID of process cartridge" and "Version of process cartridge" are defined as non-permanent information with a consideration of the process cartridge recycling.

As illustrated in FIG. 13, as one example of an exemplary embodiment of the present invention, information such as "Usage start date," "Usage start signal," and "Write-prohibited flag" are stored with certain bytes in the second writable area (address 20H) of the second nonvolatile memory 153.

The information in the second writable area is mainly semi-permanent information defined at the time of usage start of the process cartridge 20. The usage start of the process cartridge 20 means that the process cartridge 20 is in a new and unused state and is used for the first time.

Because the information in the second writable area is semi-permanent information defined at the time of the usage start of the process cartridge 20, information can be written only one time. That is, information such as "Usage start date" is written to the second writable area at the time of the usage start of the process cartridge 20.

As illustrated in FIG. 13, as one example of an exemplary embodiment of the present invention, information such as "Lot No.," "Manufacturer (Manufacturer ID)," "Manufactured date," "Serial No. (ID No.)," "Limit of number of recycling," "Product group ID of process cartridge," "Version of process cartridge," "Amount of exposed light," "Amount of charging," and "Developing bias voltage" are stored with certain bytes in the write-prohibited area (address 30H) of the second nonvolatile memory 153.

The information in the write-prohibited area is mainly permanent information relating to manufacturing of the process cartridge 20 and image forming conditions. The permanent information is information defined at the time of manufacturing the process cartridge 20.

Because the information in the write-prohibited area is permanent information defined at the time of the manufacturing the process cartridge 20, information stored in the write-prohibited area cannot be overwritten.

The image forming conditions relating to the image forming process explained with FIGS. 1 and 2 are, for example, the amount of exposed light of the laser light L in the exposing process, and the amount of charging by the charging device 22 in the charging process, the developing bias voltage of the developing device 23 in the developing process, and the image forming conditions are customized information of the process cartridge 20 to perform an optimal image formation.

"Product group ID of process cartridge" and "Version of process cartridge" are designated as permanent information because they should be the original information at the time of manufacturing.

Next, the first nonvolatile memory 111 provided to the image forming apparatus will be explained in detail with reference to FIG. 14. FIG. 14 is an exemplary memory map of the first nonvolatile memory 111 of the engine control board 110.

As illustrated in FIG. 14, as one example of an exemplary embodiment of the present invention, a write-prohibited area is allocated with an address 00H, a first writable area is allocated with an address 20H, and a second writable area is allocated with address 40H in the first nonvolatile memory 111 when an "a" unit (i.e., an "a" type process cartridge) is used. Similarly, another write-prohibited area (not shown), another first writable area with an address 60H, and another second writable area (not shown) and are allocated in the first nonvolatile memory 111 when a "b" unit (i.e., a "b" type process cartridge) is used.

The "a" unit and the "b" unit are different types of process cartridge (e.g. manufacturer, recycled, version, color type). A plurality of types of process cartridge 20 such as "a" unit and "b" unit can be installed in the image forming apparatus.

The above-mentioned control unit 100 communicates with the process cartridge 20, and judges the type of the process cartridge 20. In this case, the type is determined as an "a" unit, and information in the first writable area (address 20H), the second writable area (address 40H), and the write-prohibited area (address 00H) in the first nonvolatile memory 111 corresponding to the "a" type unit are used.

As illustrated in FIGS. 14A, 14B and 14C, as one example of an exemplary embodiment of the present invention, information such as "Manufacturer of image forming apparatus (Manufacturer ID)," "Lot No. of image forming apparatus," "Manufactured date of image forming apparatus," "Product group ID of process cartridge when image forming apparatus is shipped from factory," "Date of when image forming apparatus is shipped from factory," "Lot No. of process cartridge when image forming apparatus is shipped from factory," "Manufacturer of process cartridge when image forming apparatus is shipped from factory (Manufacturer ID)," "Manufactured date of process cartridge when image forming apparatus is shipped from factory," "Serial No. of process cartridge when image forming apparatus is shipped from factory," and "Number of limit of recycling of process cartridge when image forming apparatus is shipped from factory" are stored with certain bytes in the write-prohibited area starting at a predetermined location, for example .address 00H, of the first nonvolatile memory 111.

The information in the write-prohibited area is mainly permanent information relating to manufacturing of an image forming apparatus having a process cartridge 20. The permanent information is information defined at the time of manufacturing the image forming apparatus. Because the information in the write-prohibited area is permanent information defined at the time of the manufacturing the image forming apparatus, information stored in the write-prohibited area cannot be overwritten.

The image forming conditions of the process cartridge 20 can be written to the write-prohibited area at the time of shipping from a factory providing that only an administrator of a management system (to be described later) can cancel the write-prohibited area as described later.

As illustrated in FIGS. 14A, 14B and 14C, as one example of an exemplary embodiment of the present invention, information such as "Product group ID of process cartridge," "Version of process cartridge," "Color type of developer (color ID)," "Effective period (Storage period)," "Number of copied sheets," "Number of recycling," "Recycled date," "Malfunction history (Error history)," "Amount of exposed light," "Amount of charging," and "Developing bias voltage" are stored with certain bytes in the first writable area (e.g., at address 20H) of the first nonvolatile memory 111. Because the information in the first writable area is mainly non-permanent information corresponding to an operational history and image forming conditions of the detachable process cartridge 20, information stored in the first writable area is rewritable.

As illustrated in FIG. 14, as one example of an exemplary embodiment of the present invention, information such as "Usage start date," "Lot No.," "Manufacturer (Manufacturer ID)," "Manufactured date," "Serial No. (ID No.)," "Limit of number of recycling," "Write-prohibited flag," "Product group ID of process cartridge," and "Version of process cartridge," are stored with certain bytes in the second writable area (e.g., at address 40H) of the first nonvolatile memory 111.

The information in the second writable area is mainly semi-permanent information relating to a usage start of the image forming apparatus. The semi-permanent information means information that is defined at the time of usage start of the image forming apparatus. The information in the second writable area can be written only one time when a new process cartridge 20 is installed in the image forming apparatus.

"Product group ID of process cartridge" and "Version of process cartridge" are also designated as the semi-permanent information because they should be referred as the information at the time of manufacturing and replacement of the process cartridge.

The first nonvolatile memory 111 and the second nonvolatile memory 153 communicate information each other to realize an optimal image forming condition for the image forming apparatus. For example, when a recycled process cartridge 20, having a slightly different image forming condition compared with the to-be-replaced process cartridge 20, is installed in the image forming apparatus, information of the image forming condition of the recycled process cartridge 20 is transmitted to the first nonvolatile memory 111. Based on such information, relevant components are controlled such as developing bias voltage adjustment for the developing device 23.

The information communicated between the first nonvolatile memory 111 and the second nonvolatile memory 153 are sorted to the write-prohibited area, the first writable area, and the second writable area of the first nonvolatile memory 111 and the second nonvolatile memory 153 corresponding to property of the information.

Because information is overwritten to the nonvolatile memory in accordance with a magnitude of the information in the above-described way, the information is well organized in the nonvolatile memory. Therefore, smooth control can be achieved, and miss-writing and information manipulation by a third party can be prevented.

Next, control operations of the image forming apparatus will be described in detail with reference to FIGS. 15 through 18.

Figures 15, 15A:
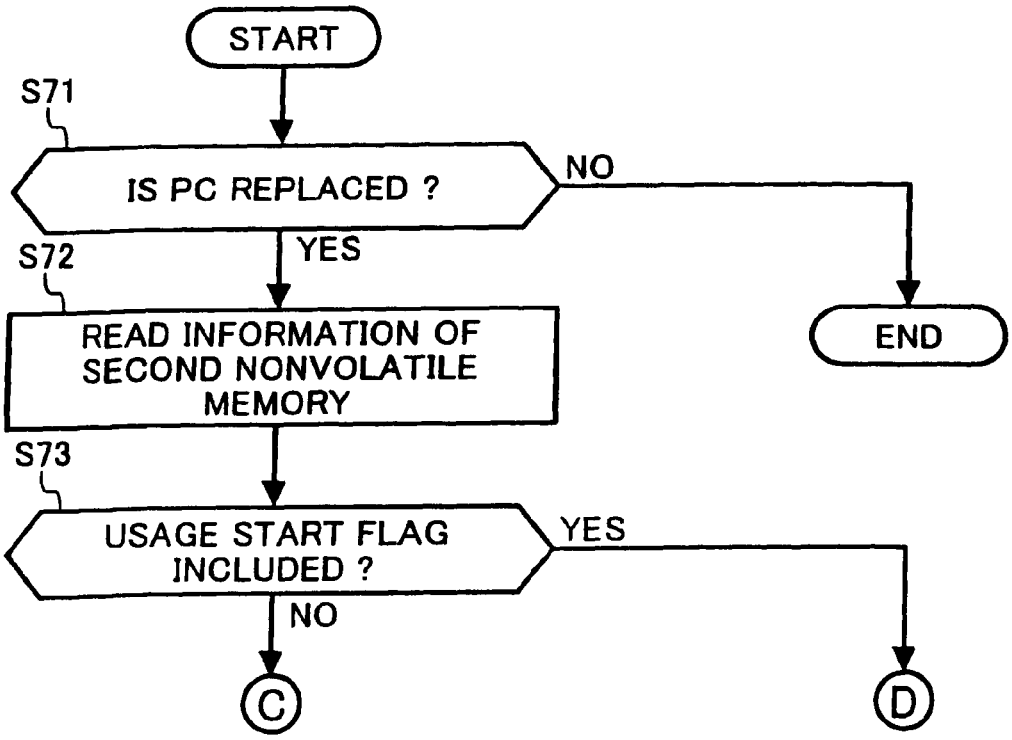
FIGS. 15A and 15B include a flow chart explaining a process cartridge preparation operation of the image forming apparatus in FIG. 1 when the process cartridge is installed in the image forming apparatus.

FIG. 15 is a flow chart explaining a process cartridge preparation operation of the image forming apparatus when the process cartridge 20 is installed therein.

Figure 15B:
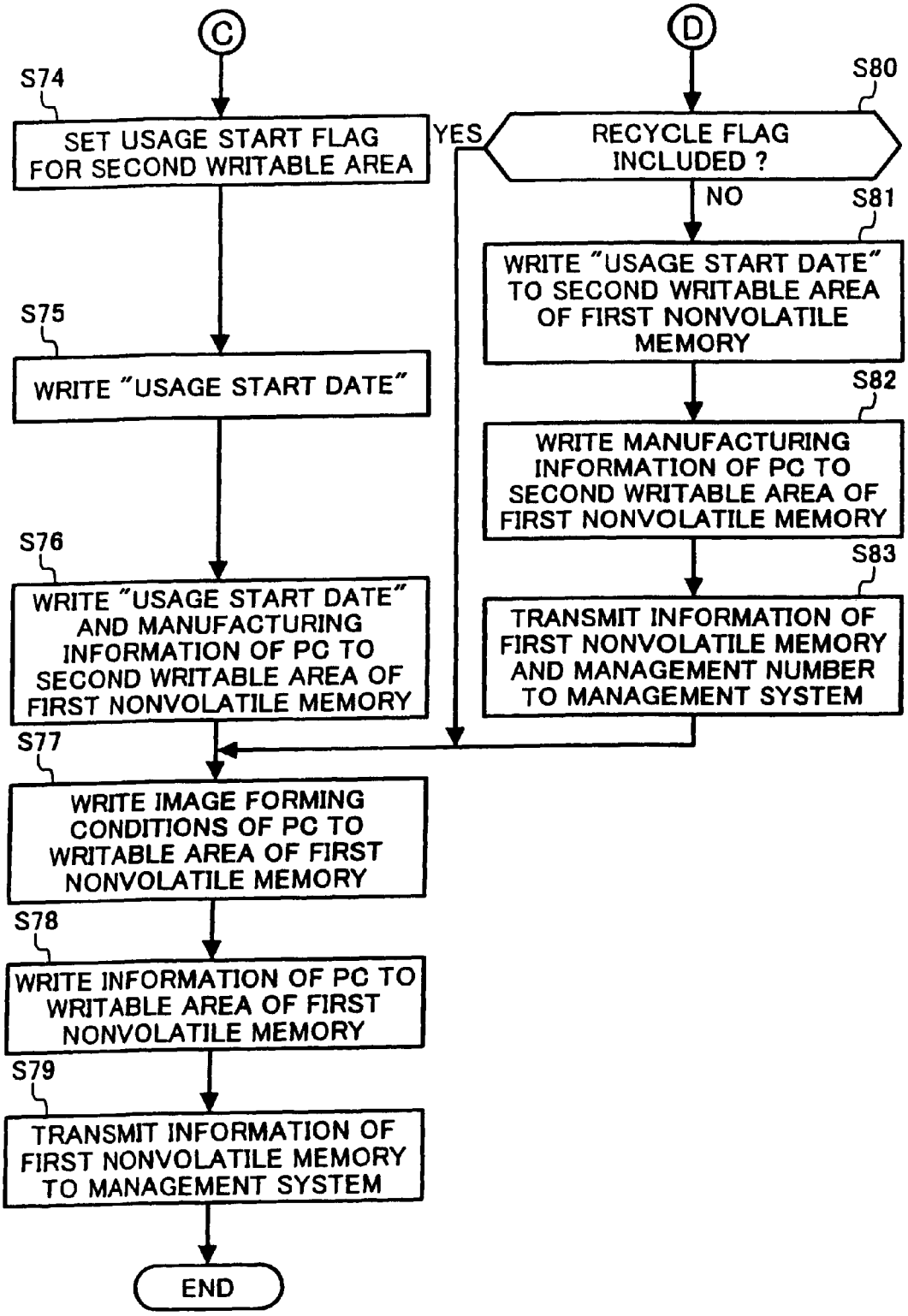

As illustrated in FIGS. 15A and 15B, the process cartridge (abbreviated as "PC" in FIG. 15) 20 is checked to see if it is replaced in the image forming apparatus, in Step S71, which will be described in detail with reference to FIG. 18.

When it is determined that the process cartridge 20 is not replaced from the image forming apparatus in Step S71, the process cartridge preparation operation ends.

On the other hand, when it is determined that the process cartridge 20 is replaced from the image forming apparatus in Step S71, the control unit 100 reads information in the second nonvolatile memory 153 of the process cartridge 20, in Step S72.

After Step S72, the type of the process cartridge 20 is determined in Step S73. Specifically, it is determined whether the process cartridge 20 has a usage start flag, in Step S73.

When it is determined that the installed process cartridge 20 does not have the usage start flag, a write-prohibited area, a first writable area, and a second writable area are allocated in the first nonvolatile memory 111 of the image forming apparatus.

After Step S73, a usage start flag is set for the second writable area of the second nonvolatile memory 153, in Step S74.

After Step S74, a usage start date is written to the second writable area of the second nonvolatile memory 153, in Step S75.

After Step S75, the usage start date and information mainly relating to manufacturing (excluding image forming conditions) in the write-prohibited area of the second nonvolatile memory 153 are overwritten to the second writable area of the first nonvolatile memory 111 of the image forming apparatus, in Step S76.

After Step S76, information of image forming conditions in the write-prohibited area of the second nonvolatile memory 153 is written to the first writable area of the first nonvolatile memory 111 of the image forming apparatus, in Step S77.

After Step S77, information in the first writable area of the second nonvolatile memory 153 is written to the first writable area of the first nonvolatile memory 111 of the image forming apparatus, in Step S78.

After Step S78, information written to the first nonvolatile memory 111 of the image forming apparatus is transmitted to a management system (management center) with a management number (ID number) of the image forming apparatus via public telecommunication line network or the Internet, in Step S79, and the process cartridge preparation operation ends. The above-mentioned management system will be described in detail later.

On the other hand, when it is determined that the installed process cartridge 20 has a usage start flag in Step S73, it is determined whether a recycle flag is detected in the second nonvolatile memory 153, in Step S80.

When it is determined that the recycle flag is detected in the second nonvolatile memory 153, information of image forming conditions corresponding to the ID number of the process cartridge 20 is written to the first writable area of the first nonvolatile memory 111 of the image forming apparatus, in Step S77. After Step S77, the above-described Steps S78 and S79 are performed.

On the other hand, when it is determined that the recycle flag is not detected in the second nonvolatile memory 153 in Step S80, it is determined whether the process cartridge 20 is already used in another image forming apparatus, or the process cartridge 20 is manufactured by another manufacturer different from the manufacturer of the image forming apparatus.

In this case, a write-prohibited area, a first writable area, and a second writable area are allocated in the first nonvolatile memory 111 of the image forming apparatus. And the usage start date stored in the second nonvolatile memory 153 is written to the second writable area of the first nonvolatile memory 111 of the image forming apparatus, in Step S81.

After Step S81, information mainly relating to manufacturing (excluding image forming conditions) in the write-prohibited area of the second nonvolatile memory 153 is written to the second writable area of the first nonvolatile memory 111 of the image forming apparatus, in Step S82.

After Step S82, information written to the first nonvolatile memory 111 of the image forming apparatus is transmitted to a management system (management center) with a management number (ID number) of the image forming apparatus via public telecommunication line network or the Internet, in Step S83.

Based on such information, the management system transmits control information to the image forming apparatus to optimize image forming, or to interrupt an image forming process, for example.

In this situation, the management system can transmit a write-prohibition cancel code to the image forming apparatus to overwrite information in the write-prohibited area or the second writable area of the first nonvolatile memory 111. This will be described in detail later with FIG. 17.

Figure 16:
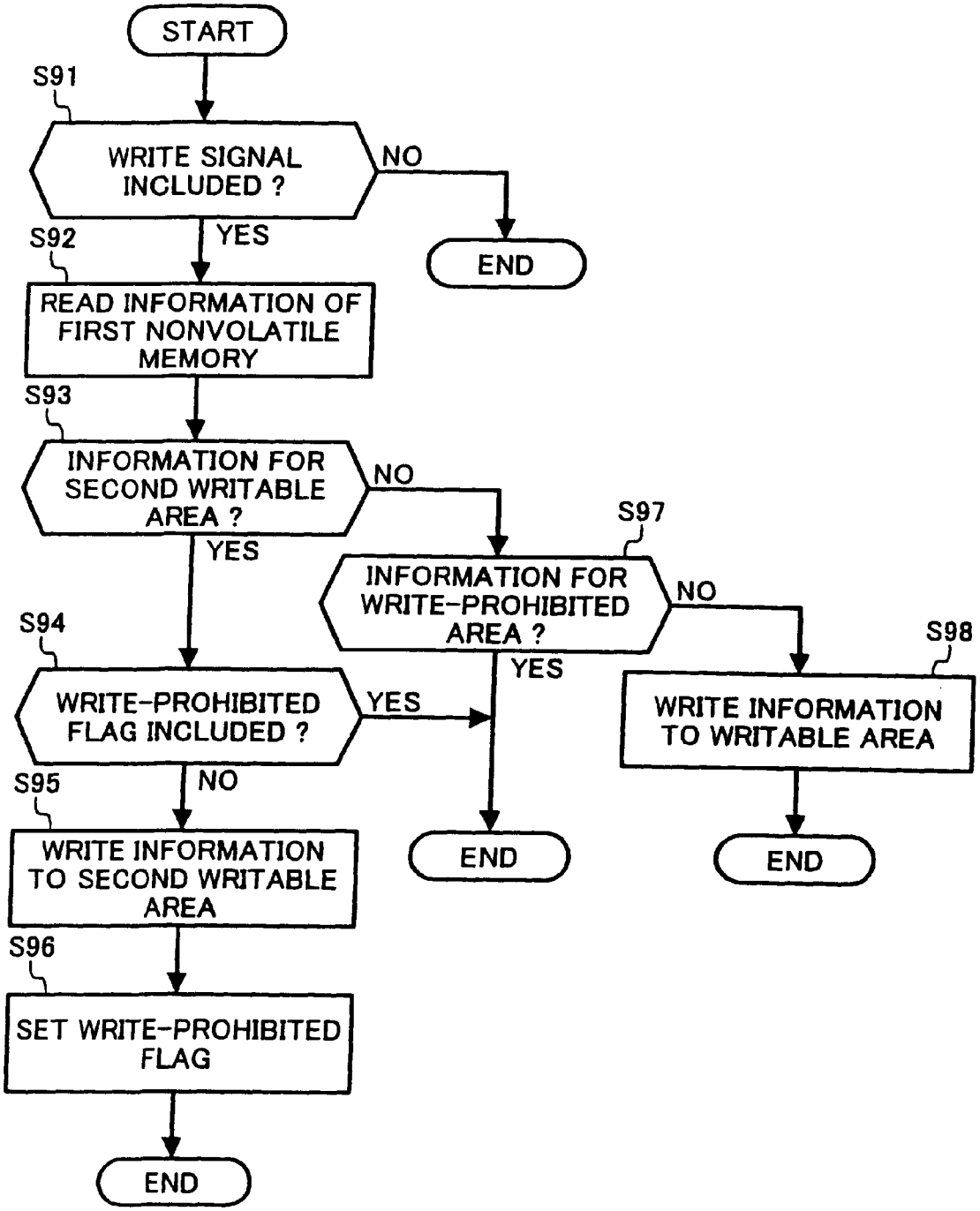
FIG. 16 is a flow chart explaining a primary information writing operation to the second nonvolatile memory of the process cartridge.

FIG. 16 is a flow chart explaining a primary information writing operation to the second nonvolatile memory 153 of the process cartridge 20.

As illustrated in FIG. 16, it is determined whether the control unit 100 transmits a write signal to the process cartridge 20, in Step 91.

When it is determined that the control unit 100 does not transmit the write signal to the process cartridge 20, the primary information writing operation ends.

On the other hand, when it is determined that the control unit 100 transmits the write signal to the process cartridge 20, information written to the first nonvolatile memory 111 is read for the second nonvolatile memory 153, in Step S92.

The information written to the first nonvolatile memory 111 may include information (i.e., designated information) input by an administrator via the management system or the operation unit 90 of the image forming apparatus.

After Step S92, it is determined whether the information read in Step S92 relates to the second writable area of the second nonvolatile memory 153, in Step S93.

When it is determined that the information relates to the second writable area of the second nonvolatile memory 153, it is determined whether a write-prohibited flag is detected, in Step S94.

When it is determined that the write-prohibited flag is not detected in Step S94, that is, it is determined that the information should be written to the second writable area of the second nonvolatile memory 153, the information is written to the second writable area of the second nonvolatile memory 153, in Step S95.

After Step S95, a write-prohibited flag is set to the second writable area of the second nonvolatile memory 153 in Step S96, and the primary information writing operation ends.

On the other hand, when it is determined that the information does not relate to the second writable area of the second nonvolatile memory 153 in Step S93, it is determined whether the information is write-prohibited information, in Step S97.

When it is determined that the information is the write-prohibited information, the primary information writing operation ends.

On the other hand, when it is determined that the information is not the write-prohibited information in Step S97, the information is written to the first writable area of the second nonvolatile memory 153, in Step S98. Then the primary information writing operation ends.

Also when it is determined that a write-prohibited flag is detected in Step S94, the primary information writing operation ends.

Figure 17:
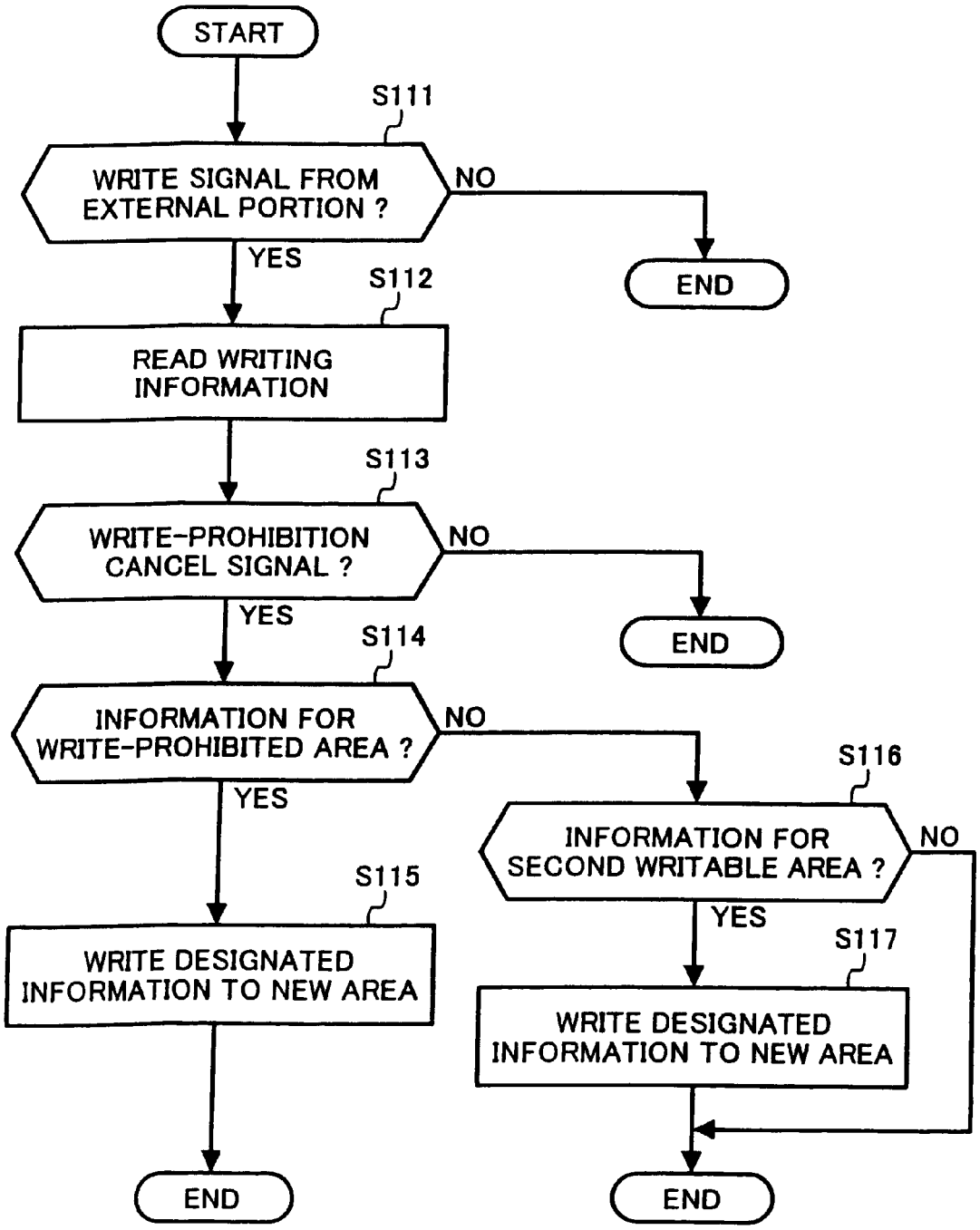
FIG. 17 is a flow chart explaining a secondary information writing operation to a write-prohibited area and a second writable area of the first nonvolatile memory of the image forming apparatus.

FIG. 17 is a flow chart explaining a secondary information writing operation to the write-prohibited area and the second writable area of the first nonvolatile memory 111 of the image forming apparatus.

The secondary information writing operation to be explained hereinafter relates to information writing to the write-prohibited area and the second writable area of the first nonvolatile memory 111 by an administrator (a designated person to administer the image forming apparatus).

Principally, information overwriting in the write-prohibited area is not permitted, and information overwriting in the second writable area is permitted only one time.

However, the administrator can exceptionally overwrite information in the write-prohibited area and the second writable area as illustrated in FIG. 17, and thus can optimize operating conditions of the image forming apparatus.

The administrator can input necessary information to the image forming apparatus by directly operating the operation unit 90 of the image forming apparatus, or by a remote control using the management system.

As illustrated in FIG. 17, it is determined whether an external unit for the image forming apparatus (i.e. operation unit 90 or management system) transmits a write signal to the control unit 100, in Step S111.

When it is determined that the external unit does not transmit a write signal to the control unit 100, the secondary information writing operation ends.

On the other hand, when it is determined that the external unit transmits the write signal to the control unit 100, information (i.e., designated information) from the external unit is read for the first nonvolatile memory 111, in Step S112. The designated information can be read for the second nonvolatile memory 153, as required.

After Step S112, it is determined whether the designated information has a write-prohibition cancel code (predetermined code), in Step S113.

When it is determined that the designated information has the write-prohibition cancel code in Step S113, it is determined whether the designated information relates to the write-prohibited area of the first nonvolatile memory 111, in Step S114.

When it is determined that the designated information relates to the write-prohibited area of the first nonvolatile memory 111 in Step S114, the designated information is written to a new area allocated in addition to the existing write-prohibited area of the first nonvolatile memory 111, in Step S115. Then the secondary information writing operation ends. In this case, a new area for write-prohibited area may be larger or smaller than the existing write-prohibited area.

On the other hand, when it is determined that the designated information does not relate to the write-prohibited area of the first nonvolatile memory 111 in Step S114, it is determined whether the designated information relates to the second writable area of the first nonvolatile memory 111, in Step S16.

When it is determined that the designated information relates to the second writable area of the first nonvolatile memory 111 in Step S116, the designated information is written to a new area allocated in addition to the existing second writable area of the first nonvolatile memory 111, in Step S117. Then the secondary information writing operation ends.

As described above, information writing can be performed to the second writable area of the first nonvolatile memory 111 another one time.

On the other hand, when it is determined that the designated information does not relate to the second writable area of the first nonvolatile memory 111 in Step S116, the secondary information writing operation ends.

When it is determined that the designated information does not have a write-prohibition cancel code in Step S113, the secondary information writing operation ends.

Figure 18A:
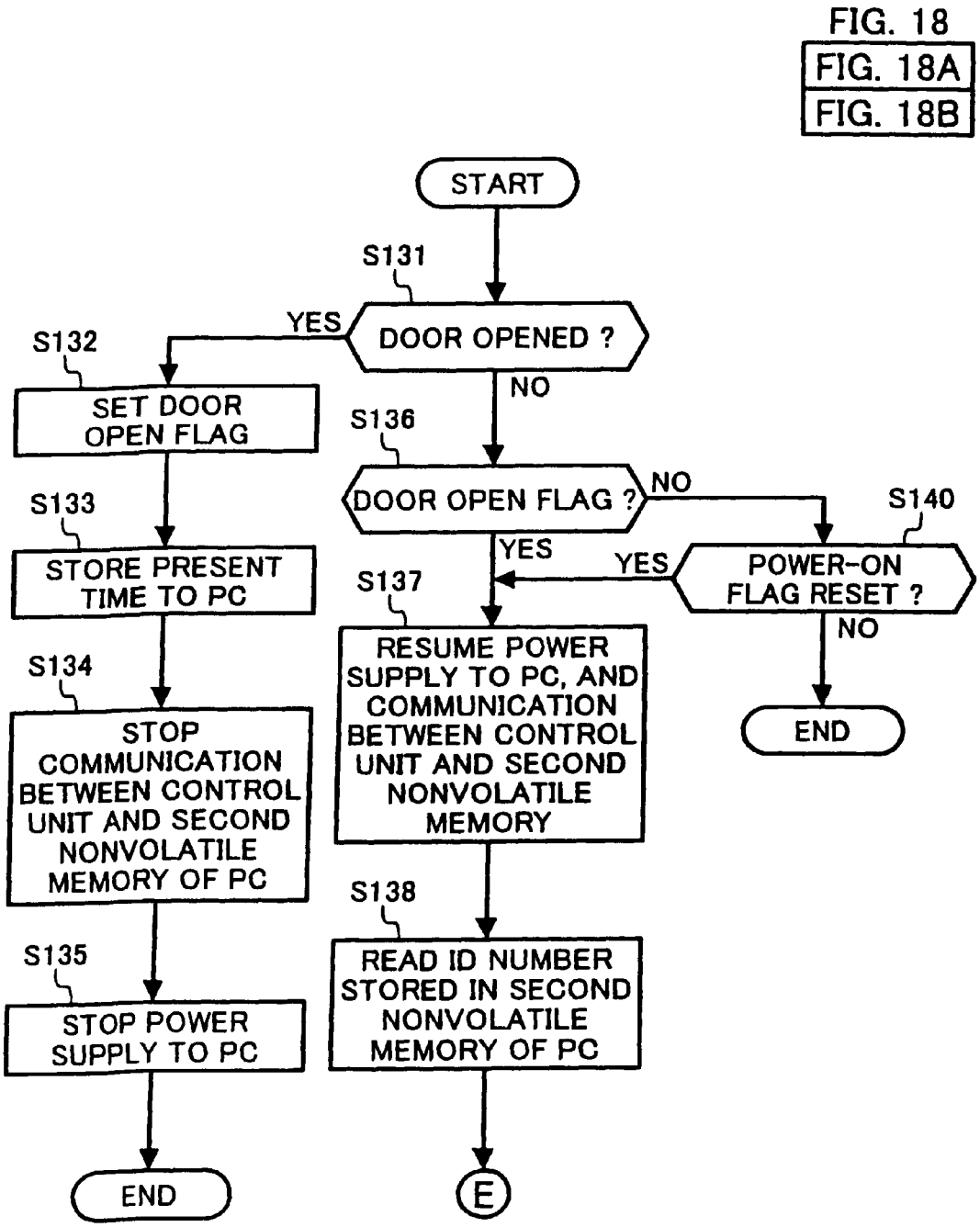
FIGS. 18A and 18B include a flow chart explaining an information check operation of the process cartridge.
Figure 18B:
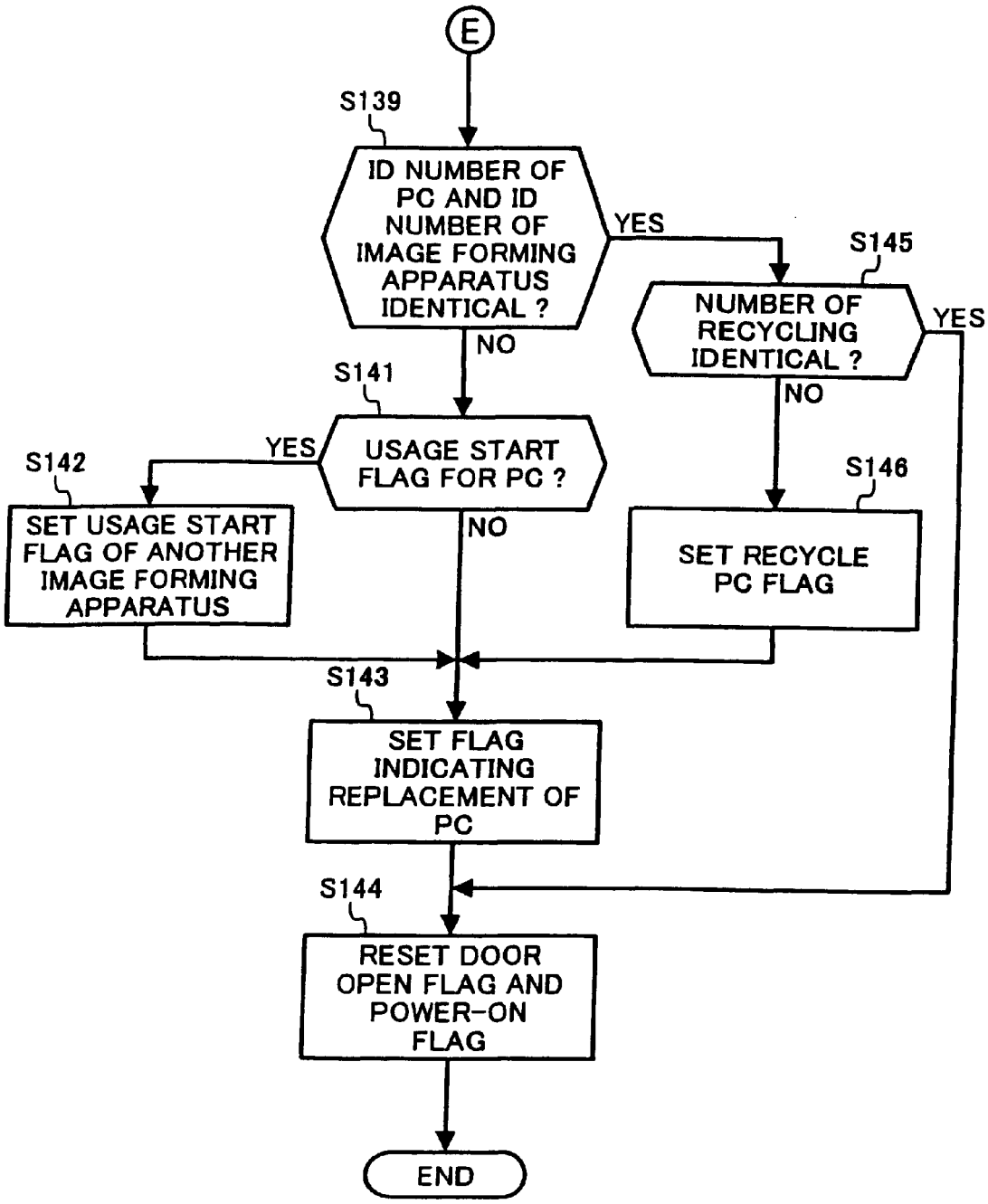

FIGS. 18A and 18B include a flow chart explaining an information check operation of the process cartridge 20.

The replacement check of the process cartridge 20 performed in Step S71 of FIG. 15 will be described in further detail with reference to FIG. 18. In FIG. 18, process cartridge is abbreviated as "PC".

The information check operation of the process cartridge 20 illustrated in FIG. 18 checks whether the process cartridge 20 is replaced from the image forming apparatus by comparing an ID number stored in the second nonvolatile memory 153 of the process cartridge 20 and an ID number stored in the first nonvolatile memory 111 of the image forming apparatus when the door of the image forming apparatus is opened and closed.

As illustrated in FIG. 18, to check whether the process cartridge 20 is replaced from the image forming apparatus, it is determined whether the door of the image forming apparatus is opened, in Step S131.

When it is determined that the door is opened, a door open flag is set, in Step S132.

After Step S132, the present time of a clock provided to the control unit 100 of the image forming apparatus is stored to the second nonvolatile memory 153 of the process cartridge 20, in Step S133.

After Step S133, communication between the control unit 100 of the image forming apparatus and the second nonvolatile memory 153 of the process cartridge 20 is stopped, in Step S134, and a power supply to the process cartridge 20 is stopped, in Step S135. Then the information check operation of the process cartridge ends.

On the other hand, when it is determined that the door is closed in Step S131, it is determined whether a door open flag is set, in Step S136.

When it is determined that the door open flag is set, that is, it is determined that the door is opened and closed, a power supply to the process cartridge 20 is resumed, and communication between the control unit 100 and the second nonvolatile memory 153 is resumed, in Step S137.

After Step S137, an ID number stored in the second nonvolatile memory 153 of the process cartridge 20 is read, in Step S138.

After Step S138, it is determined whether the above-mentioned ID number and an ID number stored in the first nonvolatile memory 111 of the image forming apparatus are identical, in Step S139.

When it is determined that the two ID numbers are not identical, it is determined whether a usage start flag for the process cartridge 20 is detected, in Step S141.

When it is determined that the usage start flag for the process cartridge 20 is detected, it is assumed that the process cartridge 20 was used in another image forming apparatus, and a flag indicating such status is set, in Step S142.

After Step S142, a flag indicating a replacement of the process cartridge is set, in Step S143.

After Step S143, a door open flag and a power-on flag are reset, in Step S144, and the information check operation of the process cartridge ends.

The above-mentioned power-on flag is set by an initializing routine when the main switch (power switch) in FIG. 12 is shifted to an "ON" state.

On the other hand, when it is determined that the usage start flag is not detected in Step S141, a flag indicating a replacement of the process cartridge is set, in Step S143. After performing Step S144, the information check operation of the process cartridge ends.

Alternatively, when it is determined that the two ID numbers are identical in Step S139, it is determined whether a number of recycling of the process cartridge 20 stored in the second nonvolatile memory 153 and a number of recycling stored in the first nonvolatile memory 111 are identical, in Step S145.

When it is determined that the two "number of recycling" are not identical, a recycle process cartridge flag is set, in Step S146. After performing Step S143 and S144, the information check operation of the process cartridge ends.

When it is determined that the two "number of recycling" are identical, in Step S145, it is assumed that the process cartridge 20 is not replaced, and Step S143 is skipped. After performing Step S144, the information check operation of the process cartridge ends.

When it is determined that the door open flag is not set in Step S136, it is determined whether a power-on flag is reset, in Step S140.

When it is determined that the power-on flag is not reset in Step S140, that is, the power supply already exists, the information check operation of the process cartridge ends.

On the other hand, when it is determined that the power-on flag is reset, after performing Step S137 and subsequent steps, the information check operation of the process cartridge ends.

In this another exemplary embodiment of the present invention, the first nonvolatile memory 111 is provided to the image forming apparatus as an independent IC detachable from the IC socket.

However, the configuration of the first nonvolatile memory 111 is not limited to such a case, but the first nonvolatile memory 111 may be formed of an EEPROM and a SRAM detachable from the IC socket, for example. In this case, information stored in the SRAM is written to the EEPROM of the first nonvolatile memory 111 to store such information when a power supply from a power source (PSU 135) to the image forming apparatus is shut down (i.e., main switch is shifted to "OFF" state).

In this another exemplary embodiment of the present invention, the first nonvolatile memory 111 for the image forming apparatus is included in the engine control board 110 of the control unit 100.

However, the configuration of the first nonvolatile memory 111 is not limited to such a case, but the first nonvolatile memory 111 may be included in the control board 101, or in each of the control board 101 and the engine control board 110, for example.

The configuration of the first nonvolatile memory 111 and the second nonvolatile memory 153 according to this another exemplary embodiment of the present invention is not restricted to the above-described configuration, but the first nonvolatile memory 111 may be an IC tag, and the second nonvolatile memory 153 may be an IC detachable from an IC socket, for example.

In this another exemplary embodiment of the present invention, a device unit is the process cartridge 20 having the second nonvolatile memory and detachable from the image forming apparatus. However, the present invention does not limit the device unit to such a process cartridge, as any device unit giving different quality to an image forming apparatus on a unit-by-unit basis can be used. The present invention defines "device unit" as a unit detachably provided to an image forming apparatus.

For example, the present invention can be applied to a device unit including the optical unit 2, the transfer belt units 24 and 30, the fixing unit 66, the sheet feeding unit 61 in FIG. 1, and the developer bottle 33 (developer cartridge) in FIGS. 2A and 2B.

In addition, in an image forming apparatus having no process cartridge, the present invention can be applied to an independent device unit for image forming process such as a photo-sensitive member in a drum shape, a charging unit, a developing unit, a cleaning unit, a transfer unit, for example.

Furthermore, the present invention can be applied to a multi-function unit formed by combining a plurality of photo-sensitive members in a drum shape, charging device, developing device, cleaning device, and transfer device, for example.

In such cases, similar effects as this another exemplary embodiment of the present invention can be obtained by providing a second nonvolatile memory, which stores necessary information for image formation quality, to a device unit, and by providing a write-prohibited area, a first writable area, and a second writable area in the second nonvolatile memory.

Hereinafter, another exemplary embodiment of the present invention will be explained, which has a common configuration to that explained with FIGS. 1 through 4.

The nonvolatile memory 157 provided to the process cartridge 20 will be explained in detail referring to FIGS. 19A and 19B. FIGS. 19A and 19B include an exemplary memory map of the nonvolatile memory 157 of the IC tag 80.

As illustrated in FIGS. 19A and 19B, as one example of an exemplary embodiment of the present invention, a first memory area is allocated with an address 00H, a third memory area is allocated with an address 20H, and a second memory area is allocated with address 30H in the nonvolatile memory 157.

As illustrated in FIGS. 19A and 19B, as one example of an exemplary embodiment of the present invention, information such as "Recycle manufacturer ID," "Replaced parts (information of replaced parts)," "Color type of developer (color ID)," "Effective period (Storage period)," "Number of copied sheets when recycled (Number of copied sheets of a recycled process cartridge)," "Number of recycling," "Recycled date," "Filling amount of developer," "Filling date of developer," "Developer remaining amount," and "Recycle usage flag set" are stored with certain bytes in the first memory area (e.g., address 00H) of the nonvolatile memory 157.

The first memory area (i.e., exclusive memory area for recycle information) mainly stores recycle information obtained when the process cartridge 20 is recycled. The recycle information stored in the first memory area is written by a reader/writer of a recycling system during recycling process. Accordingly, the reader/writer of the recycling system inputs most of the information to the first memory area.

The "recycle usage flag set" in the first memory area is set when a process cartridge relating to recycle information is used in the image forming apparatus. The validity of the recycle information is determined by a presence of the "recycle usage flag set".

The recycle information written to the first memory area is controlled such that the recycle information is not re-writable after completing a recycling to secure reliability of the recycle information.

As for information on developing method, information of a two-component agent formed of developer and carrier is input to the first memory area when the process cartridge uses a two-component developing method, and information of developer (i.e., one-component agent) is input to the first memory area when the process cartridge uses a one-component developing method.

An address 60H in the first memory area is allocated when a recycling process of the process cartridge 20 is performed for a second time. As illustrated in FIG. 19, another new area for the first memory area is allocated whenever the process cartridge 20 is recycled. Therefore, a plurality of recycling history can be stored.

As illustrated in FIGS. 19A and 19B, as one example of an exemplary embodiment of the present invention, information such as "Usage start date," "Usage start signal," "Write-prohibited flag," "Abnormal history (history of abnormal image)," "Malfunction history (history of maintenance)," "Number of copied sheets," and "Developer remaining amount" are stored with certain bytes in the third memory area (e.g., at address 20H) of the nonvolatile memory 157.

The information of the third memory area (i.e., exclusive memory area for writing) is mainly usage history information (i.e., non-permanent information) obtained after the process cartridge 20 is installed in the image forming apparatus. The non-permanent information in the third memory area is re-writable because it changes when the process cartridge 20 is operated.

The non-permanent information stored in the third memory area is written by communication from the control unit 100 of the image forming apparatus. Accordingly, the control unit 100 inputs most of the information stored in the third memory area.

The non-permanent information stored in the third memory area is useful for performing a recycling of the process cartridge 20. The reader/writer of the recycling system reads information in the third memory area during the recycling process, and the recycling is performed based on such information. For example, components relating to "abnormal history" and "malfunction history" are replaced with new components even though "number of copied sheets" is still within the predetermined limit (lifetime).

"Usage start date" and "Usage start signal" stored in the third memory area can be written only when the process cartridge 20 is actually started for operation (i.e., one time only writable information). Writing of this information is controlled with the write-prohibited flag.

As illustrated in FIGS. 19A and 19B, as one example of an exemplary embodiment of the present invention, information such as "Lot No.," "Manufacturer (Manufacturer ID)," "Manufactured date," "Serial No.," "Limit of number of recycling," "Product group ID available for process cartridge," "Version of process cartridge," "Amount of exposed light," "Amount of charging," "Developing bias voltage," "Developer property information," and "To be replaced part information" are stored with certain bytes in the second memory area (e.g., at address "30H") of the nonvolatile memory 157.

The information of the second memory area (i.e., write-prohibited area) is mainly permanent information specifying a state of an image forming apparatus and process cartridge 20 newly manufactured and shipped from a factory. Because the information of the second memory area is mainly permanent information specified at the time of the manufacturing, information overwriting after shipment is prohibited.

The information stored in the second memory area is written by communication from the control unit 100 through operating the operation unit 90 of the image forming apparatus during the manufacturing, or by communication from an external writing device in a factory.

"To be replaced part information" stored in the second memory area designates components to be replaced during recycling. For example, if it is determined that the quality of process cartridge 20 is influenced greatly by the photo-sensitive member 21 in drum shape and the cleaning blade 25*a*, information of unconditional replacement of the photo-sensitive member 21 in drum shape and the cleaning blade 25*a* during a recycling process is stored as "To be replaced part information."

As an example of this another embodiment of the present invention, the part to be replaced may include an image carrying member and a cleaning blade.

On one hand, "Replaced part" information stored in the first memory area includes actually replaced parts during a recycling process.

"Amount of exposed light," "Amount of charging," and "Developing bias voltage", stored in the second memory area, relate to the image forming process explained with FIGS. 1 and 2, and refer to "amount of exposed laser light L in a exposing process," "amount of charging (potential) of the charging device 22 in a charging process," "developing bias voltage of the developing device 23 in a developing process," respectively, and these are customized information for the image forming apparatus to optimize image forming.

As explained above, the nonvolatile memory 157 is configured to have the first memory area, the second memory area, and the third memory area, to which information is input from different source, and the information stored in the nonvolatile memory is effectively organized and utilized.

Next, control operations of the above-described process cartridge 20 will be explained in detail referring to FIGS. 20A, 20B, 21, and 22.

Figure 20A:
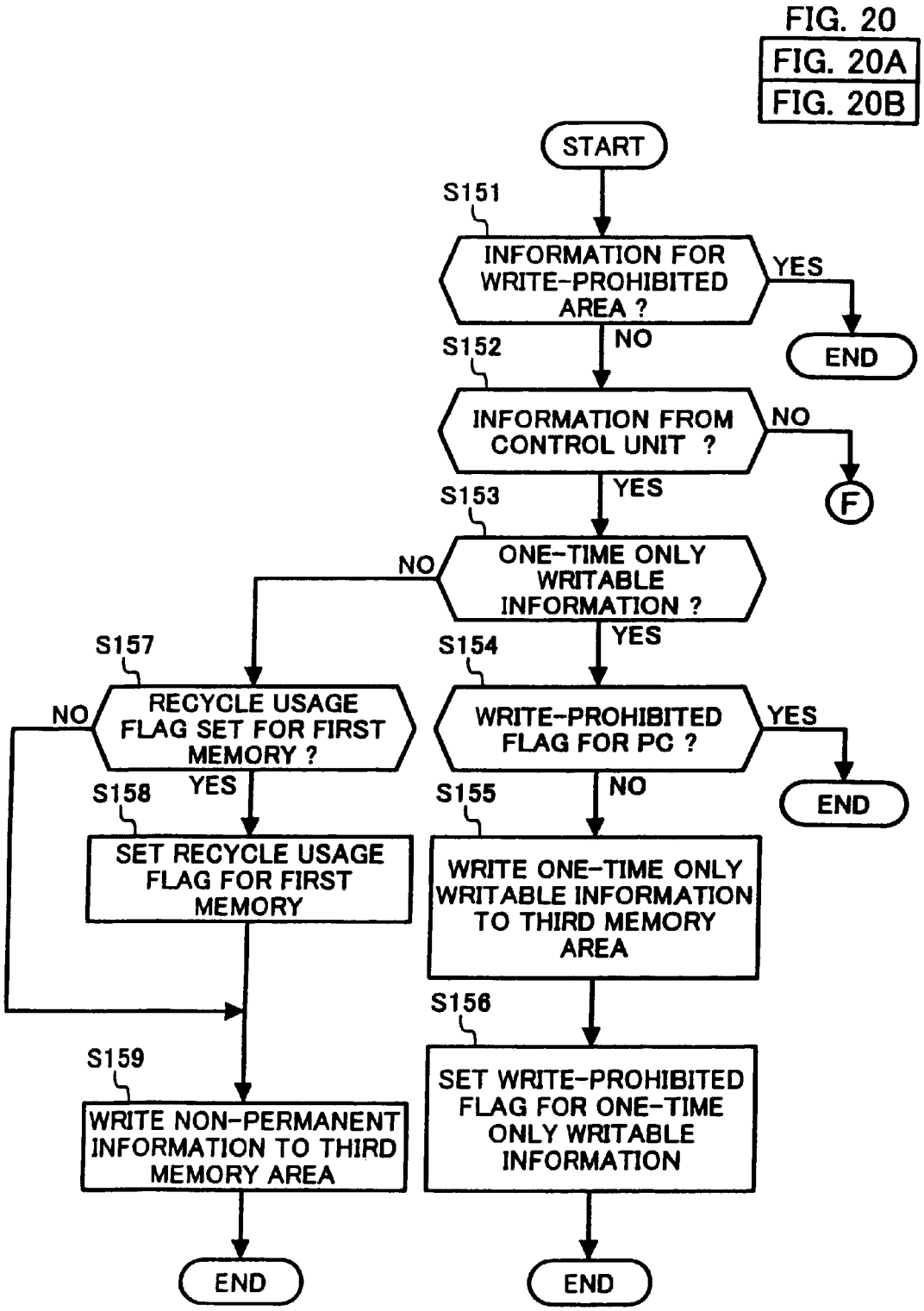
FIGS. 20A and 20B include a flow chart explaining an information writing operation for the nonvolatile memory of the process cartridge.
Figure 20B:
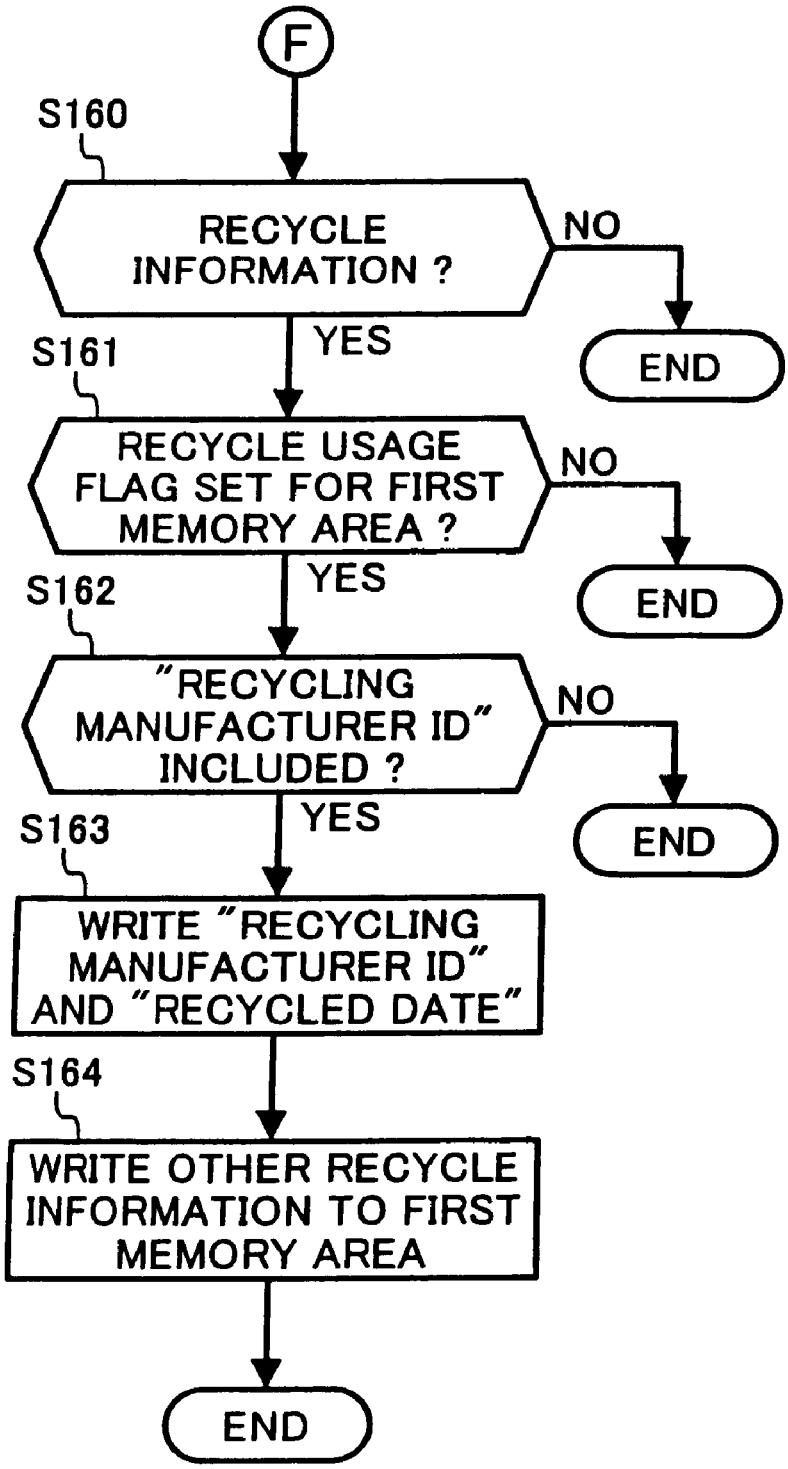

FIGS. 20A and 20B include is a flow chart explaining an information writing operation for the nonvolatile memory 157 in the process cartridge 20. In FIGS. 20A and 20B, process cartridge is abbreviated as "PC".

As illustrated in FIGS. 20A and 20B, it is determined whether transmitted information is write-prohibited information, in Step S151.

When it is determined that the information is the write-prohibited information in Step S151, the information writing operation ends.

When it is determined that the transmitted information is not write-prohibited information in Step S151, it is determined whether the information is transmitted from the control unit 100 of the image forming apparatus, in Step S152.

When it is determined that the information is transmitted from the control unit 100 in Step S152, it is determined whether the information is one-time only writable information for the third memory area of the nonvolatile memory 157, in Step S153.

When it is determined that the information is the one-time only writable information in Step S153, it is determined whether a write-prohibited flag is set for the third memory area of the nonvolatile memory 157, in Step S154.

When it is determined that the write-prohibited flag is set in Step S154, it is assumed that the process cartridge 20 is already used in the image forming apparatus, and the information writing operation ends without writing the one-time only writable information.

When it is determined that the write-prohibited flag is not set in Step S154, it is assumed that the process cartridge 20 is to be used from now, and the one-time only writable information ("Usage start date" and "Usage start signal") is written to the third memory area, in Step S155.

After Step S155, a write-prohibited flag is set for the one-time only writable information, in Step S156. Then the information writing operation ends.

On the other hand, when it is determined that the information received by the nonvolatile memory 157 is not the one-time only writable information in Step S153, it is determined whether a recycle usage flag is set for the first memory area of the nonvolatile memory 157, in Step S157.

That is, it is determined whether the first memory area (i.e., exclusive memory area for recycle information) having recycle information to be used for the first time is detected. This is due to the fact that a new address is set for the first memory area whenever a recycling is performed.

When it is determined that the first memory area to be used for the first time is detected in Step S157, a recycle usage flag is set for the first memory area, in Step S158.

On the other hand, when it is determined that the first memory area to be used for the first time is not detected in Step S157, Step S158 is skipped.

After Step S158, non-permanent information (i.e.,"Number of copied sheets," "Developer remaining amount," "Abnormal history," and "Malfunction history") transmitted from the image forming apparatus is written to the third memory area of the nonvolatile memory 157, in Step S159. Then the information writing operation ends.

When it is determined that the information transmitted to the nonvolatile memory 157 is not transmitted from the image forming apparatus in Step S152, it is determined whether the information is recycle information, in Step S160.

When it is determined that the information is not the recycle information in Step S160, it is assumed that a recycling processing is not performed, and the information writing operation ends.

On the other hand, when it is determined that the transmitted information is the recycle information in Step S160, it is assumed that the information is transmitted from the reader/writer of the recycling system, and it is determined whether a recycle usage flag is set for the first memory area of the nonvolatile memory 157, in Step S161.

That is, it is determined whether the first memory area (i.e., exclusive memory area for recycle information) to be used for the first time is allocated in Step S161. This is due to the fact that a new address is set for the first memory area whenever a recycling is performed.

When it is determined that the first memory area (exclusive memory area for recycle information) to be used for the first time is not allocated in Step S161, the information writing operation ends.

On the other hand, when it is determined that the first memory area (i.e., exclusive memory area for recycle information) to be used for the first time is allocated in Step S161, it is determined whether the recycle information includes "Recycle manufacturer ID" (i.e., information of recycle manufacturer), in Step S162.

When it is determined that the recycle information does not include "Recycle manufacturer ID" in Step S162, it is determined that responsibility of quality assurance of the recycled process cartridge is not identified clearly, and the information writing operation ends.

On the other hand, when it is determined that the recycle information includes "Recycle manufacturer ID" in Step S162, it is assumed that responsibility of quality assurance of the recycled process cartridge is identified clearly, and the "Recycle manufacturer ID" and "Recycled date" are overwritten to the first memory area of the nonvolatile memory 157, in Step S163.

After Step S163, other recycle information (i.e., "Replaced part," "Color type," "Effective usage period," "Number of copied sheets when recycled," "Number of recycling," "Filling amount of developer," "Filling date of developer," and "Developer remaining amount") is written to the first memory area of the nonvolatile memory 157 in Step S163, and the information writing operation ends.

Next, a control operation of the image forming apparatus when the power is supplied will be explained with reference to FIG. 21.

Figure 21:
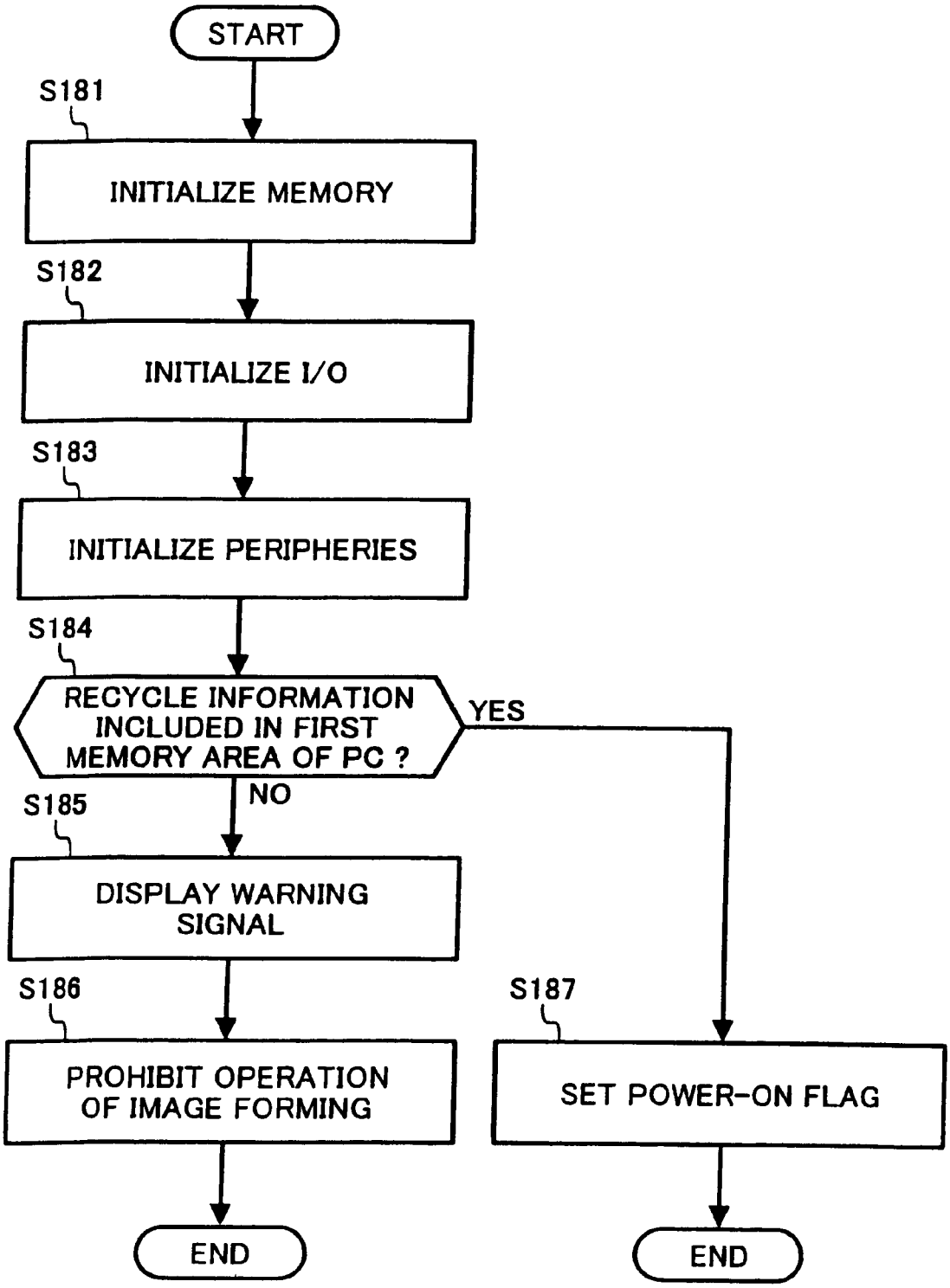
FIG. 21 is a flow chart explaining an initializing operation when power is supplied to the image forming apparatus.

FIG. 21 is a flow chart explaining an initializing operation when power is supplied to the image forming apparatus. In FIG. 21, process cartridge is abbreviated as "PC".

When a power is supplied to the image forming apparatus, it is checked whether a process cartridge, assured in quality by a certain manufacture, is installed.

As illustrated in FIG. 21, when the power is supplied to the image forming apparatus, initializing process of a memory of the image forming apparatus is performed, in Step S181. Specifically, memories such as SRAM in the control unit 100 of the image forming apparatus are cleared and initialized.

After Step S181, initializing process of the I/O of the image forming apparatus is performed, in Step S182, and initializing processes of peripheries connected to the image forming apparatus such as setting initialization are performed, in Step S183.

After Step S183, information in the first memory area of the nonvolatile memory 157 of the recycled process cartridge installed in the image forming apparatus is read, and it is determined whether the first memory area has necessary recycle information, in Step S184.

When it is determined that the first memory area has necessary recycle information, it is assumed that the manufacturer assuring quality of the process cartridge is identified, and a power-on flag for the control unit 100 is set, in Step S187. Then the initializing operation ends. After such steps, image forming operations such as copying can be performed.

On the other hand, when it is determined that the first memory area does not have at least a part of a necessary recycle information in Step S184, it is assumed that the manufacturer assuring quality of the process cartridge is not identified, and a warning signal is displayed on the display portion of the operation unit 90 of the image forming apparatus, in Step S185.

For example, a warning signal such as "Installed process cartridge is not manufactured by our company, and a manufacturer of the process cartridge is not identified. Therefore, the quality of the cartridge can not be assured" is displayed.

After Step S185, operation of the image forming apparatus is prohibited, in Step S186. Then the initializing operation ends.

In this another exemplary embodiment, a process cartridge is not restricted to a cartridge recycled by a genuine manufacturer. A process cartridge recycled by a non-genuine manufacturer can be used without limitation as long as necessary recycle information such as "Recycle manufacturer ID" is written to the nonvolatile memory during recycling process. In this way, the manufacturer that assures quality of the recycled process cartridge is identified, and a variety of choices for process cartridges can be provided to users.

Next, a control operation of the image forming apparatus when the door is opened will be explained referring to FIG. 22.

Figure 22:
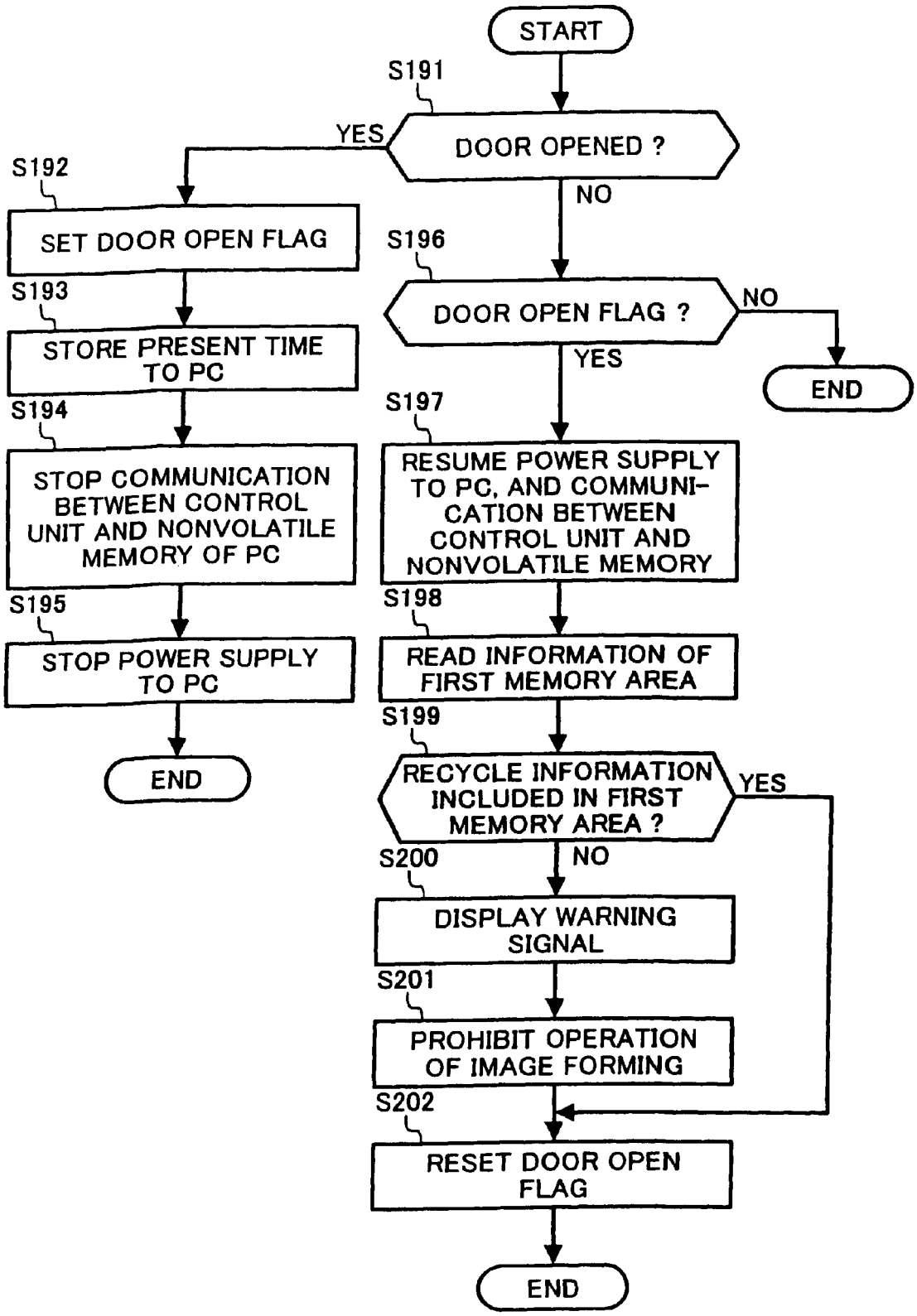
FIG. 22 is a flow chart explaining an information check operation when a door of the image forming apparatus power is opened.

FIG. 22 is a flow chart explaining an information check operation when a door of the image forming apparatus power is opened.

As illustrated in FIG. 22, when the door of the image forming apparatus is opened, it is checked whether the manufacturer assuring quality of the process cartridge can be identified because the process cartridge may be replaced in such a case. In FIG. 22, process cartridge is abbreviated as "PC".

As illustrated in FIG. 22, to check whether the process cartridge (or device unit) is replaced from the image forming apparatus, it is determined whether the door of the image forming apparatus is opened, in Step S191.

When it is determined that the door of the image forming apparatus is opened in Step S191, a door open flag is set, in Step S192.

After Step S192, a present time of the clock provided to the control unit 100 of the image forming apparatus is stored in the nonvolatile memory 157 of the process cartridge 20, in Step S193.

After Step S193, communication between the control unit 100 and the nonvolatile memory 157 of the process cartridge 20 is stopped, in Step S194, and a power supply to the process cartridge is stopped, in Step S195. Then, the information check operation ends.

On the other hand, when it is determined that the door of the image forming apparatus is closed, in Step S191, it is determined whether the door open flag is set, in Step S196.

When it is determined that the door open flag is set in Step S196, it is assumed that that the door is opened and closed. Then the power supply to the process cartridge 20 is resumed, and the communication between the control unit 100 and the nonvolatile memory 157 of the process cartridge 20 is also resumed, in Step S197.

When it is determined that the door open flag is not set in Step S196, the information check operation ends.

After Step S197, information in the first memory area of the nonvolatile memory 157 of the process cartridge 20 installed in the image forming apparatus is read, in Step S198, and it is determined whether the first memory area of the nonvolatile memory 157 of the process cartridge 20 has necessary recycle information, in Step S199.

When it is determined that the first memory area of the nonvolatile memory 157 of the process cartridge 20 has recycle information, it is assumed that the manufacturer assuring quality can be identified, and the door open flag of the control unit 100 is reset, in Step S202, and the information check operation ends. Then image forming operations can be performed.

On the other hand, when it is determined that the first memory area of the nonvolatile memory 157 of the process cartridge 20 does not have recycle information, in Step S199, it is assumed that the manufacturer assuring quality cannot be identified, and a warning signal is displayed on the display portion of the operation unit 90 of the image forming apparatus, in Step S200.

After Step S200, operation of the image forming apparatus is prohibited, in Step S201, and the door open flag is set, in Step S202. Then the information check operation ends.

In this another exemplary embodiment, a warning signal is displayed and image forming operations are prohibited based on contents of the recycle information stored in the first memory area.

Furthermore, operational conditions of the image forming apparatus can be controlled based on the recycle information stored in the first memory area. For example, based on the recycle information of the recycled process cartridge, the optical unit 2, a charging power source, and a developing power source can be controlled to obtain an optimal image forming condition for the cartridge such as "Amount of exposed light," "Amount of charging," and "Developing bias voltage". In this way, image quality can be optimized.

Next, as one example of an exemplary embodiment of the present invention, a recycling system for the above-described process cartridge 20 will be explained with referring to FIGS. 23 and 24.

Figure 23:
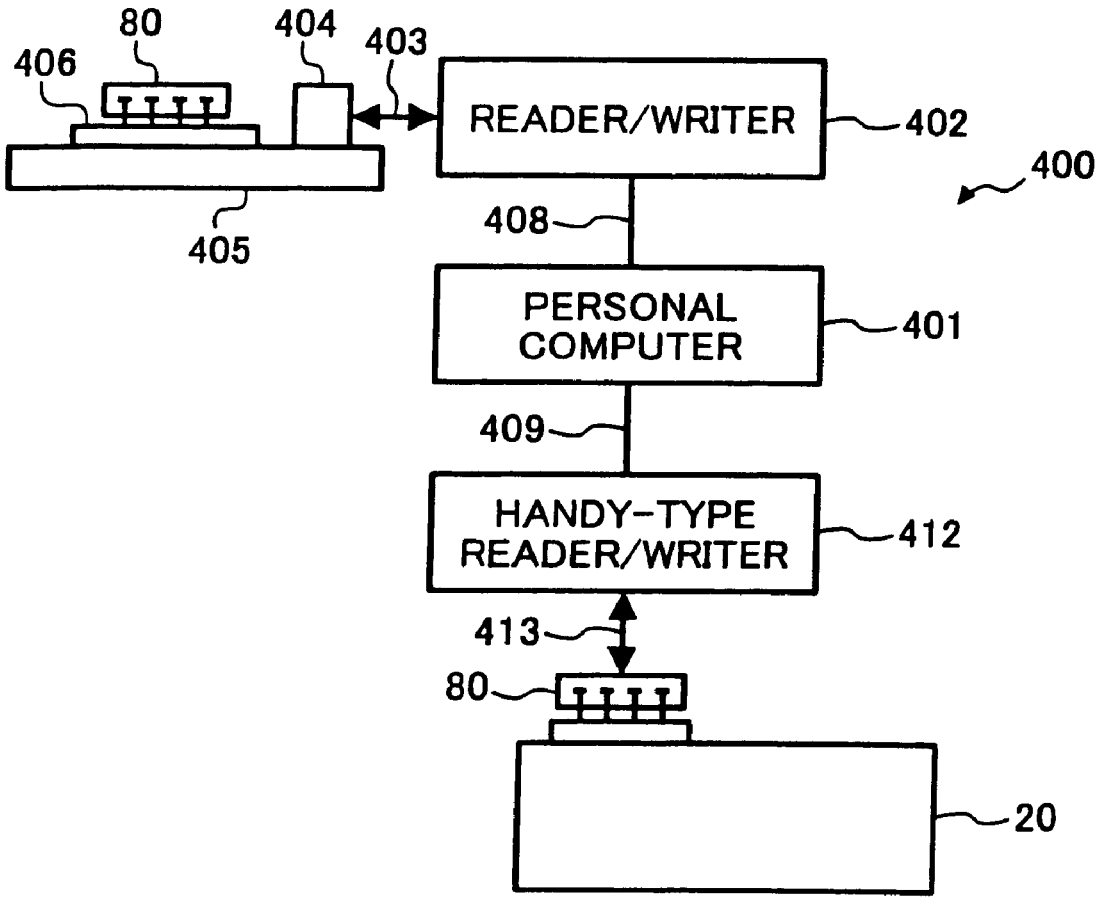
FIG. 23 is an exemplary schematic configuration for a recycling system.

FIG. 23 is an exemplary schematic configuration for a recycling system.

Figure 24:
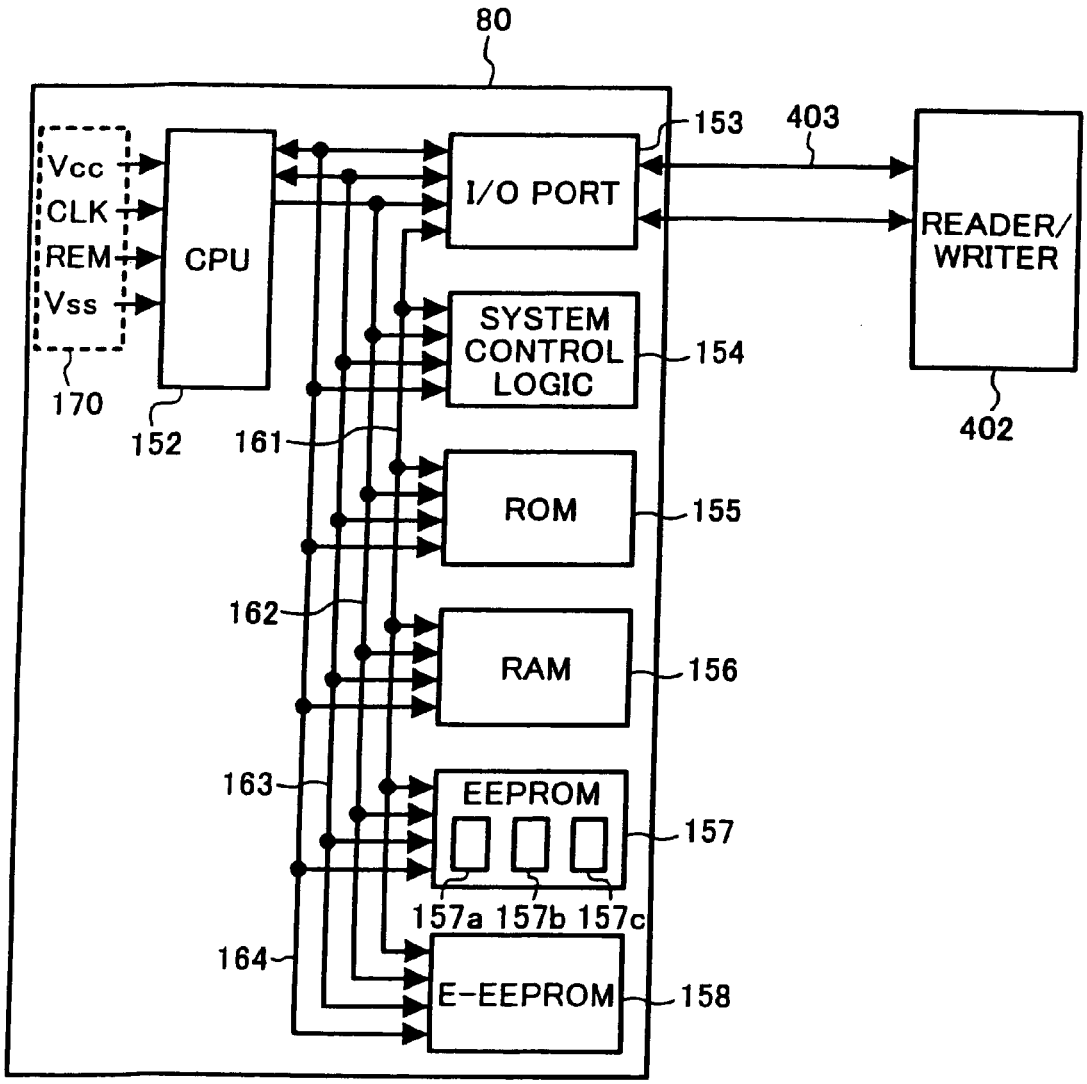
FIG. 24 is an exemplary block diagram illustrating an IC tag coupled to the recycling system in FIG. 23.

FIG. 24 is an exemplary block diagram illustrating an IC tag coupled to the recycling system in FIG. 23.

A used process cartridge 20 is detached from the image forming apparatus, delivered to a recycle manufacturer through a distribution channel, and recycled by the recycling system.

As illustrated in FIG. 23, as one example of an exemplary embodiment of the present invention, a recycling system 400 includes a personal computer 401, and a reader/writer 402 connected to the personal computer 401 via a USB 408. Furthermore, a board 405 provided with connector 404 and a socket 406 is connected to the reader/writer 402 via an I2C bus 403.

The IC tag 80 of the process cartridge 20 to be recycled is inserted to the socket 406 to perform communication between the reader/writer 402 and the IC tag 80.

Specifically, as explained with FIGS. 19 and 20, the reader/writer 402 writes the recycle information to the first memory area of the IC tag 80, and reads the non-permanent information stored in the third memory area of the IC tag 80.

The IC tag 80 is coupled to the reader/writer 402 as in a block diagram illustrated in FIG. 24.

As illustrated in FIG. 24, the I/O port 153 is coupled to the reader/writer 402 in the recycling system 400 in FIG. 23, which is different from the case explained with FIG. 4.

In this way, communication is performed between the reader/writer 402 and the nonvolatile memory 157 of the IC tag 80.

As illustrated in FIG. 23, as one example of an exemplary embodiment of the present invention, the recycling system 400 can also include a handy type reader/writer 412 connected to the personal computer 401 via an USB 409. The handy type reader/writer 412 can communicate with a non-contact type IC tag 80 via a wireless communication 413. In this case, the handy type reader/writer 412 communicates with the non-contact type IC tag 80 while the non-contact type IC tag 80 is installed on the process cartridge 20.

As above described, in this another exemplary embodiment, even if the process cartridge 20 detachable from the image forming apparatus is recycled by a genuine manufacture, or a non-genuine manufacture, the process cartridge 20 can be used without any limitations as long as necessary recycle information such as "Recycle manufacturer ID" is written to the nonvolatile memory 157 of the process cartridge 20.

In this way, a manufacturer that assures quality for the recycled process cartridge is identified, and a variety of choices of the process cartridge can be provided to users.

In this another exemplary embodiment of the present invention, a device unit is the process cartridge 20 having the nonvolatile memory 157 and detachable from the image forming apparatus. However, the present invention does not limit the device unit to such a case, but any device units giving different quality to an image forming apparatus on a unit-by-unit basis can be used. The present invention defines that "a device unit" is a unit detachably provided to an image forming apparatus.

For example, the present invention can be applied to a device unit including the optical unit 2, the transfer belt units 24 and 30, the fixing unit 66, the sheet feeding unit 61 in FIG. 1, and the developer bottle 33 (developer cartridge) in FIG. 2.

In addition, in an image forming apparatus having no process cartridge, the present invention can be applied to an independent device unit for image forming process such as a photo-sensitive member in a drum shape, a charging unit, a developing unit, a cleaning unit, and a transfer unit, for example.

Furthermore, the present invention can be applied to a multi-function unit formed by combining a plurality of photo-sensitive member in a drum shape, charging device, developing device, cleaning device, and transfer device, for example.

In such cases, similar effects as this another exemplary embodiment of the present invention can be obtained by providing a nonvolatile memory, storing necessary information for image formation quality, to a device unit, and by providing a first memory area, a second memory area, and a third memory area in the nonvolatile memory.

This another exemplary embodiment of the present invention is applied to an image forming apparatus using an electro-photography. However, the present invention is not limited to such a case, but can be applied to a variety of image forming apparatuses provided with device units such as an image forming apparatus using an ink jet method, and an image forming apparatus using a heat transfer method.

The present invention includes a device unit, an image forming apparatus, and a management system, which ensure operational reliability to users regardless of types of a device unit (i.e. genuine product or non-genuine product, recycled product or non-recycled product) by operating with optimal conditions.

The present invention also includes a device unit, an image forming apparatus, and a management system, which identify a responsibility for quality assurance even if a device unit is recycled by a non-genuine manufacturer to ensure reliability of the device unit to both users and manufacturers without limiting a user's choice.

Numerous additional modifications and variations are possible in light of the above teachings. It is therefore to be understood that within the scope of the appended claims, the disclosure of the present invention may be practiced otherwise than as specifically described herein.

The invention claimed is:

1. A device unit detachably provided to an image forming apparatus having a control unit configured to control the image forming apparatus, the device unit comprising:

a CPU configured to communicate with the control unit; and a memory configured to store property information including information provided through a communication between the CPU and the control unit, the memory including:

a first writable area configured to allow information writing, and a second writable area configured to controllably prohibit or allow overwriting of information therein.

2. A device unit detachably provided to an image forming apparatus having a control unit configured to control the image forming apparatus, the device unit comprising:

a CPU configured to communicate with the control unit; and a memory configured to store property information including information provided through a communication between the CPU and the control unit, the memory including:

a write-prohibited area configured to prohibit information overwriting, a first writable area configured to allow information writing, and a second writable area configured to controllably prohibit or allow a one time overwriting of information therein.

3. The device unit according to claim 2, wherein the second writable area of the memory is configured to allow a one time overwriting of information therein when the device unit recognizes a predetermined code transmitted from the control unit.

4. The device unit according to claim 2, wherein the write-prohibited area, the first writable area, and the second writable area of the memory are allocated in a way corresponding to product group identifications.

5. A device unit detachably provided to an image forming apparatus having a control unit configured to control the image forming apparatus, the device unit comprising:

a CPU configured to communicate with the control unit; and a memory configured to store property information including information provided through a communication between the CPU and the control unit, the memory including:

a write-prohibited area configured to prohibit information overwriting, a first writable area configured to allow information writing, and wherein the write-prohibited area of the memory is configured to cancel the prohibition of information overwriting.

6. The device unit according to claim 5, wherein the write-prohibited area of the memory is configured to allow a one time overwriting of information therein when the device unit recognizes a predetermined code transmitted from the control unit.

7. The device unit according to claim 1, wherein the memory is included in an IC tag detachably provided to the device unit.

8. The device unit according to claim 1, further comprising at least one of an image carrying member, a charging device, a developing device, a transfer device, and a cleaning device.

9. The device unit according to claim 1, wherein the memory further comprises a write-prohibited area configured to allow information writing, and the write prohibited area stores information relating to image forming conditions.

10. The device unit according to claim 1, further comprising a developer cartridge configured to store developer.

11. The device unit according to claim 1, wherein the memory further comprises a write-prohibited area configured to allow information writing, and the write prohibited area stores information relating to manufacturing of the device unit.

12. The device unit according to claim 1, wherein the first writable area of the memory stores information relating to an operational history of the device unit.

13. The device unit according to claim 1, wherein the second writable area is configured to controllably prohibit or allow a one time overwriting of information therein, and the second writable area stores information relating to a start time of using the device unit.

14. The device unit according to claim 1, wherein the memory includes a nonvolatile memory.

15. An image forming apparatus, comprising:

a control unit configured to control the image forming apparatus and including a control unit memory; and a device unit including a CPU configured to communicate with the control unit; and a device unit memory configured to store property information including information provided through a communication between the CPU and the control unit, the device unit memory including:

a first writable area configured to allow information writing, and a second writable area configured to controllably prohibit or allow overwriting of information therein.

16. The image forming apparatus according to claim 15, wherein the image forming apparatus is coupled to a management system which administers operational status of the image forming apparatus via a public telecommunication line or Internet, and is configured to transmit information stored in the memory to the management system via the public telecommunication line or the Internet.

17. The image forming apparatus according to claim 15, wherein the image forming apparatus is coupled to a management system which administers operational status of the image forming apparatus via a public telecommunication line or Internet, and is configured to receive information from the management system via the public telecommunication line or the Internet, and to store the information from the management system into the memory.

18. The image forming apparatus to claim 15, wherein the memory includes a nonvolatile memory.

* * * * *